United States Patent [19]

Fushiki et al.

[11] 4,192,680

[45] Mar. 11, 1980

[54] PROCESS FOR TREATING LIGHT-SENSITIVE SILVER HALIDE COLOR PHOTOGRAPHIC MATERIAL

[75] Inventors: Isamu Fushiki; Atushi Kamitakahara, both of Hino; Keiichi Mori, Odawara, all of Japan

[73] Assignee: Konishiroku Photo Industry Co., Ltd., Tokyo, Japan

[21] Appl. No.: 908,913

[22] Filed: May 24, 1978

[30] Foreign Application Priority Data

May 26, 1977 [JP] Japan ..... 52-61917

[51] Int. Cl.[2] ..... G03C 7/00

[52] U.S. Cl. ..... 430/380; 430/388; 430/467

[58] Field of Search ..... 96/22, 55, 66.5, 56.2, 96/56.4, 56.5

[56] References Cited

U.S. PATENT DOCUMENTS

| | | | |
|---|---|---|---|
| 3,243,294 | 3/1966 | Barr | 96/22 |
| 3,658,525 | 4/1972 | Bent et al. | 96/22 |
| 3,759,710 | 9/1973 | Nagae et al. | 96/22 |
| 3,869,288 | 3/1975 | Godowsky | 96/22 |
| 3,960,570 | 6/1976 | Oishi et al. | 96/22 |
| 3,997,348 | 12/1976 | Shimamura et al. | 96/22 |
| 4,046,571 | 9/1977 | Mertz | 96/66.5 |

*Primary Examiner*—J. Travis Brown

*Attorney, Agent, or Firm*—Bierman & Bierman

[57] ABSTRACT

A process for developing an image-wise exposed light-sensitive silver halide color photographic material comprising developing said material with a solution containing a specified concentration range of bromide ion in the presence of at least one of certain active point substitution type yellow couplers.

11 Claims, No Drawings

PROCESS FOR TREATING LIGHT-SENSITIVE SILVER HALIDE COLOR PHOTOGRAPHIC MATERIAL

This invention relates to a process for treating a light-sensitive silver halide color photographic material (referred to hereinafter simply as a color photography treating process), particularly to a color photography treating process whereby a dye image excellent in granularity is provided.

With regard to the color photography treating process, it is known to use a p-phenylenediamine developing agent together with a coupler to form a color image. The outline of this process is described in Thirtle's Encylopedia of Chemical Technology, 5, 812–845 (1964) (John Wiley & Sons, Inc.). A color developing agent is oxidized with silver halide in the presence of a latent image of a photographic element to give metal silver and an oxide of the color developing agent. The oxide of the color developing agent is then subjected to coupling with an exisiting color forming compound to form indophenol, indoaniline, indamine, azomethine, phenoxazine, phenazine and other dyes similar thereto, and thus a dye image being formed. In this mode of process, usually the subtractive color method is used for color reproduction and yellow, magenta and cyan dye image forming agents (so-called coupler) which are complementary colors, respectively, with regard to silver halide emulsions selectively sensitive to blue, green and red lights, respectively, are used. For the formation of a yellow dye image, there is used, for example, an acylacetanilide or dibenzoylmethane series coupler. For the formation of a magenta dye image, a pyrazolone, pyrazolobenzimidazole, cyanoacetophenone or indazolone series coupler is primarily used and for the formation of a cyan dye image, a phenol series coupler, for example, phenols and naphthols are primarily used.

Color development of separately sensitized emulsion layers of color photographic element containing a non-diffusible coupler is conveniently effected in a single color development step and when this development step is the first development step, color negative image reproduction is achieved and when it is followed by a negative black and white development step and subsequently a step where remaining unexposed and undeveloped silver halide is enabled to be developed and then color developed, color reversal image is obtained. In a non-diffusible coupler-free color reversal photographic element, a diffusible coupler is used in an alkaline aqueous color developing solution which is employed for selectively color developing a certain silver halide emulsion layer in one time. For effecting reversal treatment of such multi-color, mulit-layer element (to which no coupler is added), there is required, subsequent to the negative black and white treatment, a step which comprises enabling the remaining unexposed and undeveloped silver halide of a certain emulsion layer to be selectively developed, then color developing said layer with a color developing solution containing a diffusible coupler, forming a non-diffusible dye which is a complementary color to the light which is sensitive to this layer, further enabling unexposed and undeveloped silver halide of a second emulsion layer to be selectively developed, color developing said layer with another color developing solution containing a diffusible coupler, forming a non-diffusible dye which is a complementary color to the light which is sensitive to the layer, then enabling unexposed and undeveloped silver halide of a third emulsion layer, enabling the layer to be developed with another color developing solution containing a diffusible coupler, effecting color developing and forming a non-diffusible dye which is a complementary color to the light which is sensitive to this layer. After completion of the color developing, the photographic element is subjected to silver bleaching and then fixing to remove silver and the remaining silver halide.

Light-sensitive silver halide photographic material is, in general, widely used because of its high light-sensitivity and excellent image properties. However, worldwide shortness of silver resources and the consequent increase in the price of the raw materials recently become a great problem. In particular, for the light-sensitive silver halide photographic material in which silver is used in a great amount, such problem is considered with great interest to be a disadvantageous factor of the industrial matter, and consequently there is an increase in the technical requirement for removing such disadvantageous factor. As a technique for satisfying the above requirement, a silver-saving type light-sensitive silver halide photographic material has been suggested and some of the art have already been known. For example, as described in British Patent No. 1,331,179, it is known to use so-called 2 equivalents type coupler (active point substitution type coupler) which makes it sufficient to use 2 atoms of silver, though 4 atoms of silver was previously required, for giving 1 molecule of a dye by the introduction of a substituent into the active point of a color coupler. According to this method, it is possible theoretically to reduce the amount of silver used to one half of that required in the case where the so-called 4 equivalents type coupler is used. Actually, however, it is possible to reduce the amount of silver to less than one half, because the efficiency for utilizing silver is higher in comparison with the case where the 4 equivalents type coupler is used.

Further, due to its high reactivity during the development process and its ability for formation of a dye of satisfactory density during the development, the active point substitution type coupler as above-mentioned requires no after treatment with a processing solution containing a particular oxidizing agent as required in the use of the old, dye-formation coupler. Thus, the afore-mentioned active point substitution type coupler is advantageous also in the simplification and increase in the rate of treatment. Thus the active point substitution type coupler has recently been begun to be used with a view to achieving save of silver and increase in the rate of treatment. However, use of the active point substitution type coupler is accompanied with significant drawbacks that said coupler itself is unstable and the granularity of the resulting dye image will get worse. Such phenomenon is particularly outstanding in the dye image obtained by the yellow active point substitution type coupler. For the purpose of improving the granularity of a dye image, addition of 1-phenyl-5-mercaptotetrazole, so-called DIR coupler (Development Inhibitor Releasing coupler) as described in U.S. Pat. No. 3,617,291, development inhibitor-releasing type compound described in U.S. Pat. No. 3,632,345 or a polyvinylpyrrolidone to a light-sensitive color photographic material has been known. However, when the additive is made to a light-sensitive color photographic material, there would be observed some drawbacks that the photographic speed is reduced and destruction of a latent image occurs, and the practical use of the light-sensitive color photographic material was problematic. Further, there is effected incorporation of 1-phenyl-5-mercaptotetrazole into a color developing solution. This is effective in certain degree to improve the granularity, but due to its strong inhibition action, a slight variation in the processing solution causes a great change of the photographic characteristics and, in particular, such procedure is not suitable for the continuous treatment by means of an automatic processing machine, which requires a constant and uniform finishings. Thus, no satisfactory results can have been obtained.

On the other hand, a light-sensitive silver halide color photographic material (referred to hereinafter simply as "light-sensitive color photographic material") has the drawback that it is particularly sensitive to the admixture of chemicals which possess fixing action, particularly a processing solution containing a thiosulfuric acid ion or a thiocyanic acid ion into the color developing solution and readily causes color fog due to such admixture. Recently, a bleaching and fixing solution which possesses at the same time both the bleaching action and the fixing action has been used in a subsequent treatment following to the color development to achieve rapid treatment and consequently the admixture of an ingredient having the fixing action into the color developing solution occurs in more times and this has become a problem. (Such phenomenon is particularly outstanding in the automatic developing machine which deals with a large quantity.)

There has not been found any formula of such color developing solution that is stable against the admixture of chemicals possessing fixing action.

The first object of this invention is to provide a process for treating a light-sensitive color photographic material yielding a color photographic image excellent in granularity of a yellow dye image.

The second object of this invention is to provide a process for forming an image by treating rapidly a light-sensitive color photographic material.

The third object of this invention is to provide a process for treating a light-sensitive color photographic material, which process comprises preventing color fog at the addition of an agent having fixing action such as a thiosulfuric acid ion or a thiocyanic acid ion to the color developing solution.

Other objects of this invention will be apparent from the description given hereinafter.

As a result of extensive researches made to achieve the afore-mentioned objects, the inventors found that the above objects can be achieved by subjecting an exposed light-sensitive silver halide color photographic material to the photographic treatment with a color developing solution containing at least 0.0292 mol/1 of bromide ion in the presence of at least one of the active point substitution type yellow coupler (referred to herein as "the coupler of this invention") of the following general formulae [I], [II], [III] and [IV]:

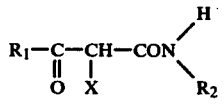

(I)

wherein $R_1$ represents a chained or cyclic alkyl group having at the end a tertiary carbon atom which is directly attached to the carbonyl group (for example, tertiary butyl, teritary amyl, 1,1-dimethyl hexyl, 1,1-dimethyl decyl, 1,1-dimethyl tetradecyl, 1,1-dimethyl hexadecyl, 1-bicyclo[3,2,1]octyl, 5-norbornen-2-yl, 5-pinanyl, 1-p-menthen-8-yl, bicyclo[3,2,1]oct-5-yl), or an aryl group (e.g. phenyl or naphtyl); $R_2$ represents an aryl group (for example, phenyl or naphthyl, etc.) or a heterocyclic ring (preferably a 5–7 membered heterocyclic ring containing nitrogen, oxygen and/or sulfur, for example, thienyl, benzothienyl, furyl, pyranyl, pyrrolyl, imidazolyl, pyrazolyl, pyridyl, pyrimidyl, pyridazyl, indolyl, indazolyl, quinolyl, oxazolyl, pyrrolidinyl, benzimidazolyl, naphthoimidazolyl, benzoxazolyl, naphthoxazolyl, thiazolyl, benzothiazolyl, naphthothiazolyl, selenazolyl, benzoselenazolyl, etc.); X represents

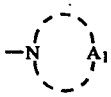

where $A_1$ represents an atom group necessary for forming an imide ring, a pyrrole ring or a diazole ring (for example, 1-imidazoyl, 1-imidazolinyl, 1-pyrazolinyl, 2-pyrazolinyl, etc.) and X represents a group in which oxygen atom is directly attached to the active point and said oxygen atom is directly attached to a non-metal atom having a double bond (this group being referred to hereinafter as oxygen-attaching group), said double bond including one between carbon-carbon, carbon-oxygen, carbon-nitrogen, carbon-sulfur or sulfur-oxygen. In the formula [I], $R_1$ is preferably a chained or cyclic alkyl group having 4–18 carbon atoms or a phenyl group, and particularly a chained alkyl having 4–18 carbon atoms (and further a tertiary alkyl group), cyclic alkyl having 6–18 carbon atoms or phenyl (which may be substituted by alkyl having 1–22 carbon atoms or alkoxy having 1–22 carbon atoms, halogen and/or carbamoyl) is preferable. $R_2$ is preferably a phenyl group, and particularly a phenyl group including those having a substituent, at the ortho-position of the phenyl, with halogen, an alkoxy group having 1–22 carbon atoms or a phenoxy group is preferably. X is preferably a phenoxy group, an α-naphthoxy group, a β-naphthoxy group, an acyloxy group, a thiocarbonyloxy group, an imidoether group, a sulfonyloxy group, a sulfinyloxy group, an atom group necessary for forming a pyrrole ring, an atom group necessary for forming a 5–6 membered diazole ring or an atom group necessary for forming a 4–6 membered imide ring [these atom groups being able to contain in addition to carbon atom, oxygen, sulfur, selenium or nitrogen atom and being, for example, a succinimide ring, a malonimide ring, a phthalimide ring, a maleimide ring, a glutarimide ring, an 1,2,3,6-tetra-hydro-pyridin-2,6-dione-1-yl group, a 3-isothiazoli-dinon-1, 1-dioxido-2-yl group, a 3,5-dioxotrizolidin-3-yl (urazol) group, a 2,4-dioxo-oxazolidin-3-yl group, a 3,5-dioxomorpholin-4-yl group, a 2,4-dioxo-thiazo-lidin-2-yl group, a 2,4-dioxo-imidazolidin-3-yl (hydantoin) group, a 3-oxo-succinimide ring residue, a 2,3,5-trioxo-imidazolidin-4-yl (parabamic acid) group, an 1,3-benzoxa·in-2,4(3H)-dione-3-yl group, a 2,4-azetidindione-1-yl group, a 2H-pyridazine-3-one-2-yl group, a 2-pyridon-1-yl group, an 1H-pyrazin-2-one group, an 3H-pyrimidin-4-one-3-yl group, a 2-pyrazolin-5-one-1-yl group, an 1H-pyrimidin-2-one-1-yl group, a 2-quinolon-1-yl group, an 1,2,4-triazin-5(4H)-one-yl group, a $\Delta^1$-1,2,4-triazin-3-one-4-yl group, a $\Delta^5$-1,2,3-triazin-4-one-3-yl group, a $\Delta^1$-1,2,3-triazolin-4-one-3-yl group, an 1,2,4-oxadiazolin-2-one-3-yl group, an 1,3,4-thiadiazolin-2-one-3-yl group, a $\Delta^4$-1,2,4-triazolin- 3-one-2-yl group, an 1,2,3,4-tetrazolin-5-one-1-yl group, a thiazolin-2-one-3-yl group, an isothiazolin-3-one-2-yl group, an oxazolin-2-one-3-yl group, an 1,3,5-triazin-2(1H)-one-1-yl group, a 5-imidazolin-4-one-3-yl group, an 1,2,4-triazin-3(2H)-one-2-yl group, a 4-imidazolin-2-one-1-yl group, a 3-pyrrolin-2-one-1-yl group, an isoxazolin-3-one-2-yl group, etc.). Further, each of the groups of X may be condensed at the saturated or unsaturated carbon ring.

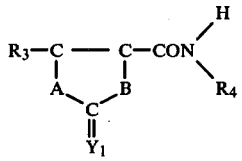

(II)

wherein $R_3$ represent a chained or cyclic alkyl group (for example, one similar to $R_1$ or methyl, ethyl, propyl, butyl, iso-butyl, octyl, dodecyl or octadecyl group etc.), an aryl group (e.g. phenyl and naphthyl groups), or a heterocyclic ring (preferably a 5–7 membered heterocyclic ring containing nitrogen, oxygen and/or sulfur e.g. imidazolyl, benzimidazolyl, naphthimidazolyl, furyl, imidazolidinyl, indazolyl, indolyl, oxazolyl, benzoxazolyl, naphthoxazolyl, thiazolyl, benzothiazolyl, naphthoxazolyl, isoxazolyl, morpholino, oxazinyl, pentazolyl, pyperidino, pyrazyl, pyrazolinyl, pyrazolyl, pyridyl, pyrimidyl, pyrrolyl, tetrazolyl, thiazinyl, thiazolinyl, thienyl, triazolyl, etc.). $R_3$ is preferably a group similar to one as defined for $R_1$ or a phenyl group and particularly preferably $R_3$ is a tertiary butyl group. A and B each represent an oxygen or the group >N-R', wherein R' represents hydrogen or an alkyl group (for example, a lower alkyl group such as methyl, ethyl, propyl or butyl), an aryl group (e.g. phenyl) or an acyl group (e.g. acetyl, propionyl, butanoyl, octanoyl, benzoyl, cinnamoyl, etc.), said R' being preferably hydrogen or an alkyl group having 1–4 carbon atoms, a phenyl group or an acyl group. Said A and B should not be the same to each other. $Y_1$ represents oxygen or sulfur and $R_4$ represents an aryl group (e.g. phenyl, naphthyl, etc.) or a heterocyclic ring (e.g. a heterocyclic ring similar to one as defined for $R_3$).

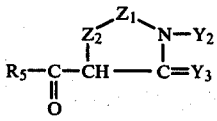

(III)

wherein $R_5$ represents the same group as defined for $R_3$, $Y_2$ represents hydrogen or a group of $R_3$; when $Z_1$ is a carbonyl group or a thiocarbonyl group, $Y_3$ and $Z_2$ each represent oxygen or sulfur and, when $Z_1$ is a chained or cyclic alkylene group (e.g. methylene, ethylene, cyclohexylene, etc.), an arylene group (e.g. phenylene) or a divalent heterocyclic ring (e.g. a heterocyclic group which is similar to one as defined for $R_3$ and which is divalent), $Y_3$ represents oxygen and $Z_2$ represents oxygen or sulfur, or an acylamino group or a sulfonamido group.

$R_5$ is preferably an alkyl group having 1–16 carbon atoms or a phenyl group, and particularly preferable a tertiary butyl group or a phenyl group. $Y_2$ is preferably hydrogen or a phenyl group. $Z_1$ is preferably a carbonyl group or a phenylene group.

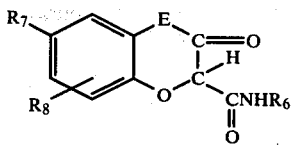

(IV)

wherein $R_6$ represents an aryl group (for example a phenyl group or a naphthyl group), $R_7$ represents a group which does not split off during coupling reaction (e.g. the same group as defined for $R_3$), $R_8$ represents hydrogen or halogen or an alkyl group, an alkoxy group, an aryloxy group or an acylamino group and E represents a simple bond or $—C(CH_3)_2—$.

In the general formula [IV], $R_6$ is preferably a phenyl group, $R_7$ is preferable an alkyl group, particularly an alkyl group having 1–4 carbon atoms and $R_8$ is preferably hydrogen.

The groups and rings appeared in all the general formulas include the substituted as explained before.

Although the substituents may be any substituents, prefered ones are one or more appropriately selected from the group consisting of halogen (fluorine, chlorine, bromine, etc.), nitro, cyano, hydroxy, carboxy, sulfo, amino, an alkyl group (e.g. methyl, ethyl, propyl, butyl, amyl, octyl, dodecyl, octadecyl, eicosyl, etc.), aryl (e.g. phenyl, naphthyl, etc.), a heterocyclic ring (e.g. imidazolyl, benzimidazolyl, naphthimidazolyl, furyl, imidazolizinyl, indazolyl, indolyl, oxazolyl, benzoxazolyl, naphthoxazolyl, thiazolyl, benzothiazolyl, naphthoxazolyl, isoxazolyl,morpholino, oxazinyl, pentazolyl, piperidino, pyrazyl, pyrazolinyl, pyrazolyl, pyridyl, pyrimidylyl, pyrrolyl, tetrazolyl, thiazinyl, thiazolinyl, thienyl, triazolyl, etc.), an alkenyl group (e.g. alkyl, butenyl, octenyl, etc.), an alkoxy group (e.g. methoxy, ethoxy, butoxy, octoxy, etc.), an aryloxy group (e.g. phenoxy, naphthoxy, etc.), an aryloxy group (e.g. phenoxy, naphthoxy), an acyl group (e.g. acetyl, propionoyl, butanoyl, octanoyl, benzoyl, cinnamoyl, etc.), an acyloxy group (e.g. acetyloxy, propionoyloxy, octanoyloxy, benzoyloxy, cinnamoyloxy, etc.), a sulfonyl group, a sulfonyloxy group, a carbamoyl group, an acylamino group, a sulfonamido group and a sulfamoyl group.

According to this invention, the object thereof can satisfactorily be achieved by subjecting an exposed light-sensitive silver halide color photographic material to the photographic treatment with a color developing solution containing at least 0.0292 mol/l of bromide ion in the presence of a coupler of the present invention and said treatment is preferably effected in the presence of a coupler of the general formula [I], [II] or [III], more preferably a coupler of the general formula [I] or [II] and particularly a coupler of the general formula [I] is preferable. Further, the coupler of this invention is preferably present in the light-sensitive color photographic material.

The coupler of this invention can readily be prepared according to the process described, for example, in U.S. Pat. Nos. 3,447,928, 3,415,652, 3,730,722, 3,408,194, 3,990,896, 3,960,570, 4,012,259, 4,029,508 and 4,046,575, British Patents 1,351,424, 1,425,020, 1,386,151, 1,040,710, 1,434,472, 1,421,123, 1,421,125, 1,420,564, 1,331,179 and 1,478,205 and Research Disclosure No. 13013.

Typical examples of the couplers of this invention will be shown below without any intention to limit the couplers of this invention thereto.
Couplers of the general formula [I]:
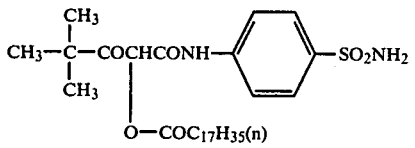
(AY-1)
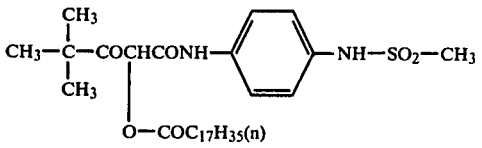
(AY-2)
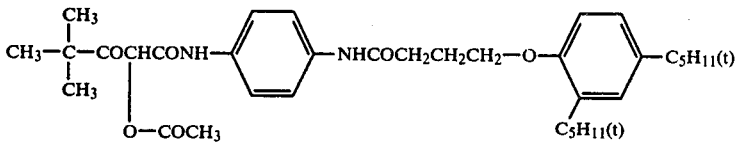
(AY-4)
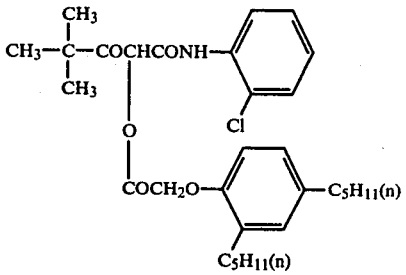
(AY-5)
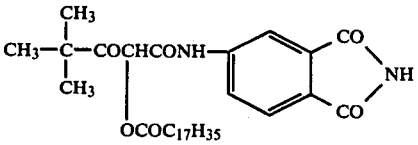
(AY-6)
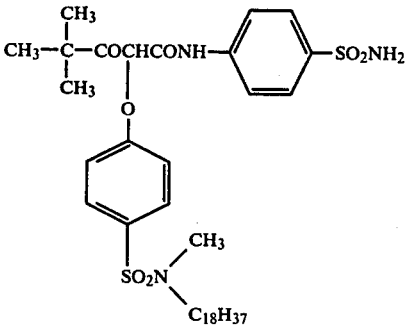
(AY-7)
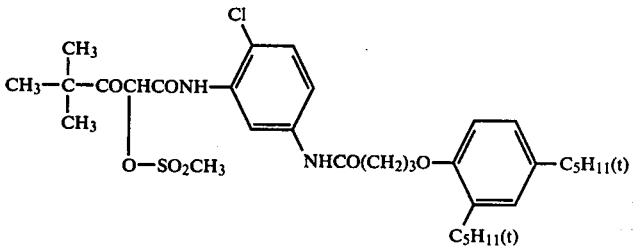

-continued
(AY-8)
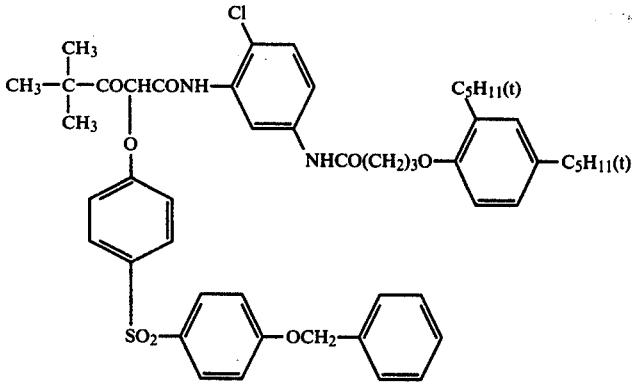
(AY-9)
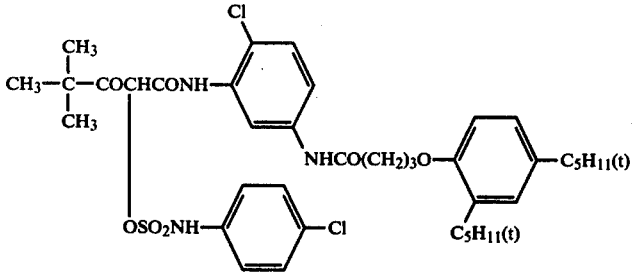
(AY-10)
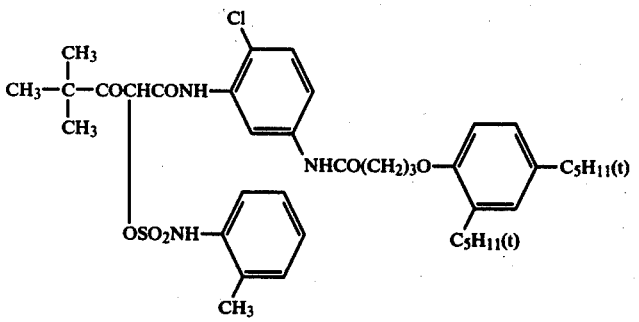
(AY-11)
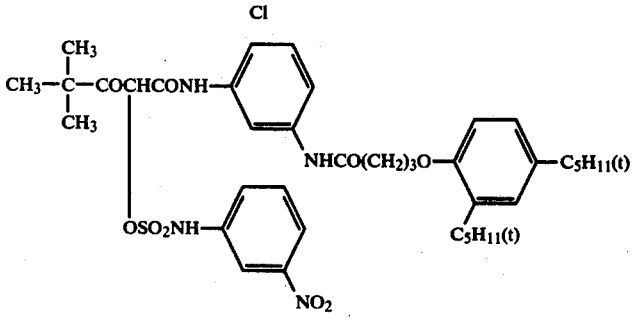
(AY-12)
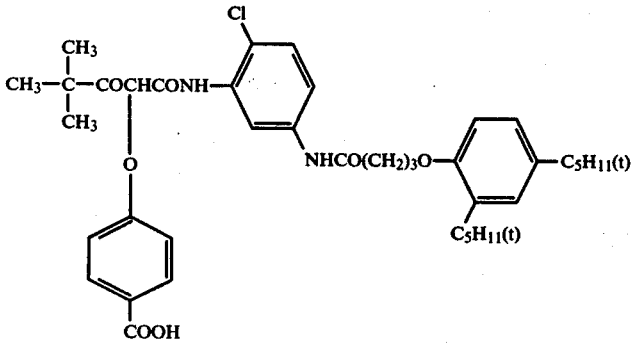

-continued
(AY-13)
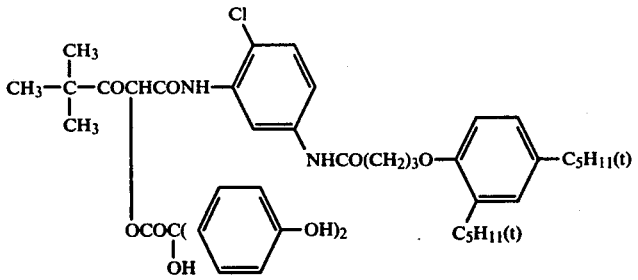
(AY-14)
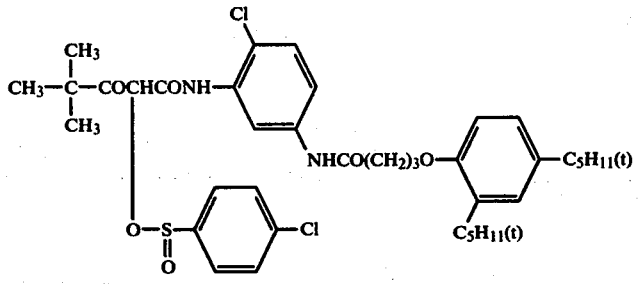
(AY-15)
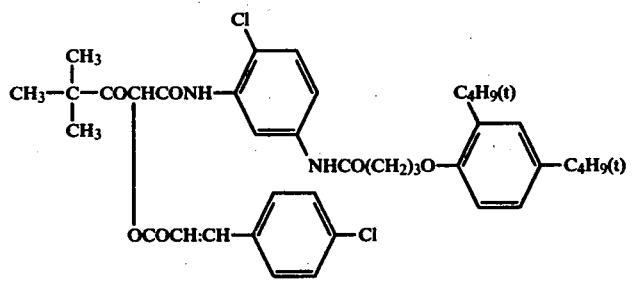
(AY-16)
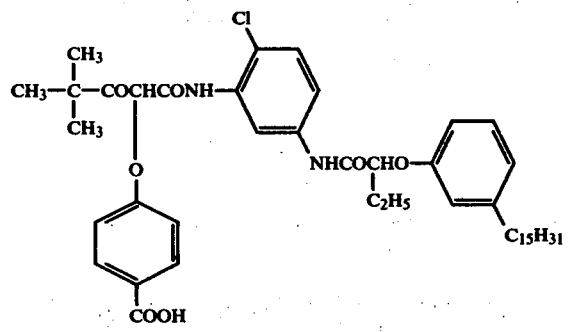
(AY-17)
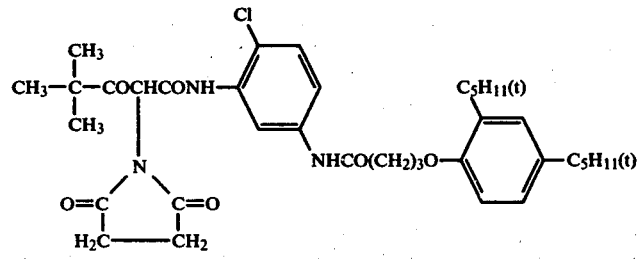

-continued
(AY-18)
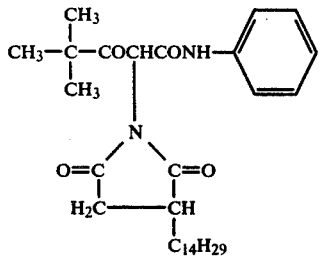
(AY-19)
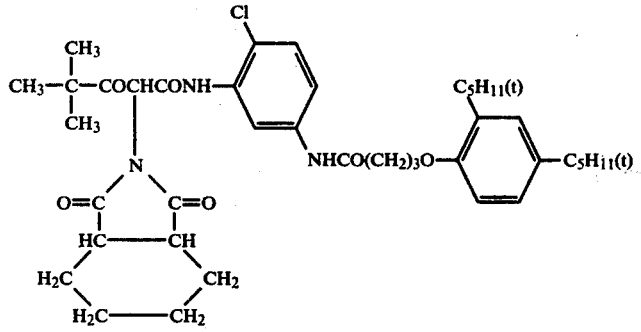
(AY-20)
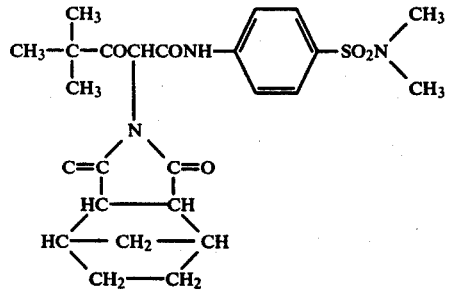
(AY-21)
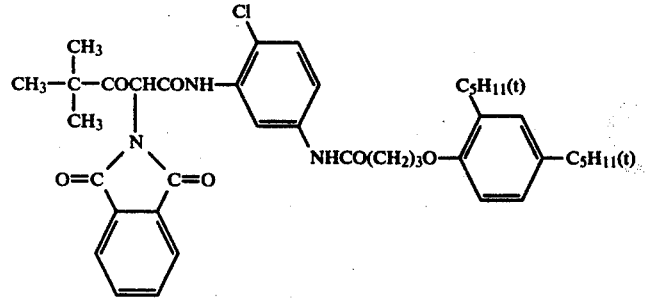
(AY-22)
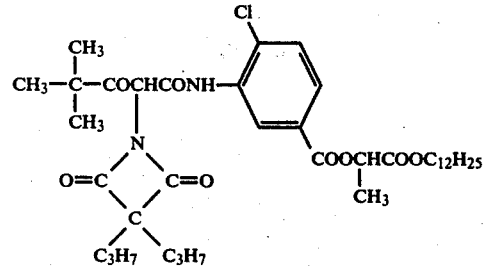

-continued
(AY-23)
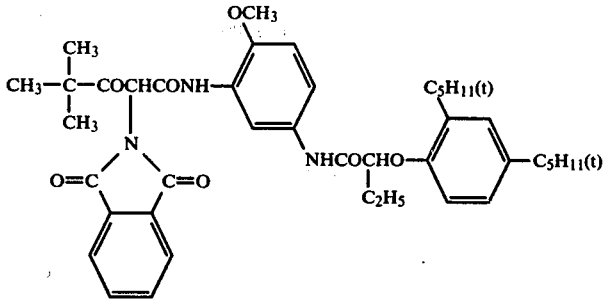
(AY-24)
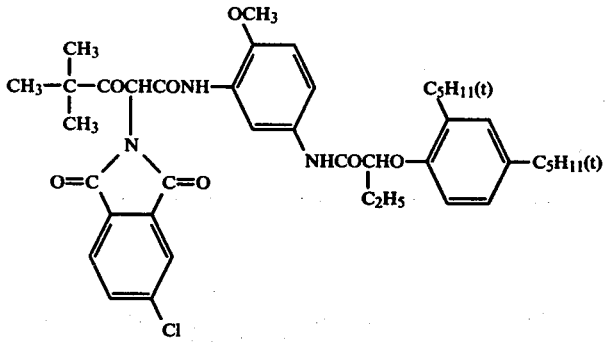
(AY-25)
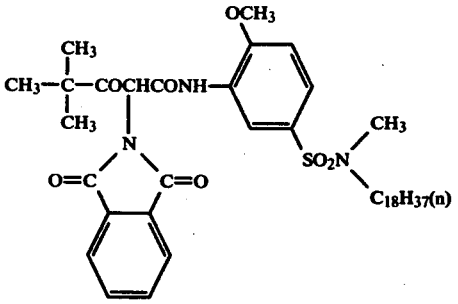
(AY-26)
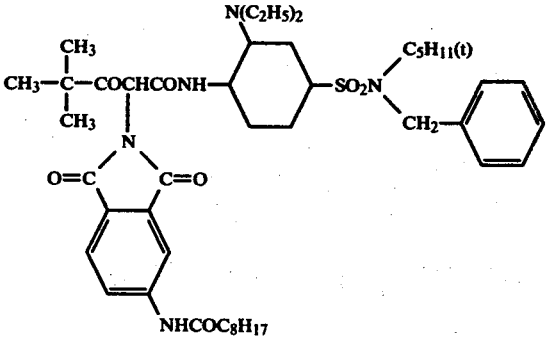
(AY-27)
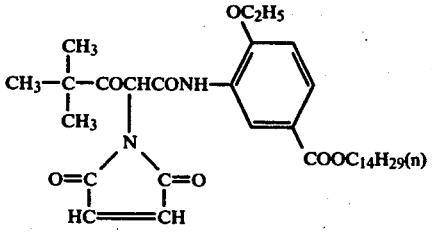

-continued
(AY-28)
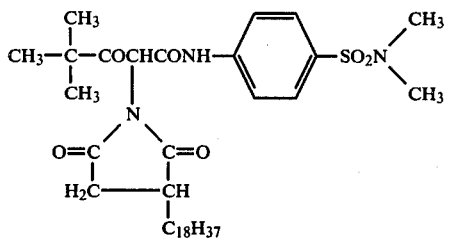
(AY-29)
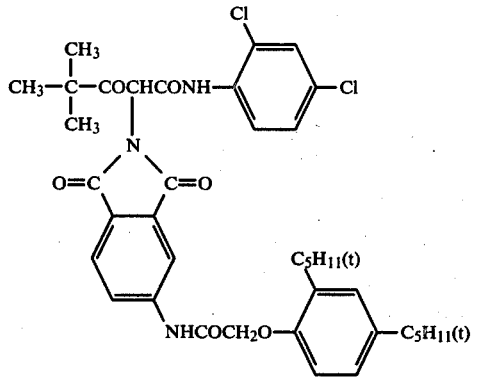
(AY-30)
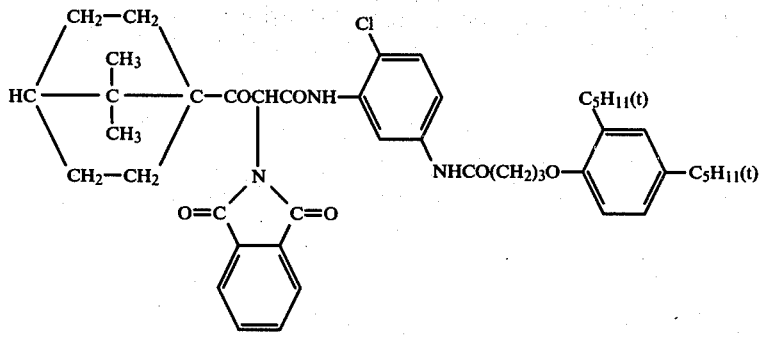
(AY-31)
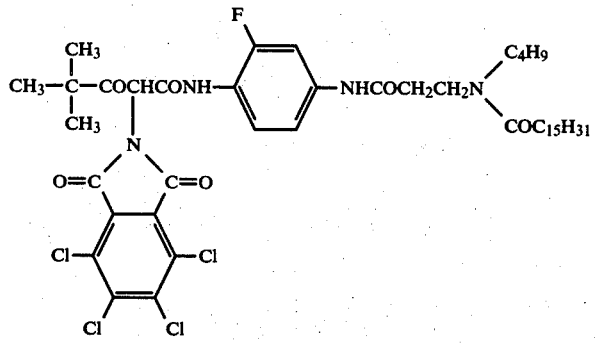
(AY-32)
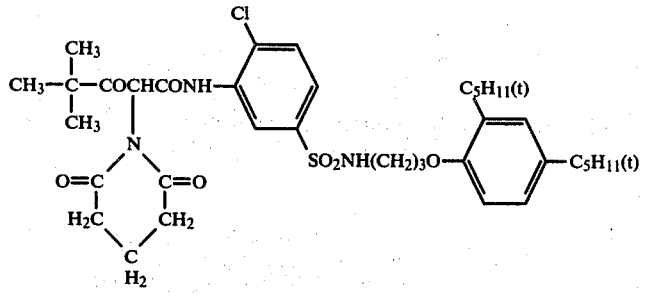

-continued
(AY-33)
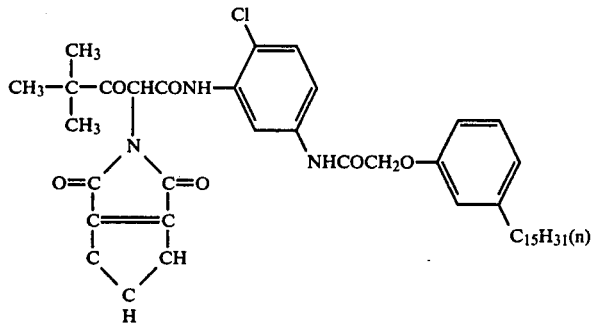
(AY-34)
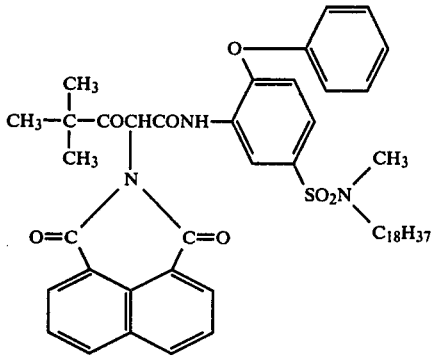
(AY-35)
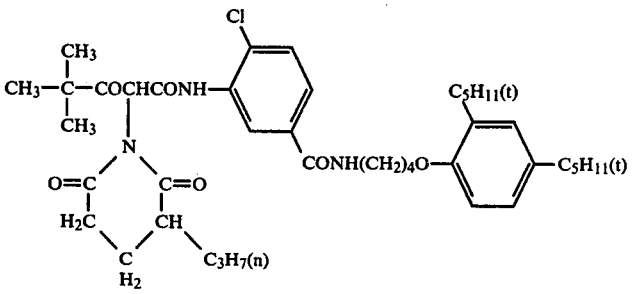
(AY-36)
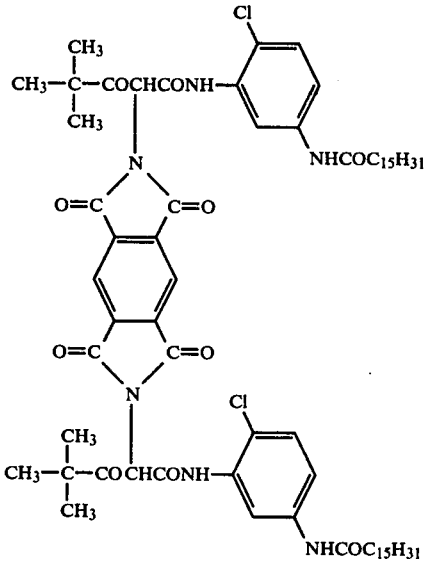

-continued
(AY-37)
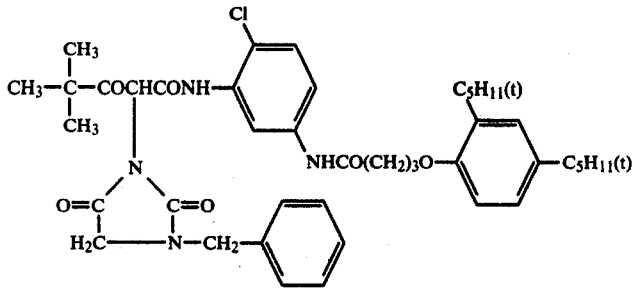
(AY-38)
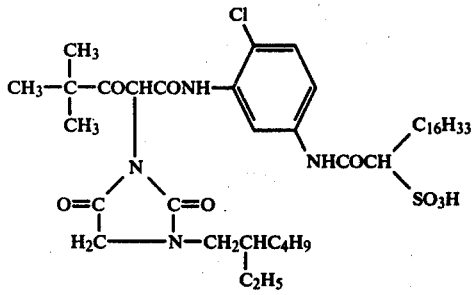
(AY-39)
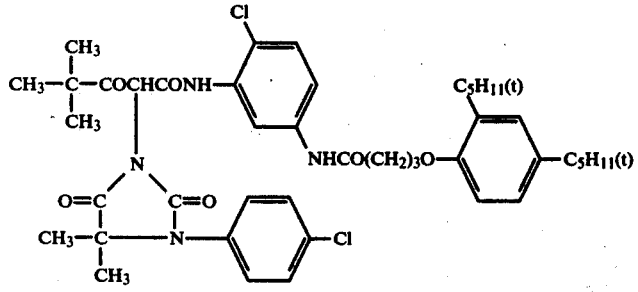
(AY-40)
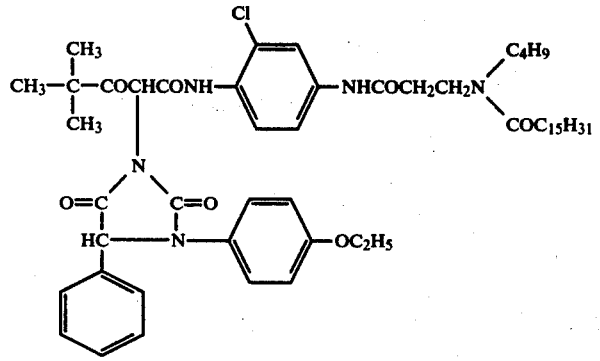

-continued
(AY-41)
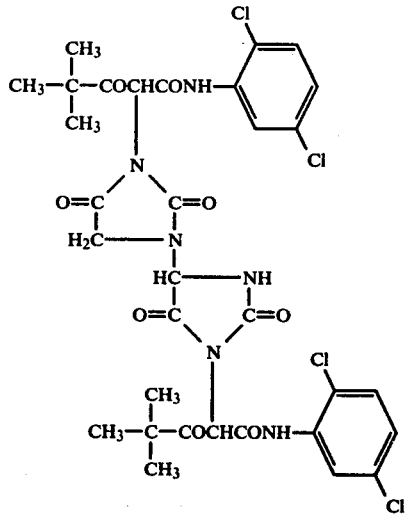
(AY-42)
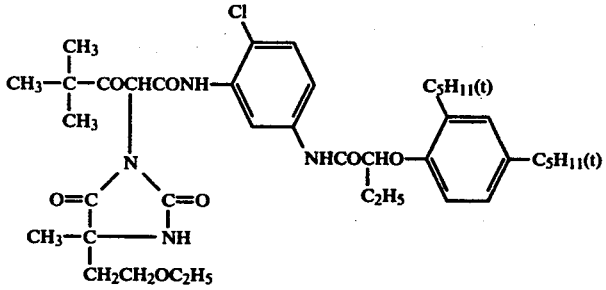
(AY-43)
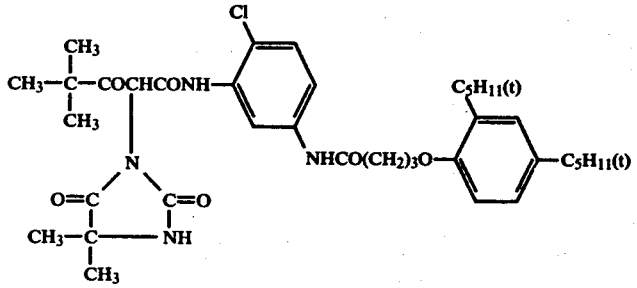
(AY-44)
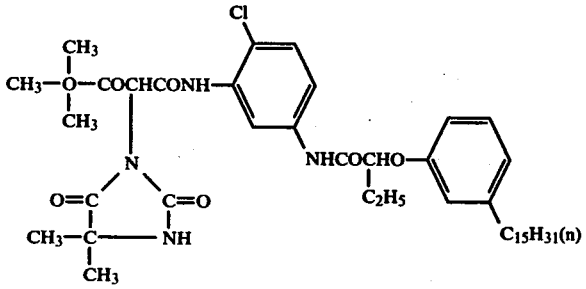

-continued
(AY-45)
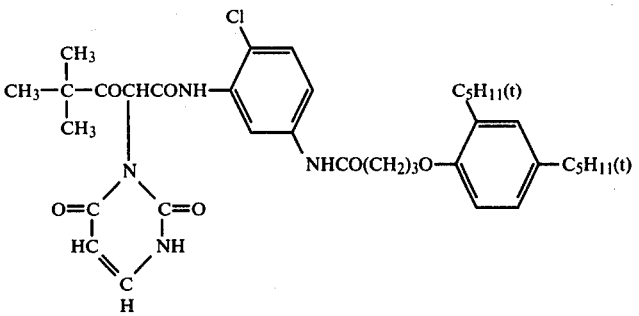
(AY-46)
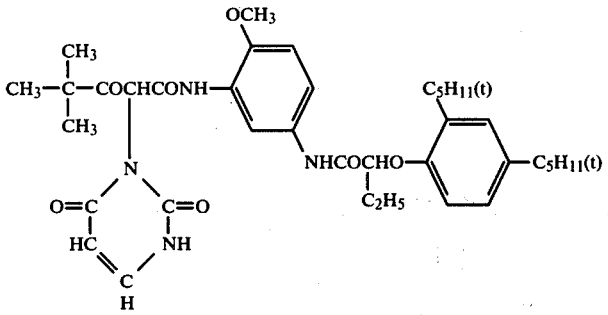
(AY-47)
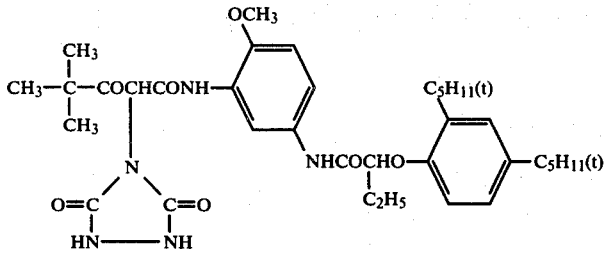
(AY-48)
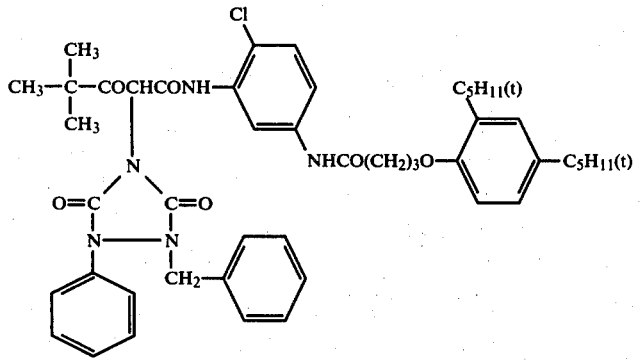
(AY-49)
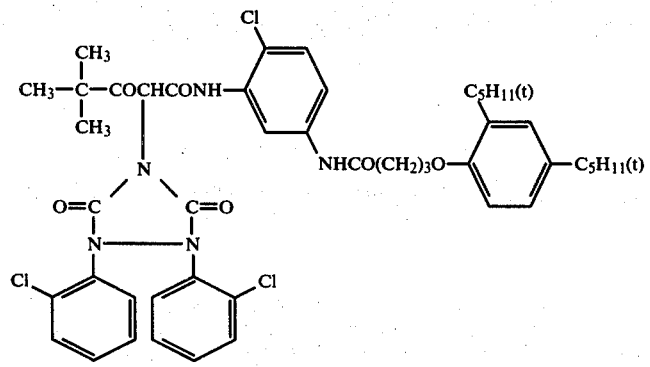

-continued
(AY-50)
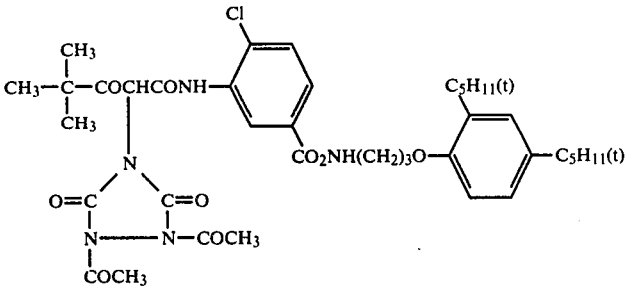
(AY-51)
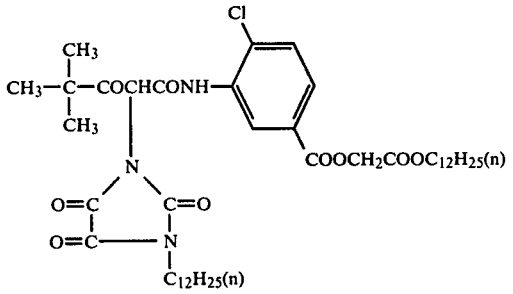
(AY-52)
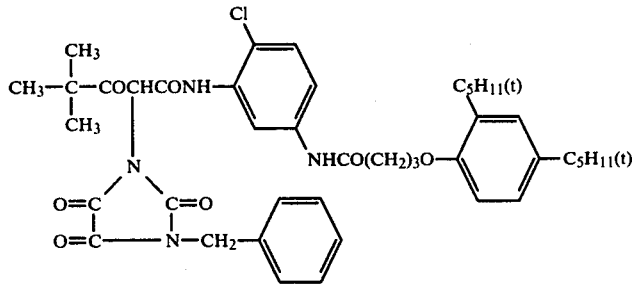
(AY-53)
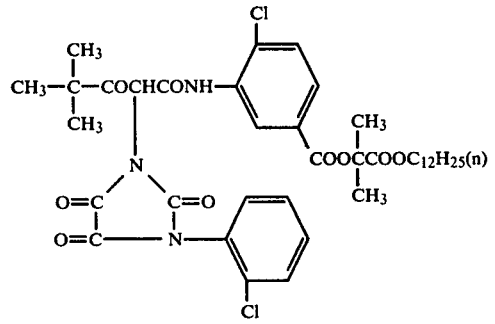
(AY-54)
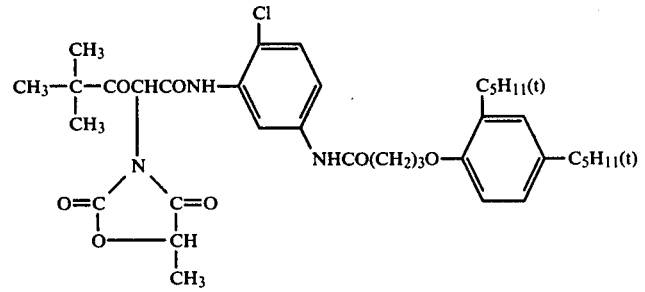

-continued
(AY-55)
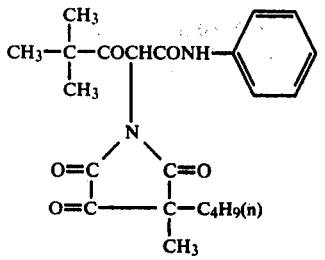
(AY-56)
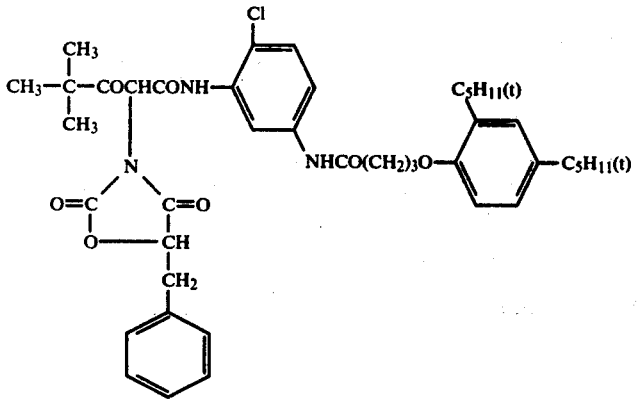
(AY-57)
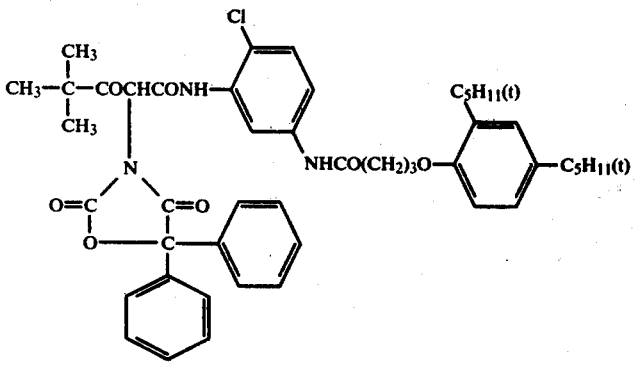
(AY-58)
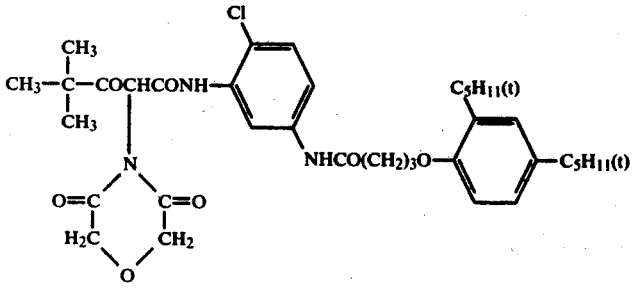
(AY-59)
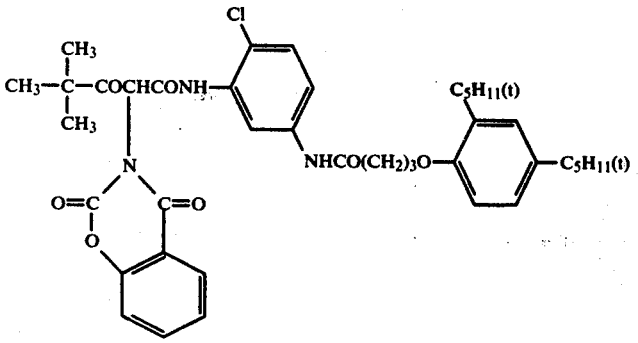

-continued
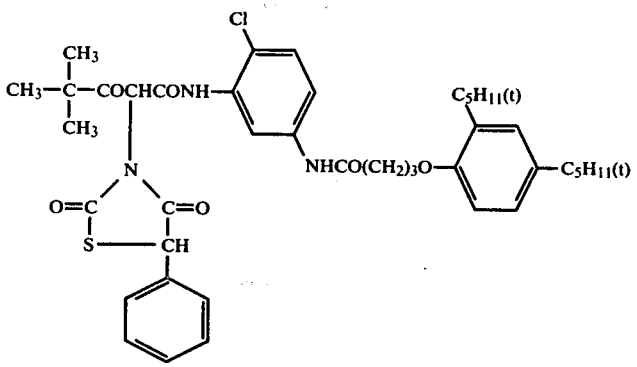
(AY-60)
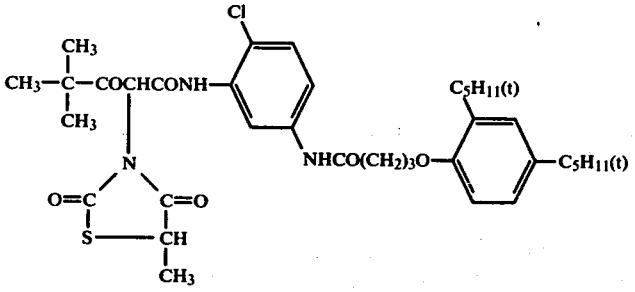
(AY-61)
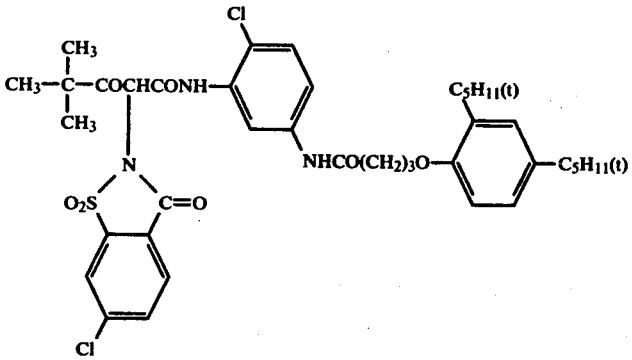
(AY-62)
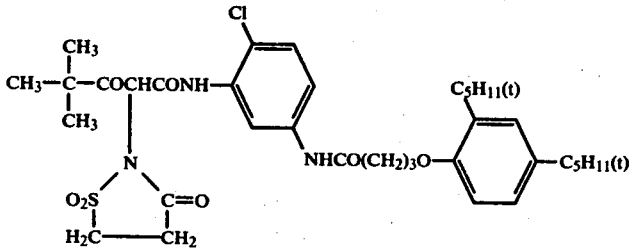
(AY-63)
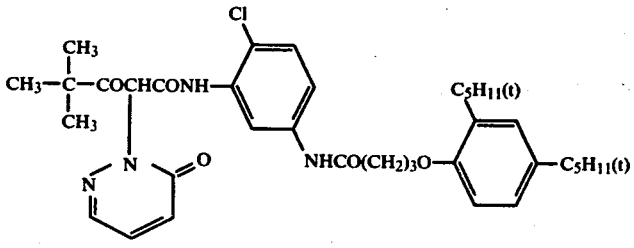
(AY-64)

-continued
(AY-65)
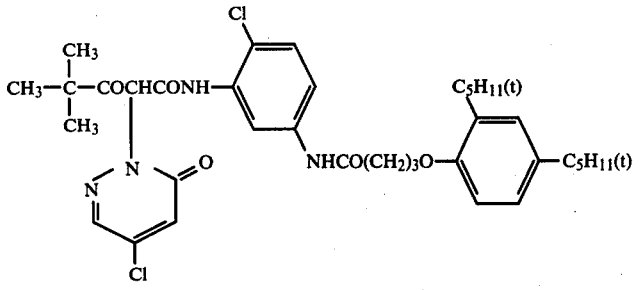
(AY-66)
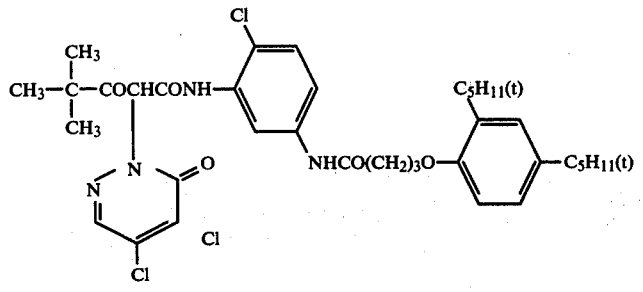
(AY-67)
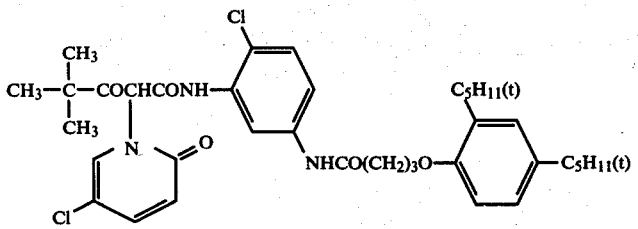
(AY-68)
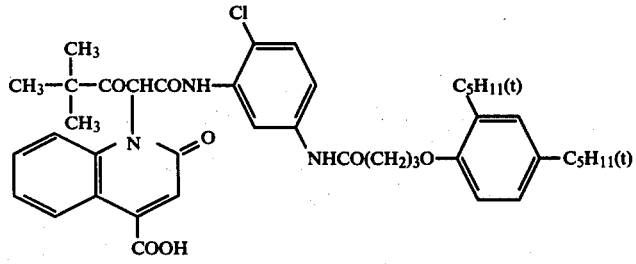
(AY-69)
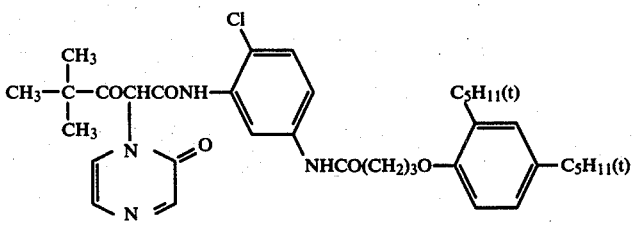
(AY-70)
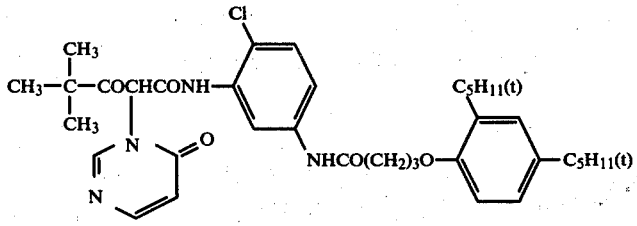

-continued
(AY-71)
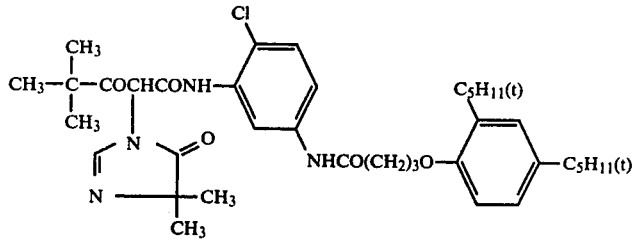
(AY-72)
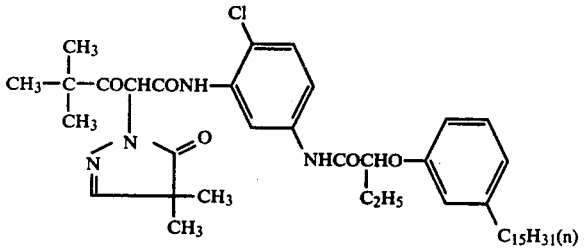
(AY-73)
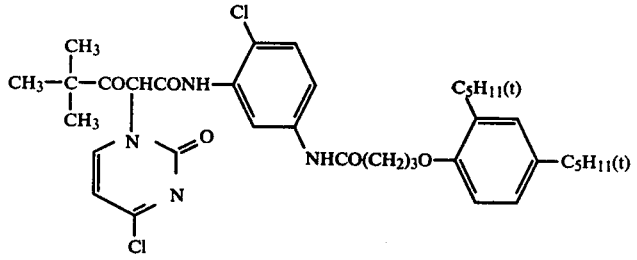
(AY-74)
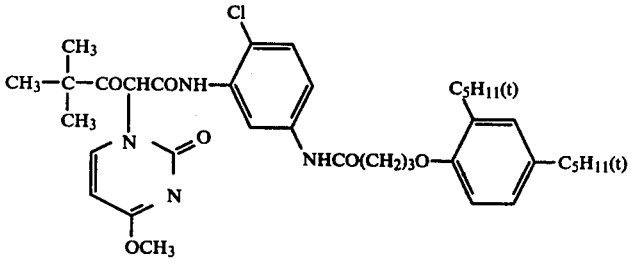
(AY-75)
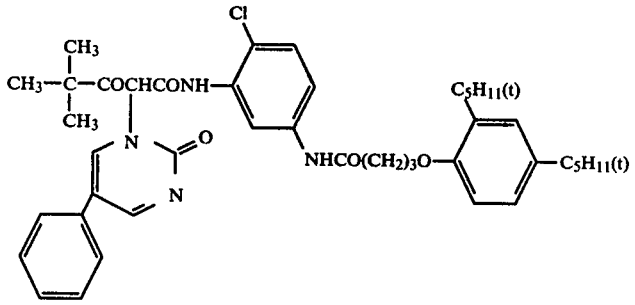
(AY-76)
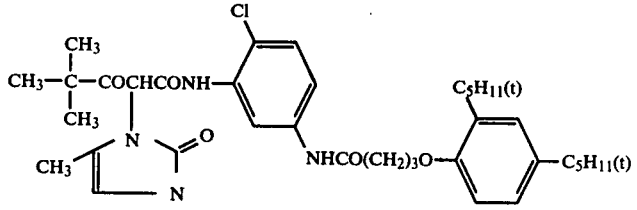

-continued
(AY-77)
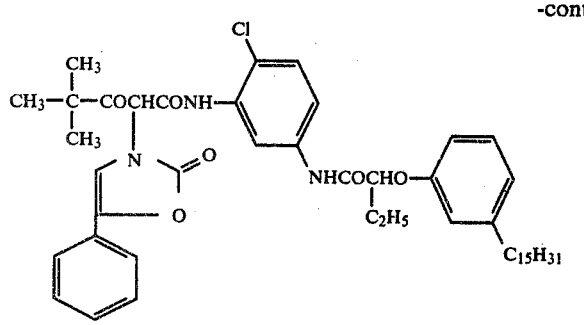
(AY-78)
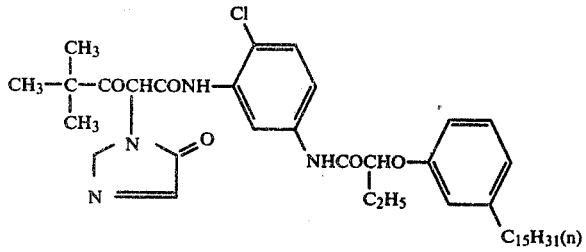
(AY-79)
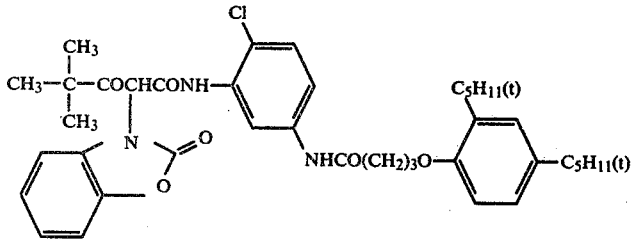
(AY-80)
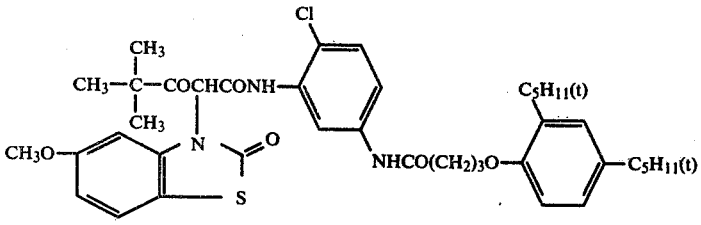
(AY-81)
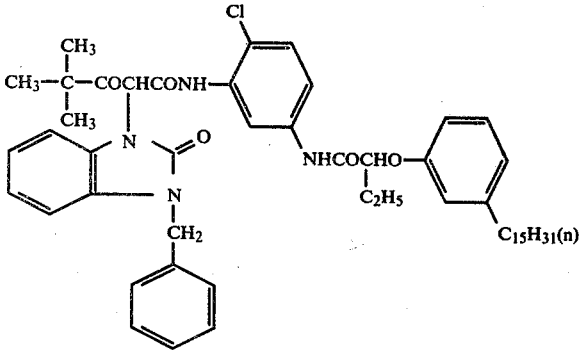
(AY-82)
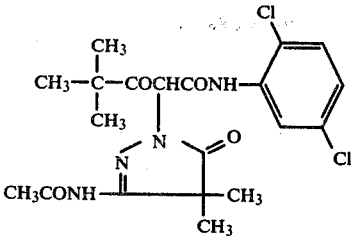

-continued
(AY-83)
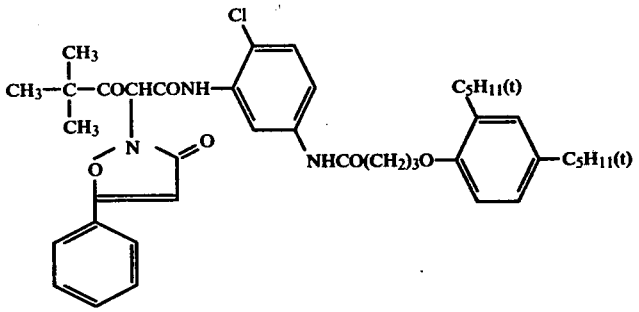
(AY-84)
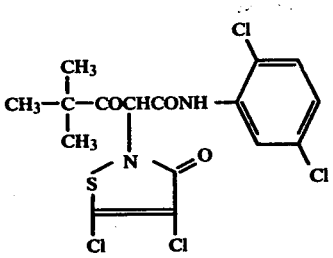
(AY-85)
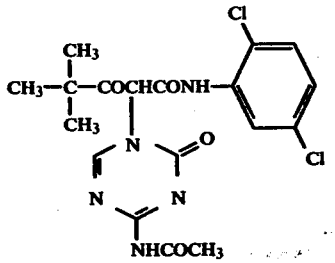
(AY-86)
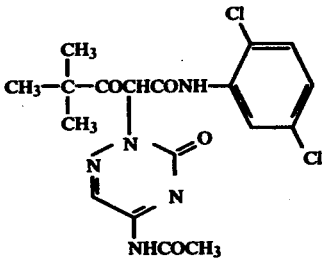
(AY-87)
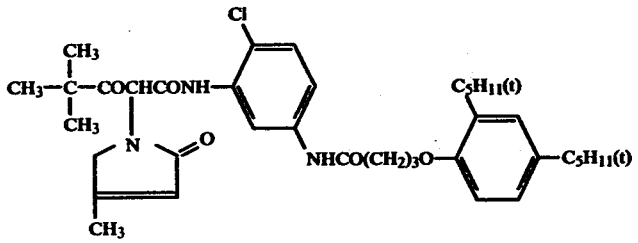
(AY-88)
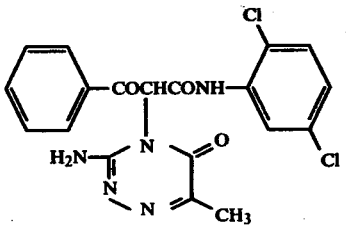

-continued
(AY-89)
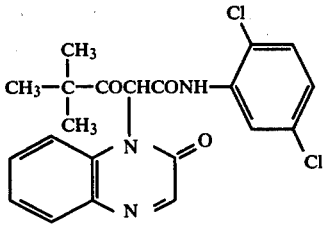
(AY-90)
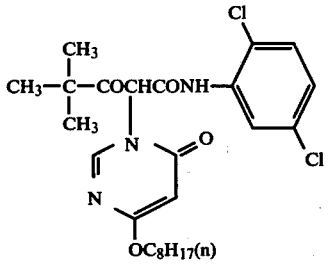
(AY-91)
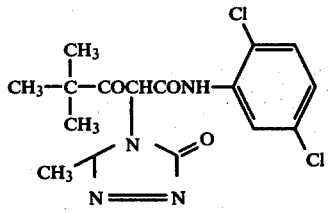
(AY-92)
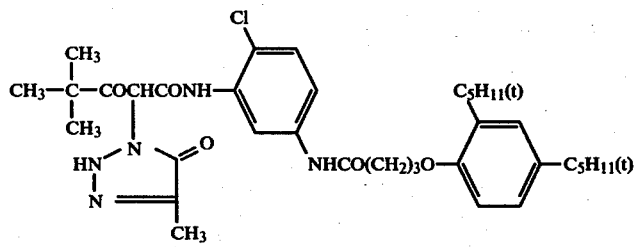
(AY-93)
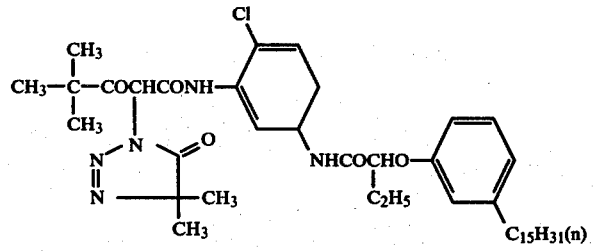
(AY-94)
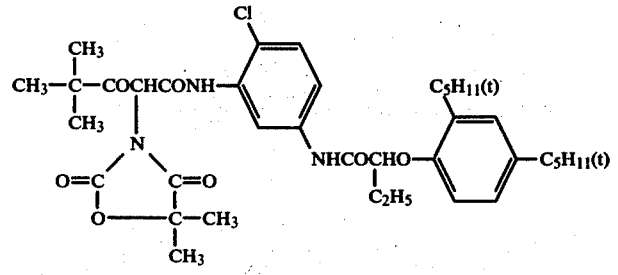

-continued
(AY-95)
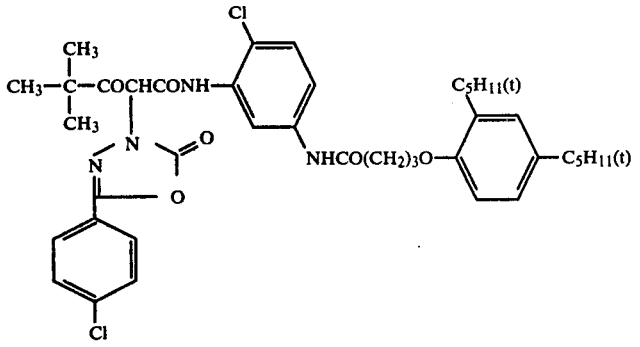
(AY-96)
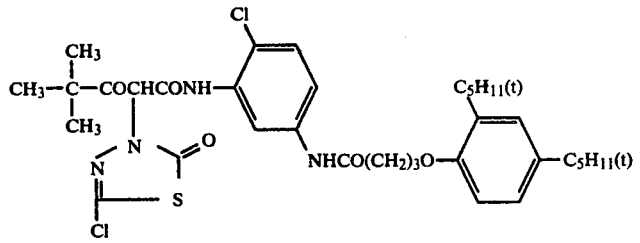
(AY-97)
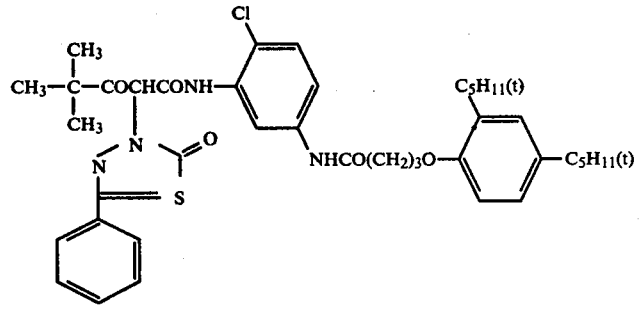
(AY-98)
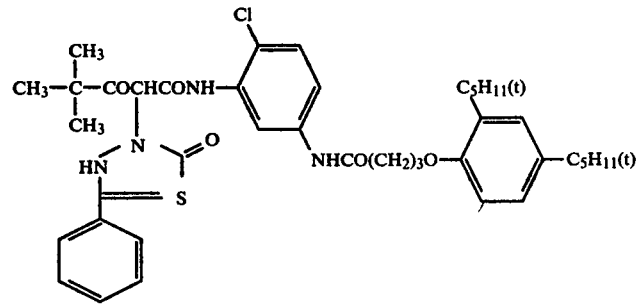
(AY-99)
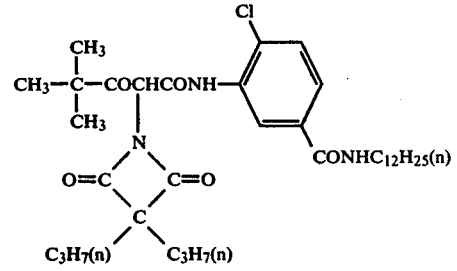

-continued
(AY-100)
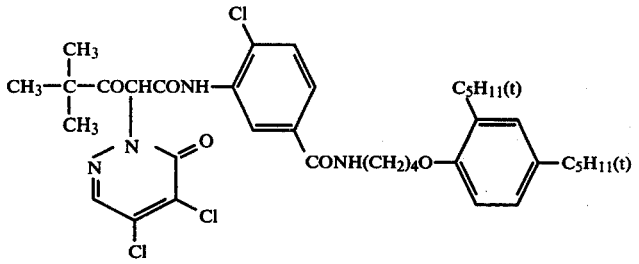
(AY-101)
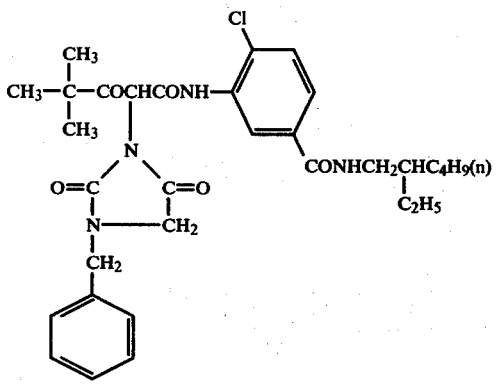
(AY-102)
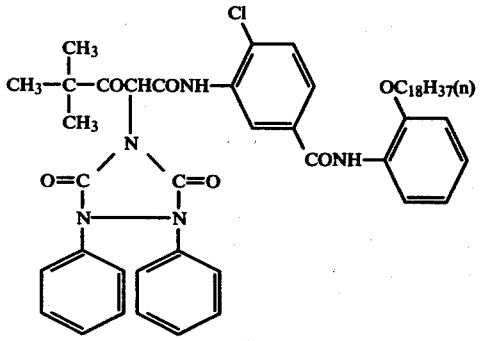
(AY-103)
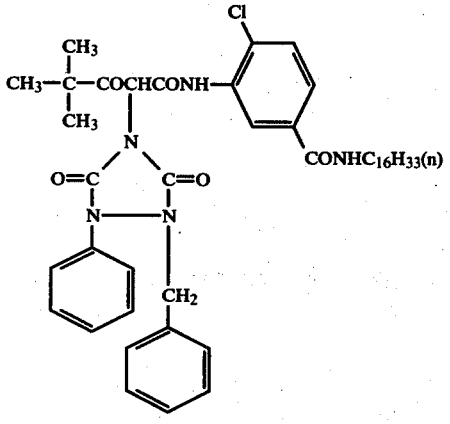

-continued
(AY-104)
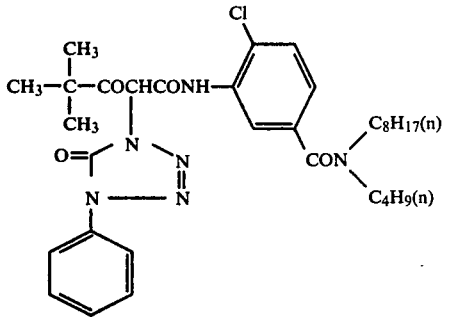
(AY-105)
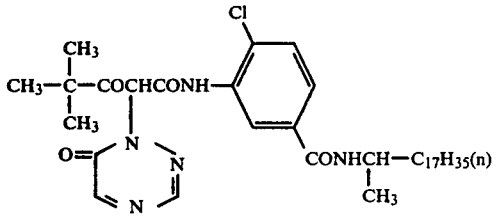
(AY-106)
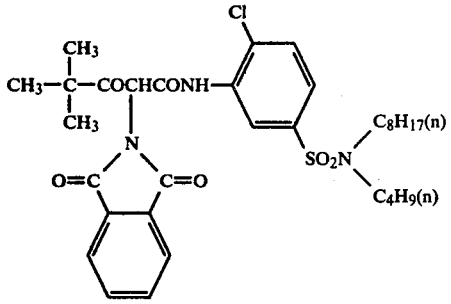
(AY-107)
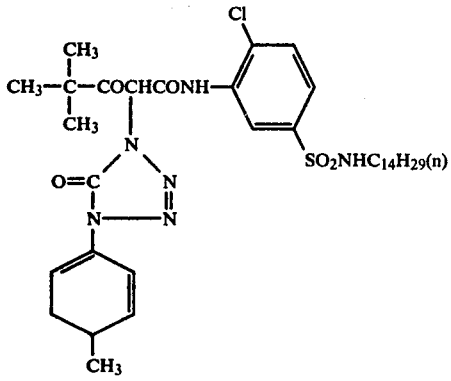
(AY-108)
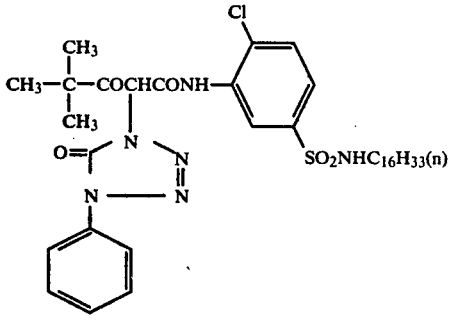

-continued
(AY-115)
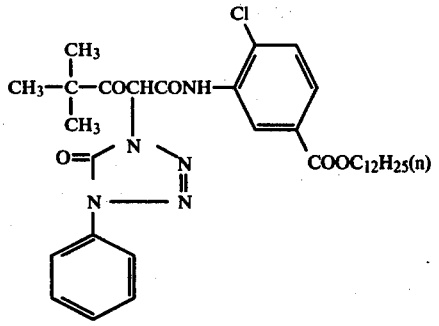
(AY-116)
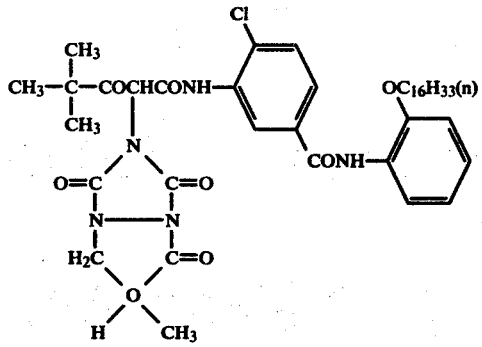
(AY-117)
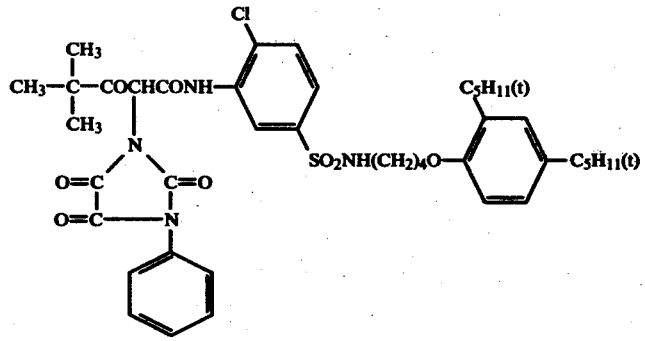
(AY-118)
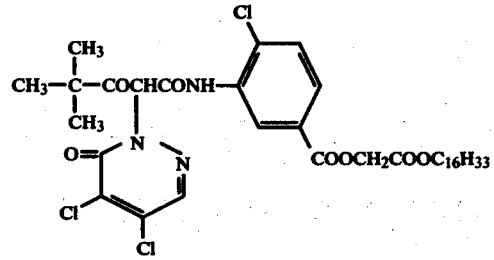
(AY-119)
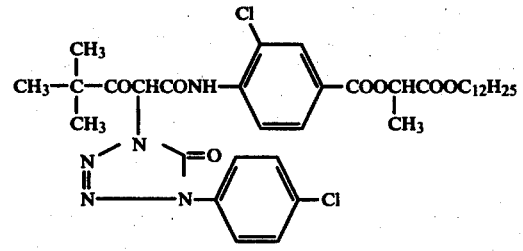

-continued
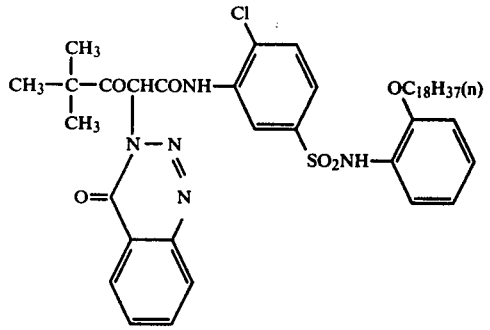
(AY-109)
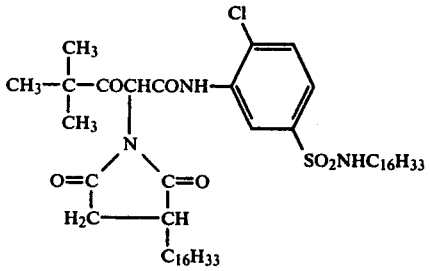
(AY-110)
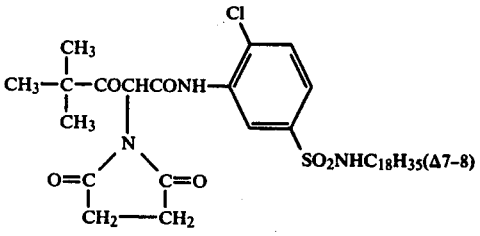
(AY-111)
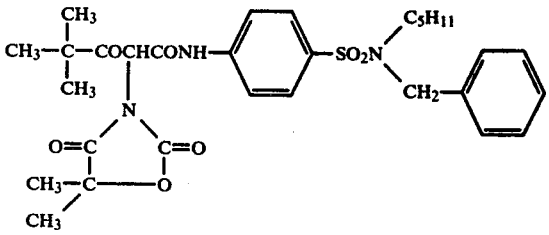
(AY-112)
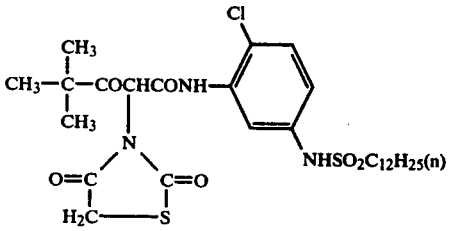
(AY-113)
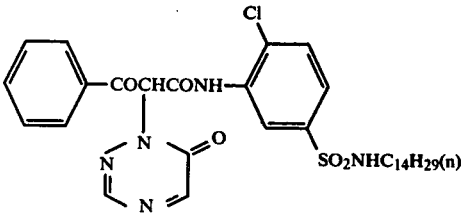
(AY-114)

-continued
(AY-120)
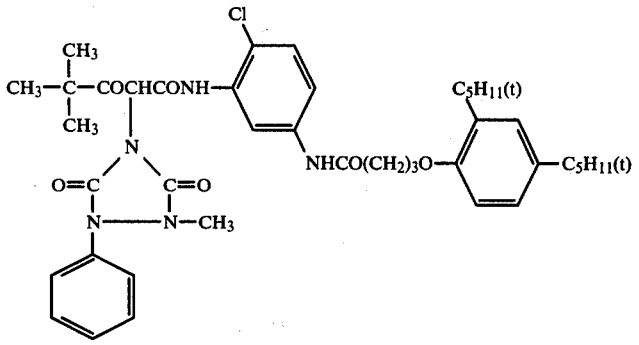
(AY-121)
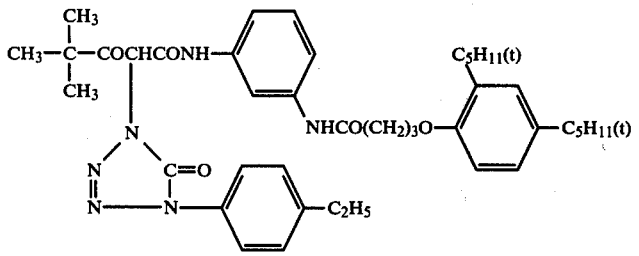
(AY-122)
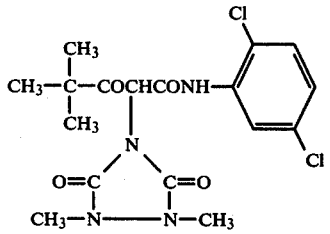
(AY-123)
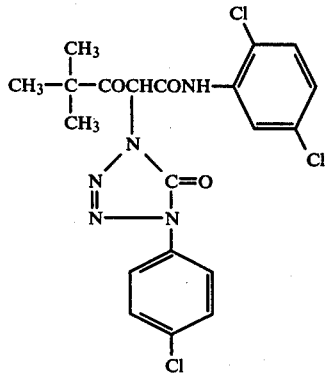
(AY-124)
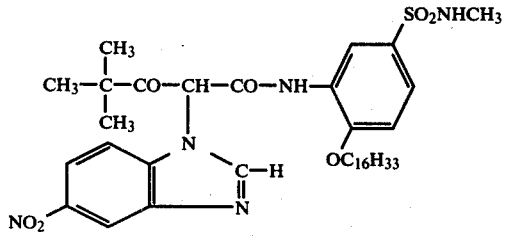

-continued
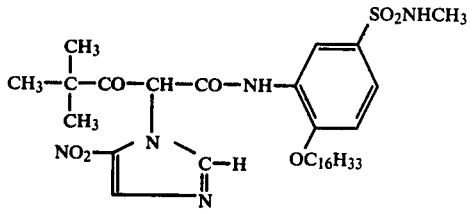
(AY-125)
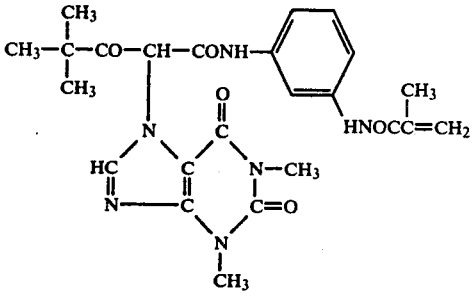
(AY-126)
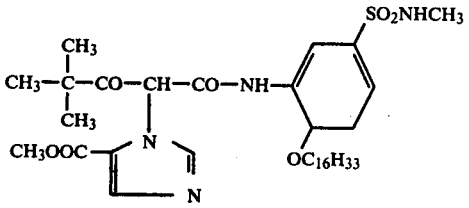
(AY-127)
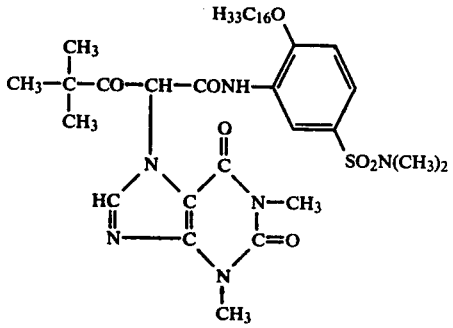
(AY-128)
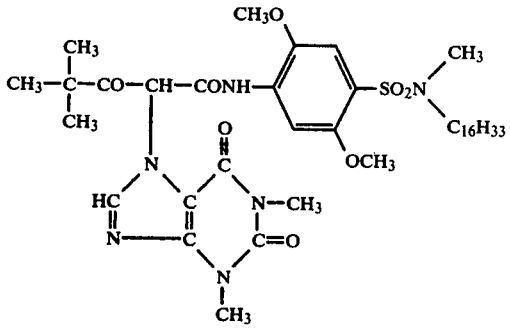
(AY-129)

-continued
(AY-130)
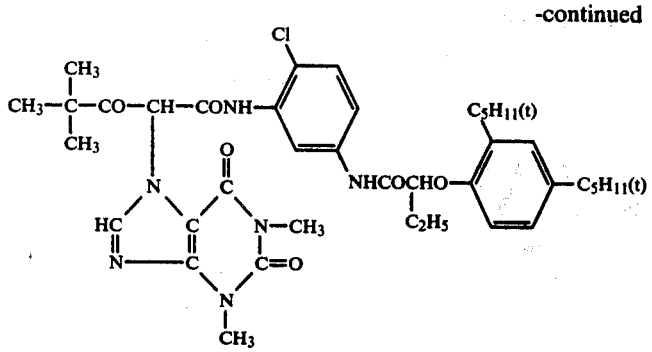
(AY-131)
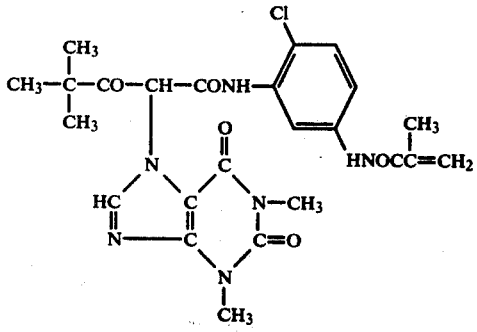
(AY-132)
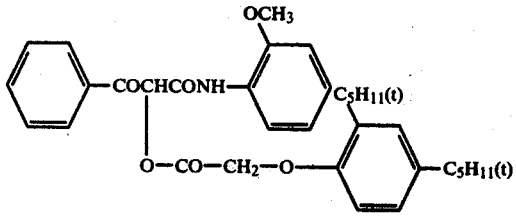
(AY-133)
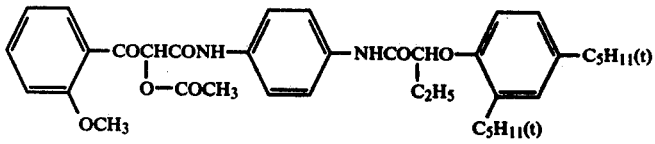
(AY-134)
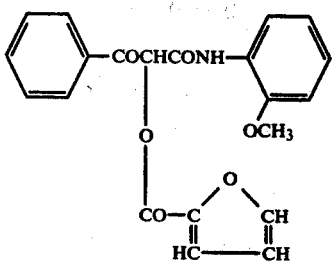
(AY-135)
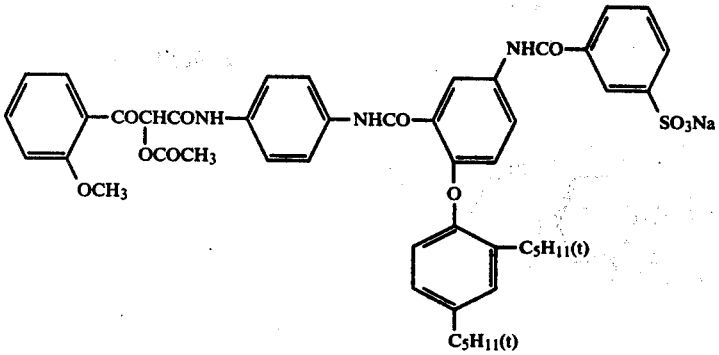

-continued
(AY-136)
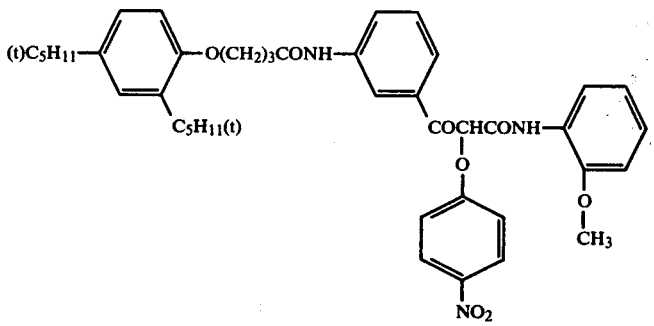
(AY-137)
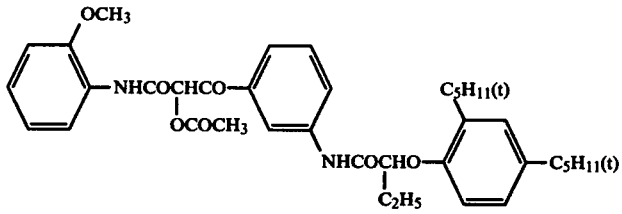
(AY-138)
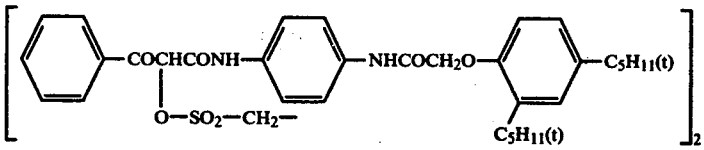
(AY-139)
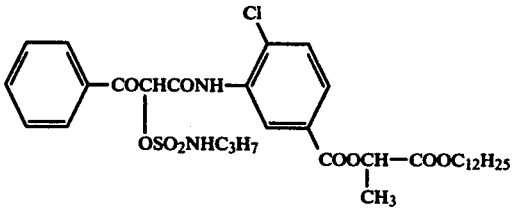
(AY-140)
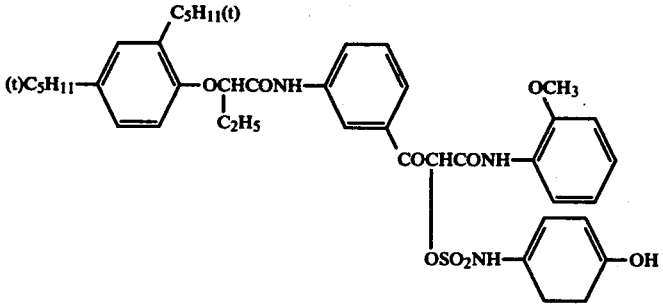
(AY-141)
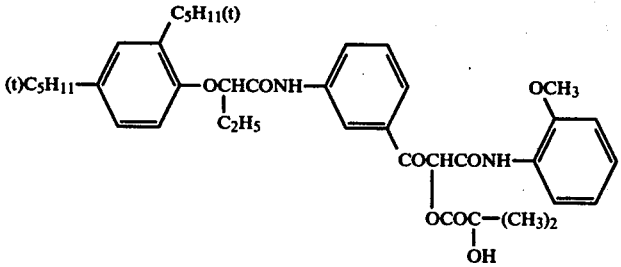

-continued
(AY-142)
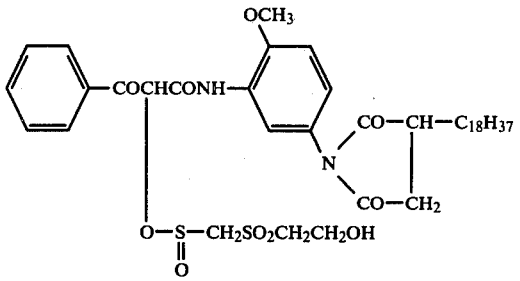
(AY-143)
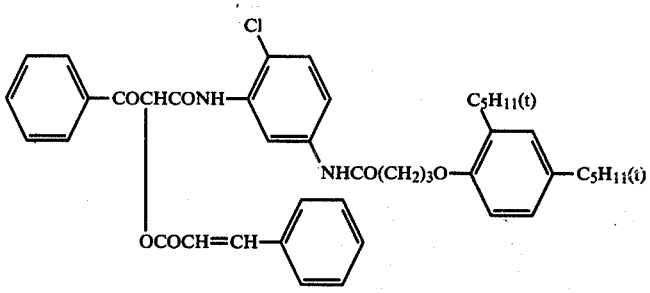
(AY-144)
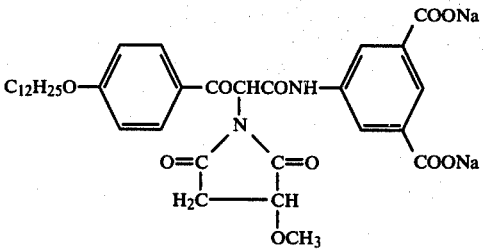
(AY-145)
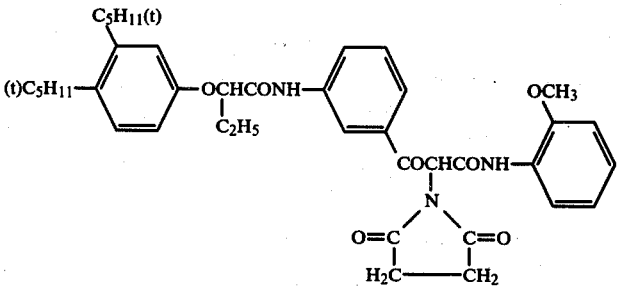
(AY-146)
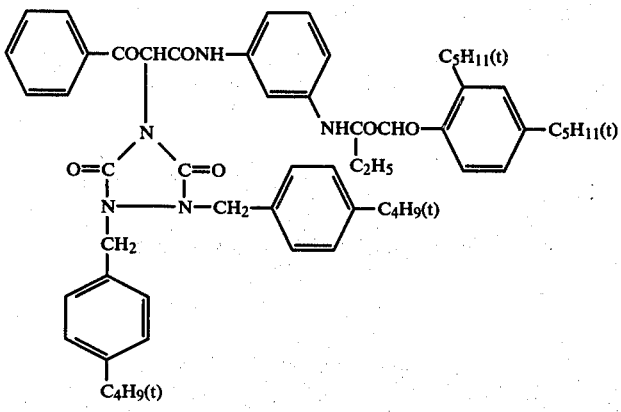

-continued
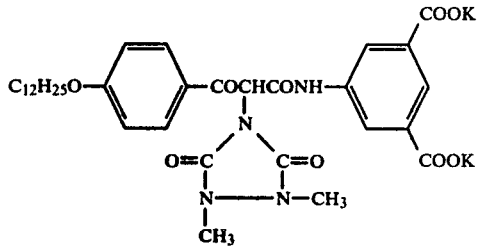
(AY-147)
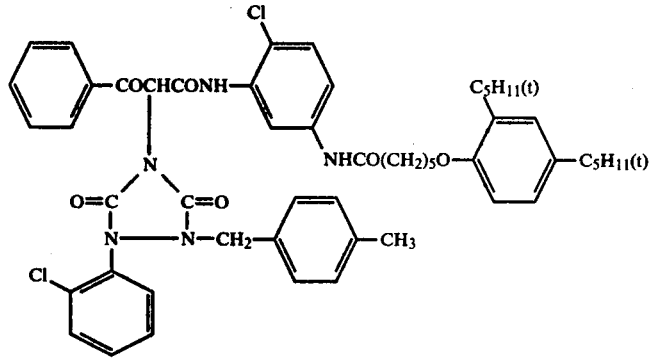
(AY-148)
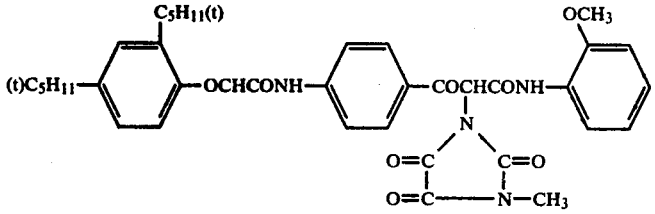
(AY-149)
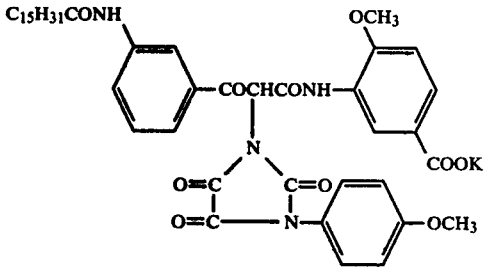
(AY-150)
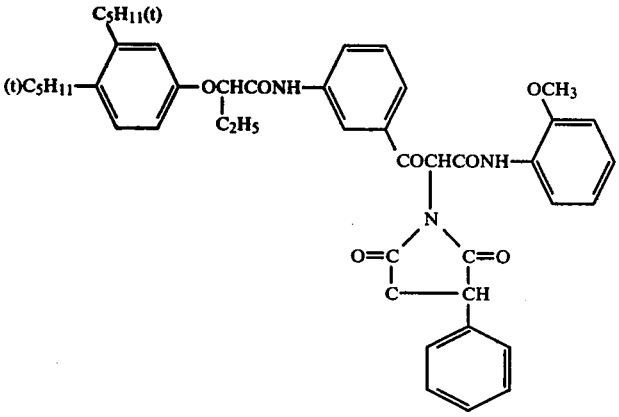
(AY-151)

-continued
(AY-152)
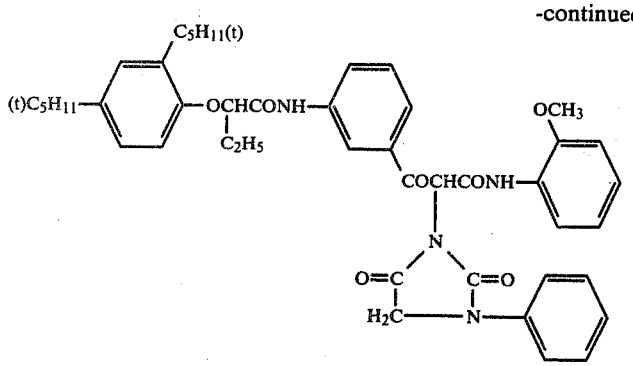
(AY-153)
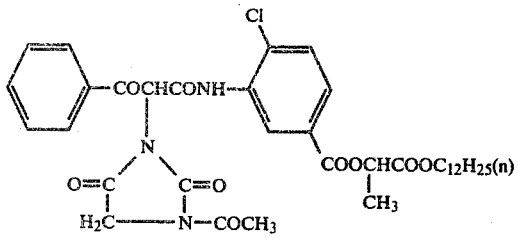
(AY-154)
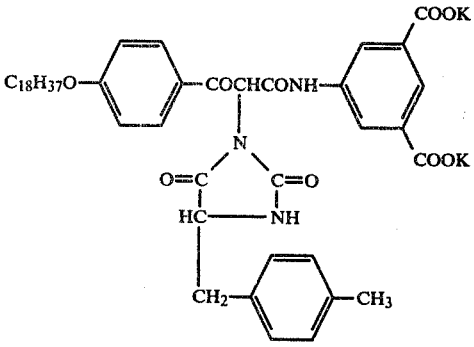
(AY-155)
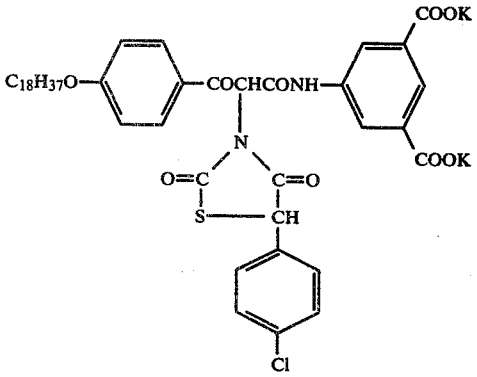
(AY-156)
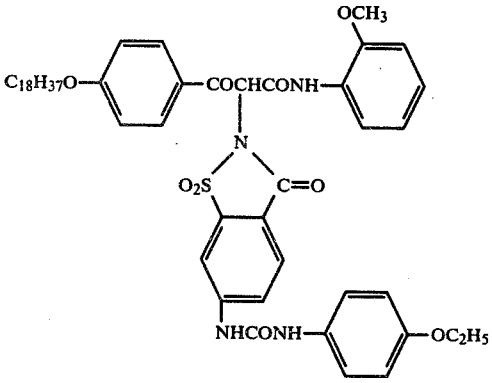

-continued
(AY-157)
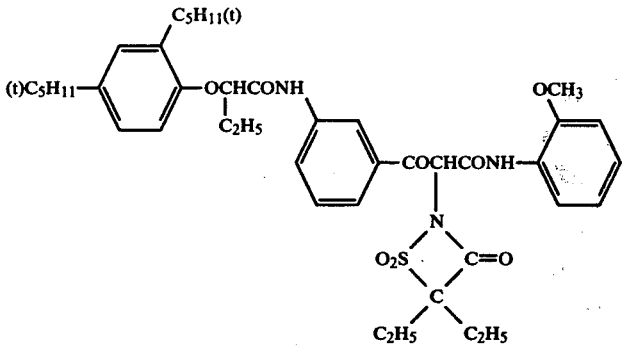
(AY-158)
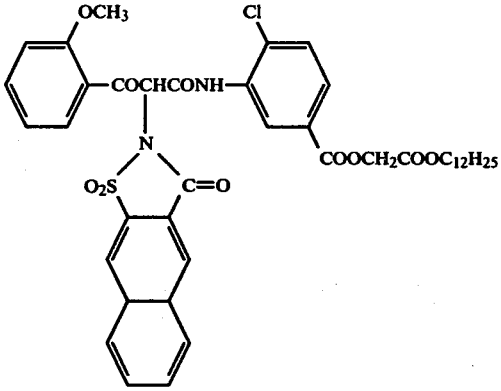
(AY-159)
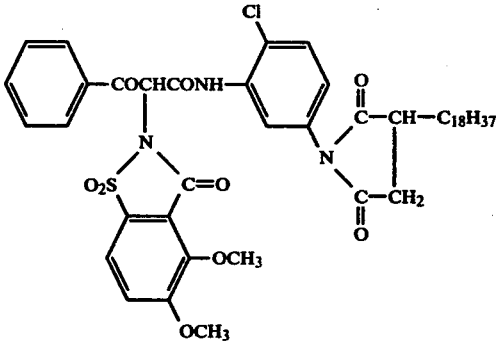
(AY-160)
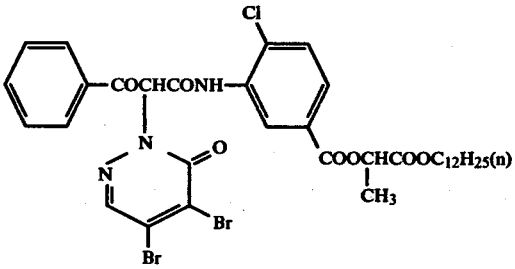
(AY-161)
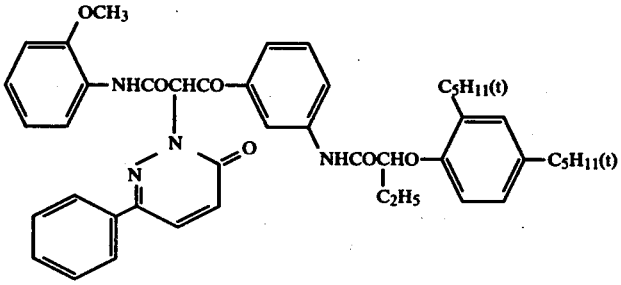

-continued
(AY-162)
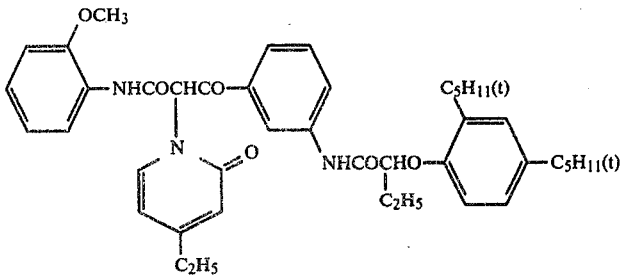
(AY-163)
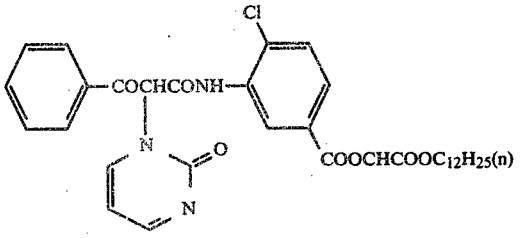
(AY-164)
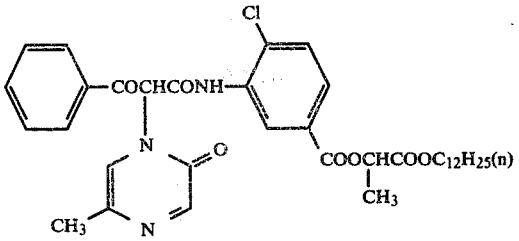
(AY-165)
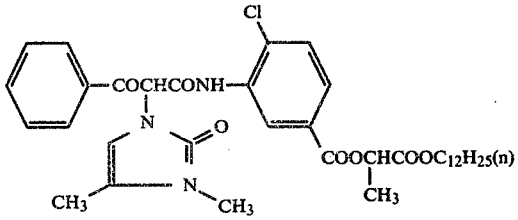
(AY-166)
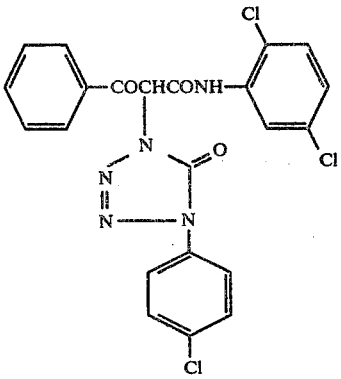
(AY-167)
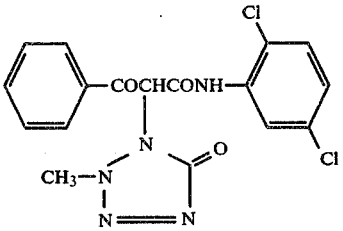

-continued
(AY-168)
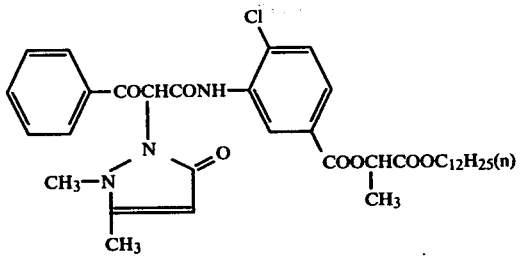
(AY-169)
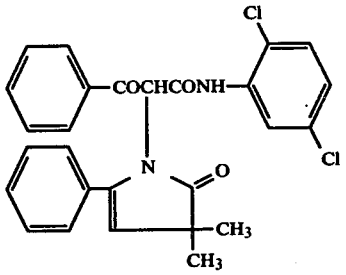
(AY-170)
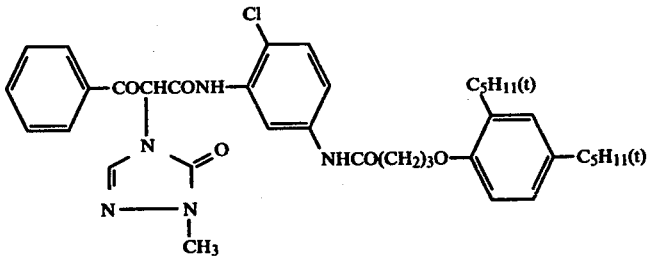
(AY-171)
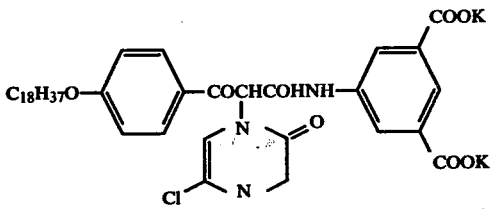
(AY-172)
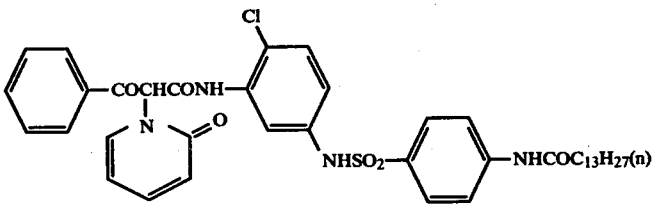
(AY-173)
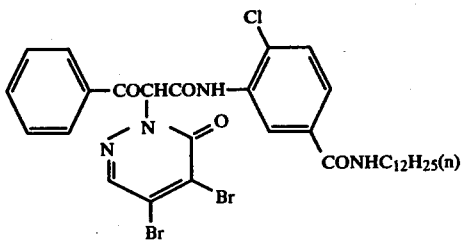

-continued
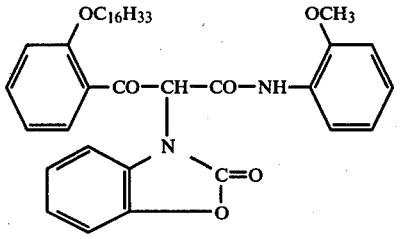
(AY-174)
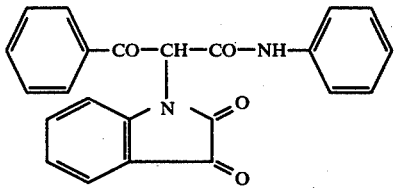
(AY-175)
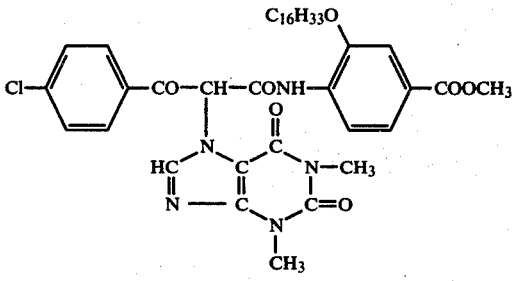
(AY-176)
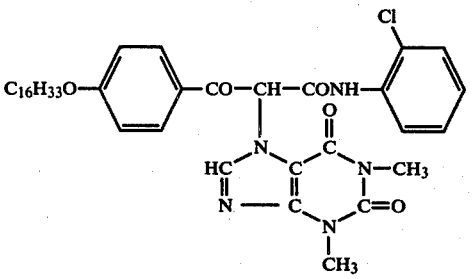
(AY-177)
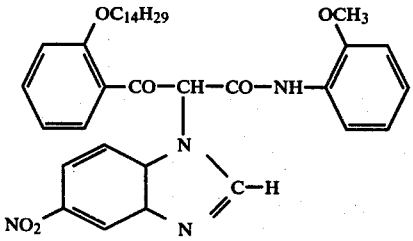
(AY-178)
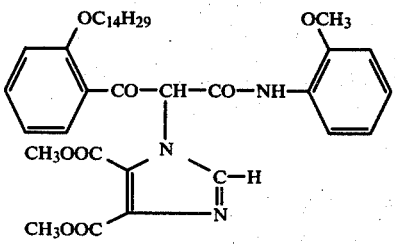
(AY-179)

-continued
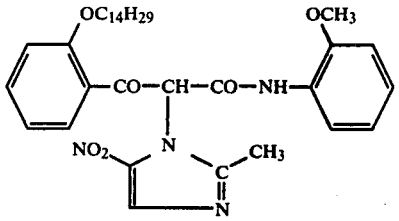
(AY-180)
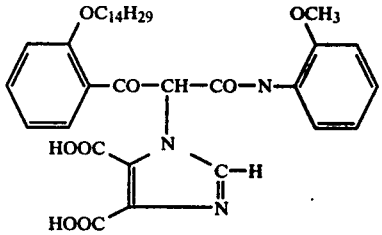
(AY-181)
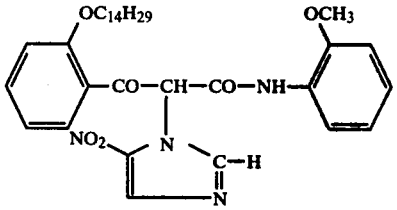
(AY-182)
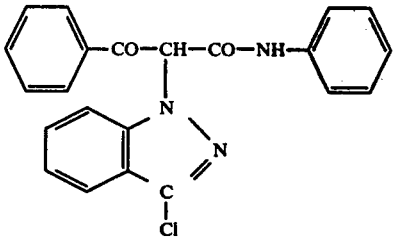
(AY-183)
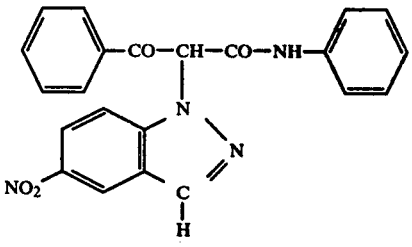
(AY-184)
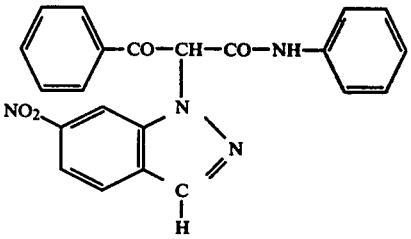
(AY-185)
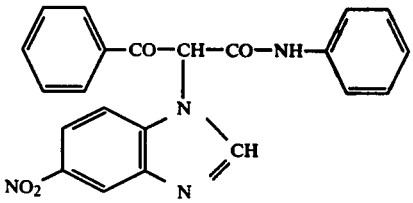
(AY-186)

-continued
(AY-187)
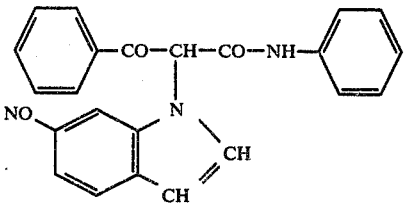
(AY-188)
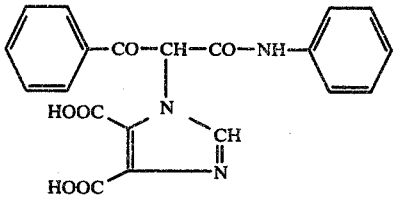
(AY-189)
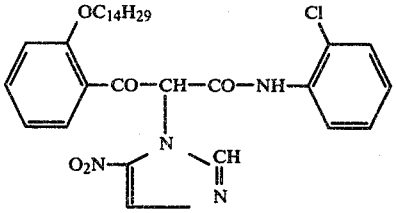
(AY-190)
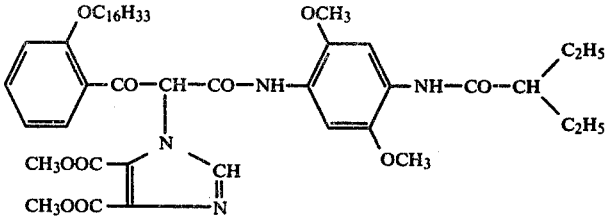
(AY-191)
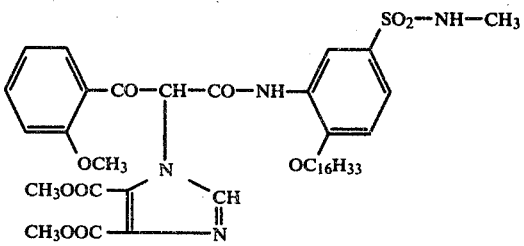
(AY-192)
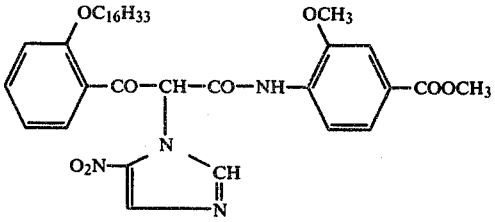
(AY-193)
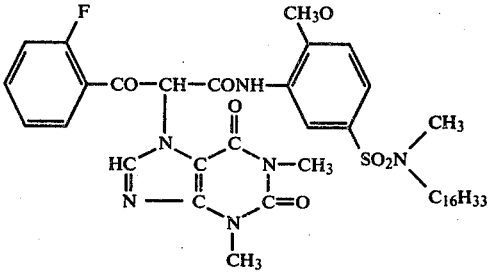

-continued
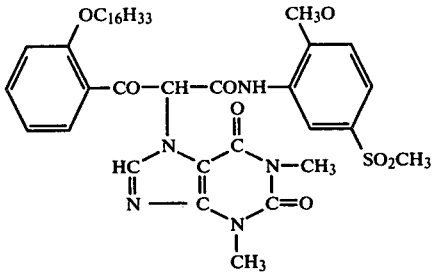
(AY-194)
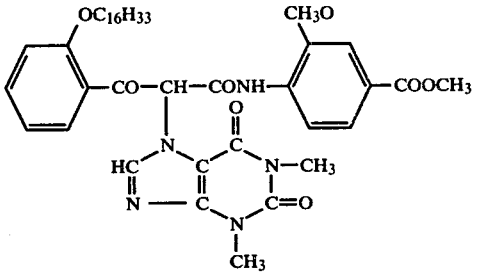
(AY-195)
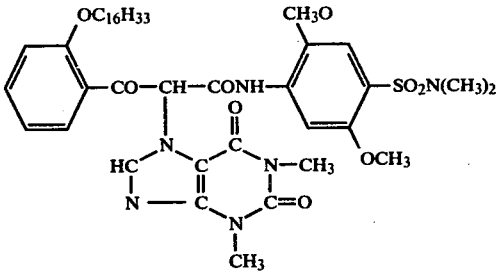
(AY-196)
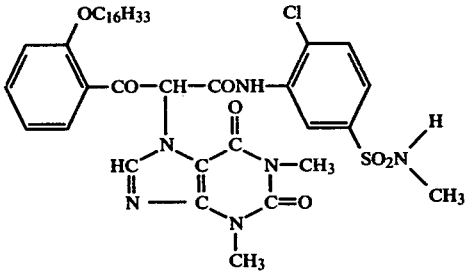
(AY-197)
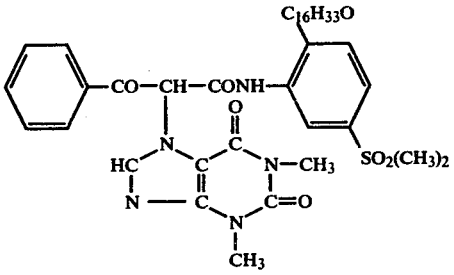
(AY-198)
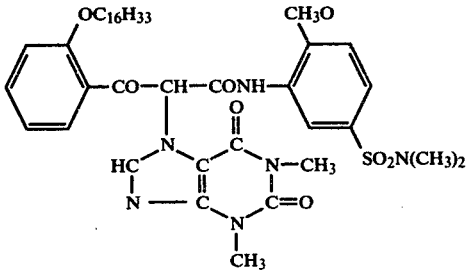
(AY-199)

-continued
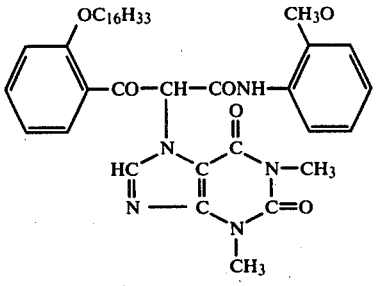
(AY-200)
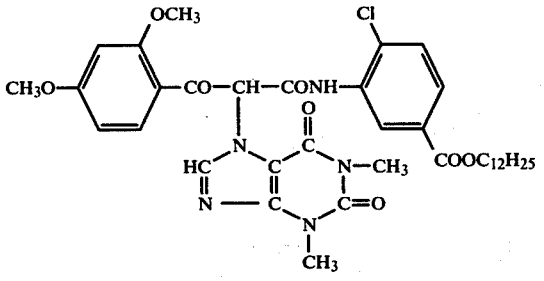
(AY-201)
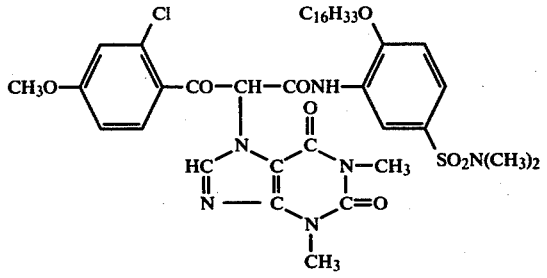
(AY-202)
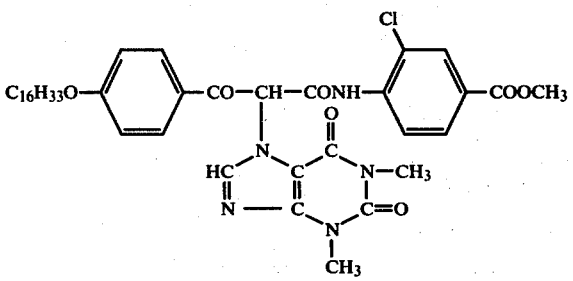
(AY-203)
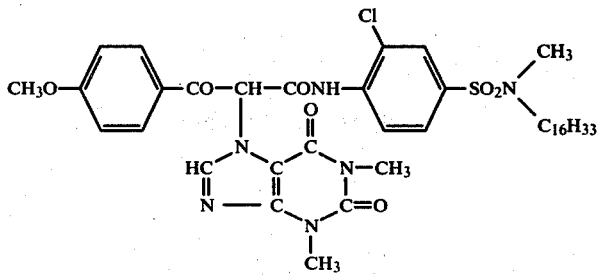
(AY-204)

-continued
(AY-205)
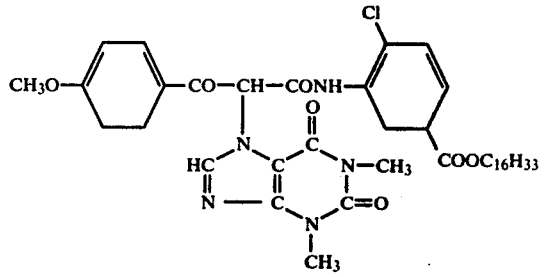
(AY-206)
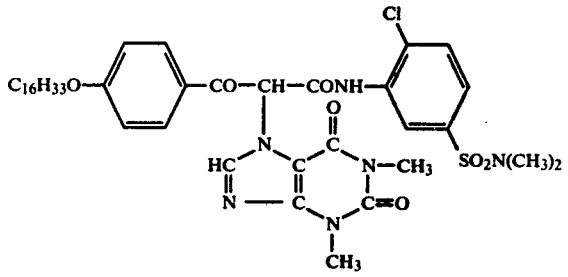
(AY-207)
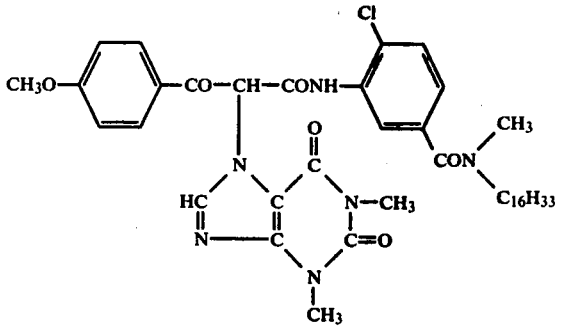
(AY-208)
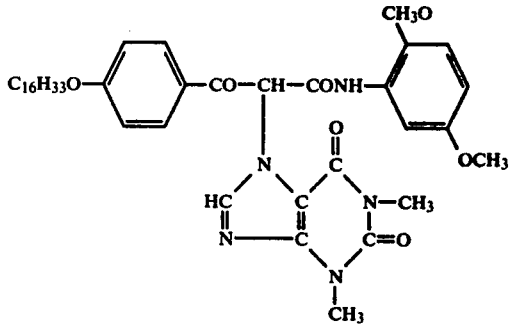
(AY-209)
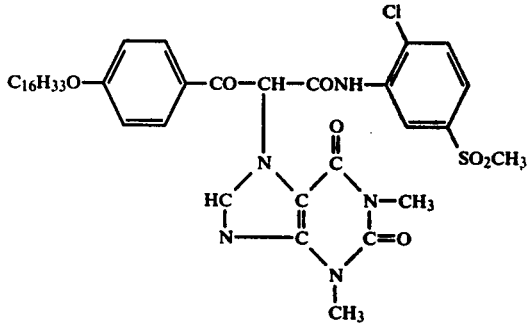

-continued
(AY-210)
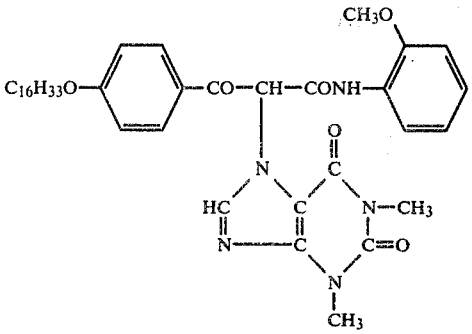
(AY-211)
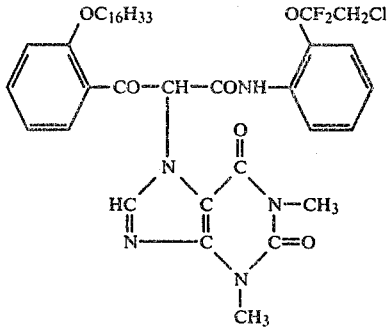
(AY-212)
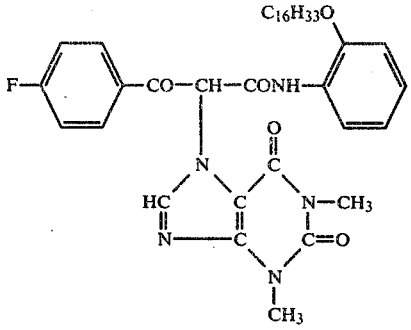
(AY-213)
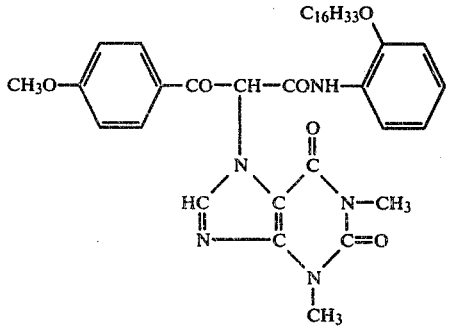
(AY-214)
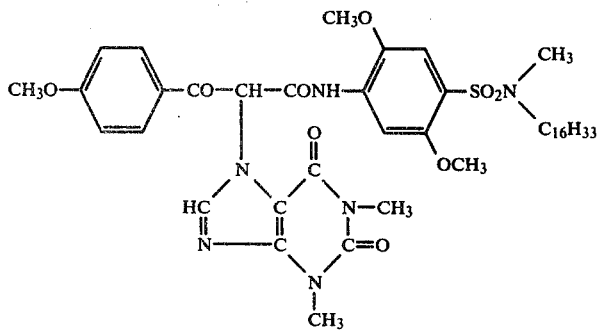

-continued
(AY-215)
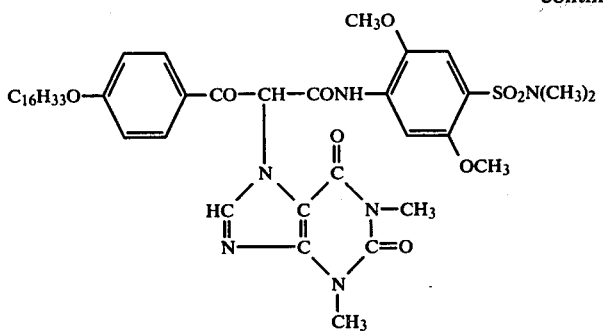
(AY-216)
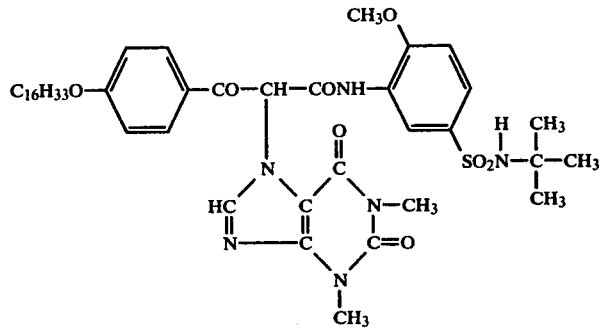
(AY-217)
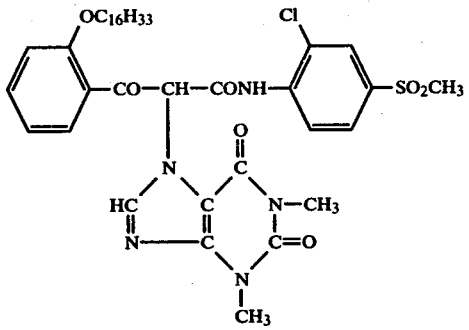
(AY-218)
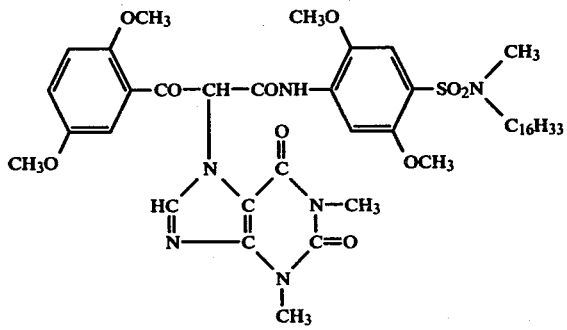
(AY-219)
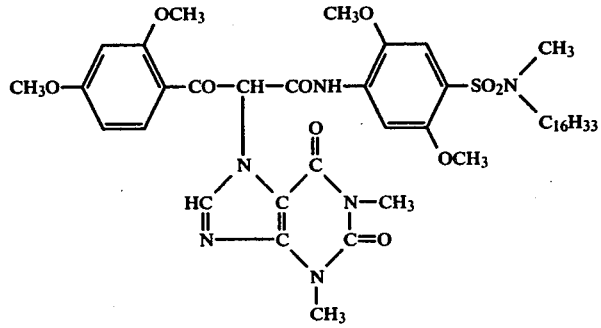

-continued
(AY-220)
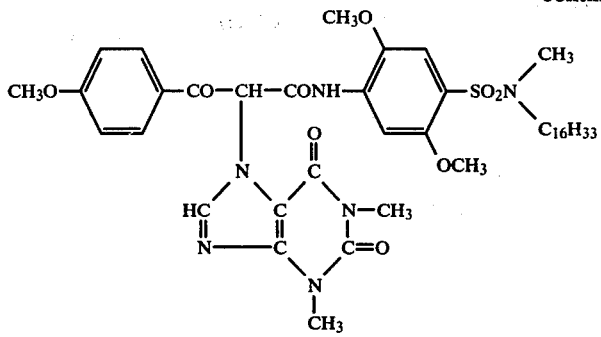
(AY-221)
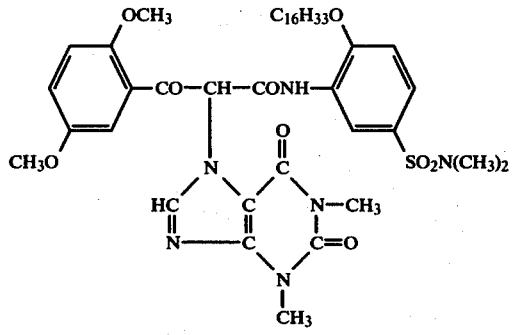
(AY-222)
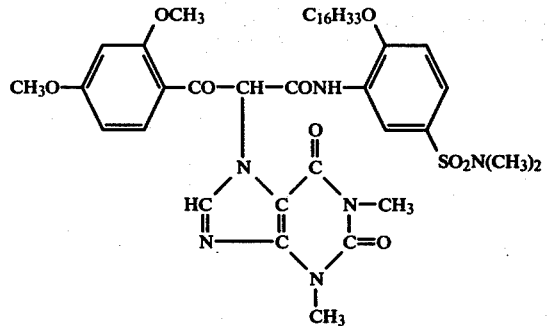
(AY-223)
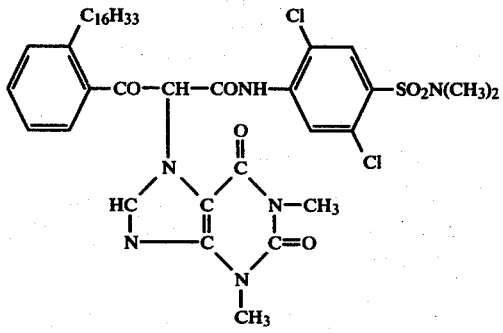
(AY-224)
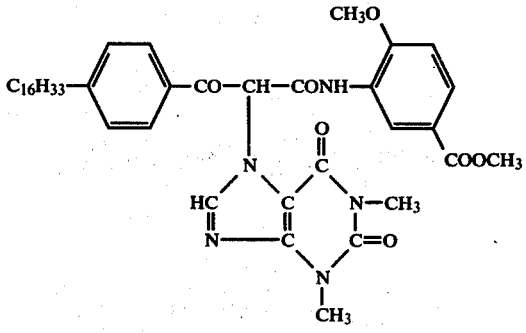

-continued
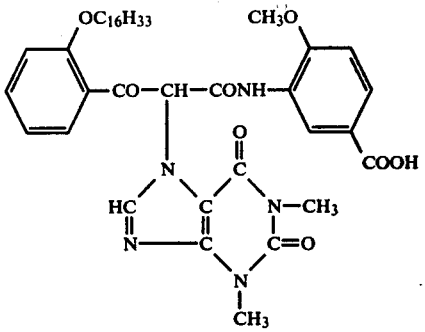
(AY-225)
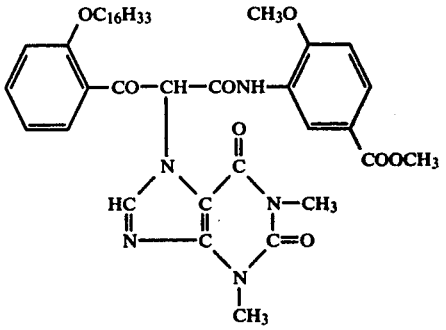
(AY-226)
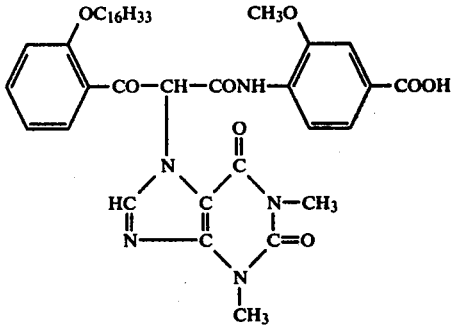
(AY-227)
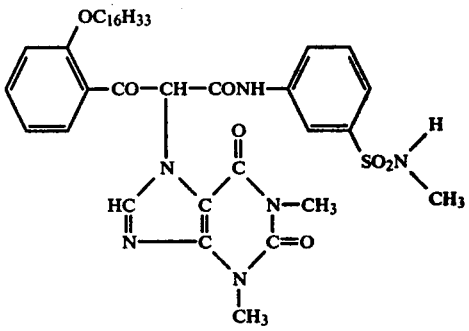
(AY-228)
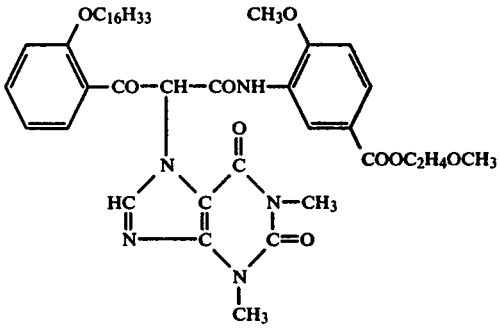
(AY-229)

-continued
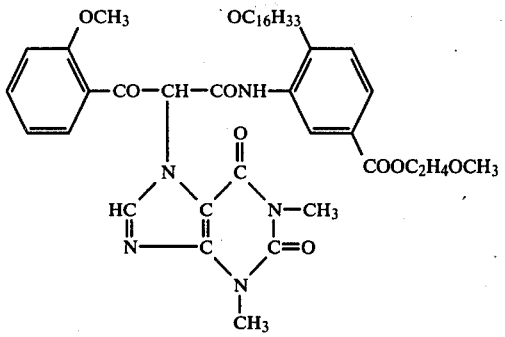
(AY-230)
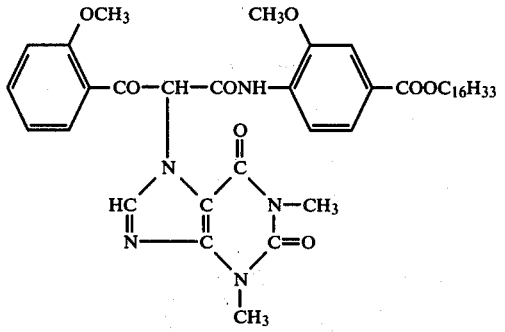
(AY-231)
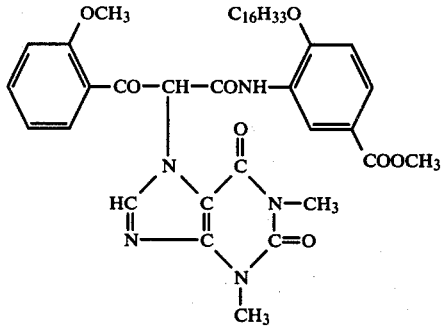
(AY-232)
Couplers of the general formula (II):
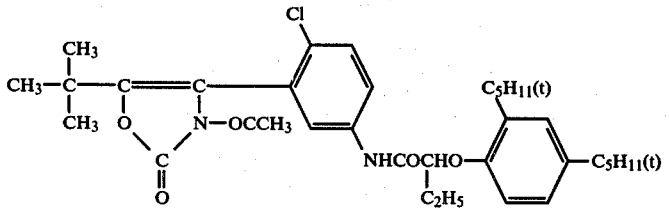
(AY-233)
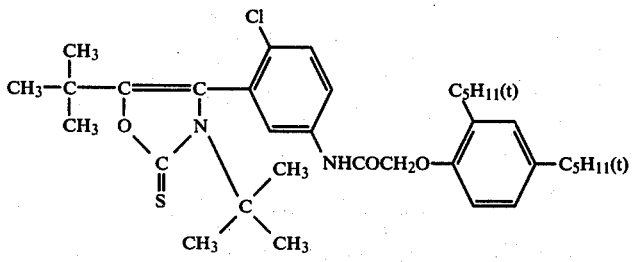
(AY-234)

-continued
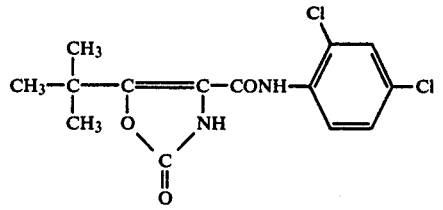
(AY-235)
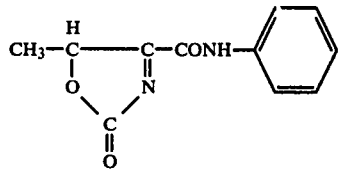
(AY-236)
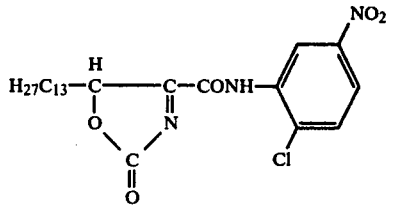
(AY-237)
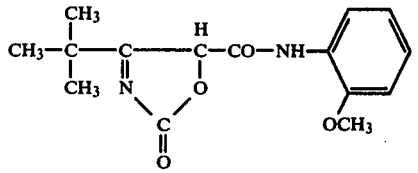
(AY-238)
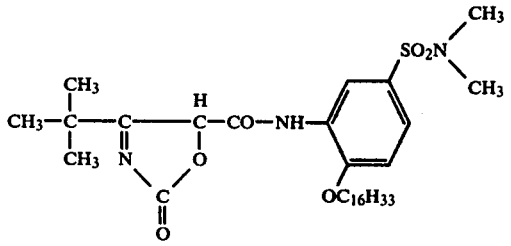
(AY-239)
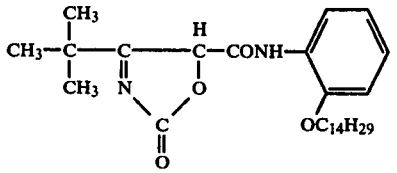
(AY-240)
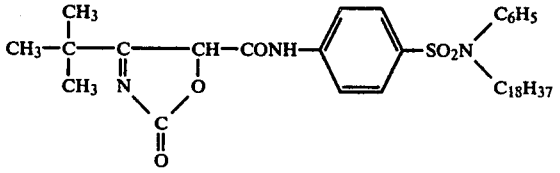
(AY-241)
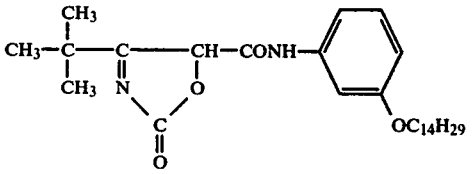
(AY-242)

-continued
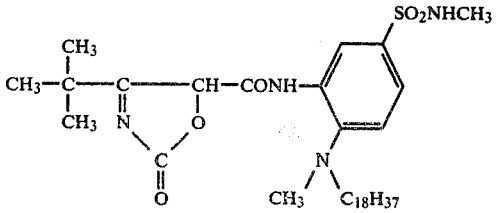
(AY-243)
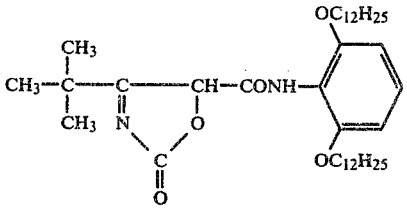
(AY-244)
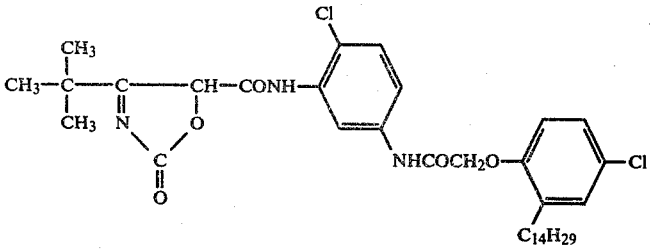
(AY-245)
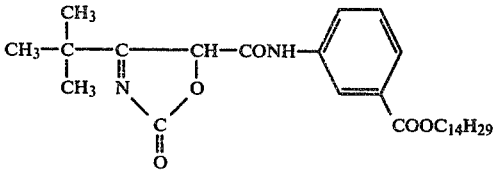
(AY-246)
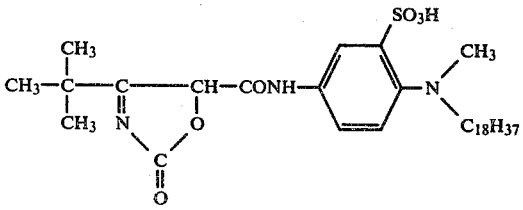
(AY-247)
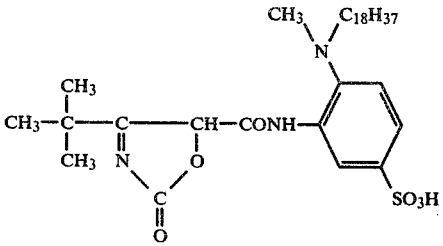
(AY-248)
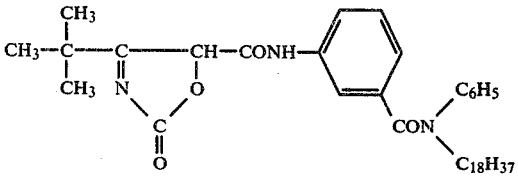
(AY-249)

-continued
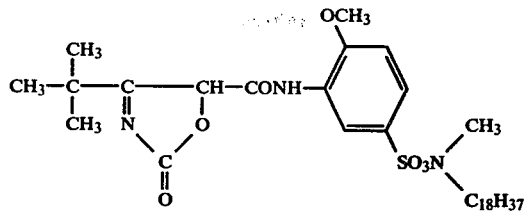
(AY-250)
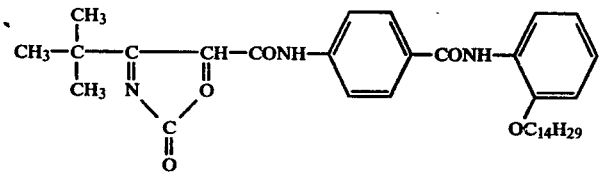
(AY-251)
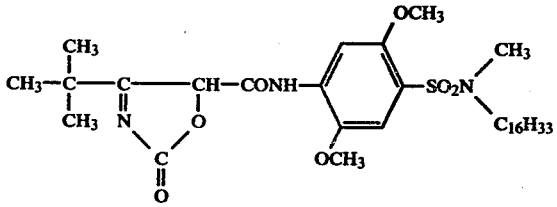
(AY-252)
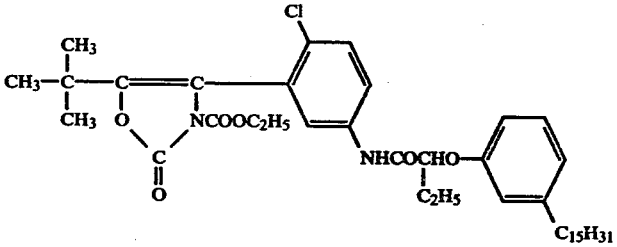
(AY-253)
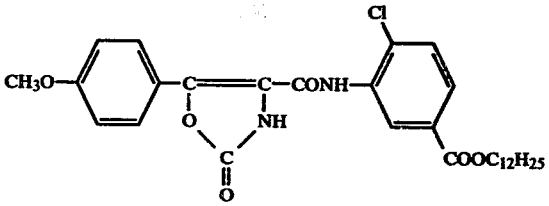
(AY-254)
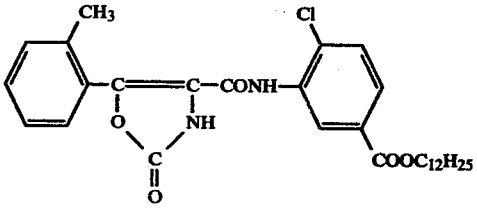
(AY-255)
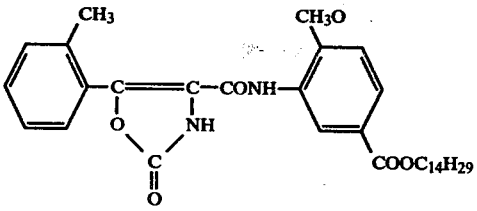
(AY-256)

-continued
(AY-257)
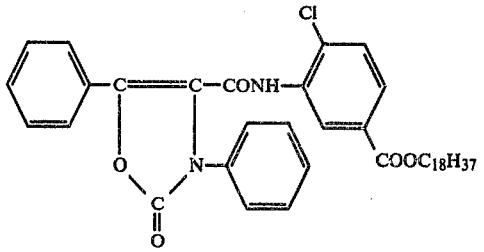
(AY-258)
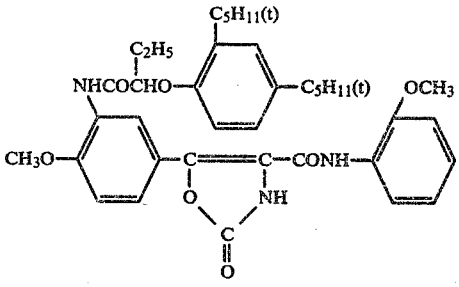
(AY-259)
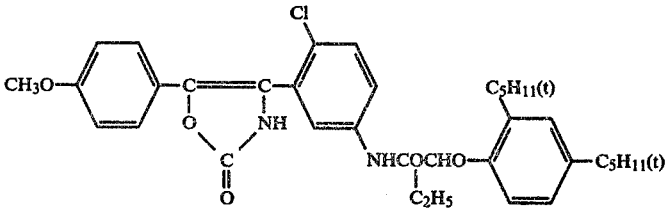
(AY-260)
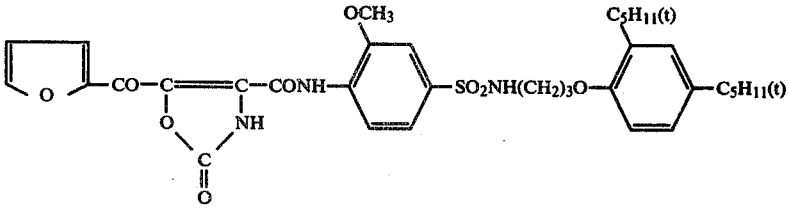
(AY-261)
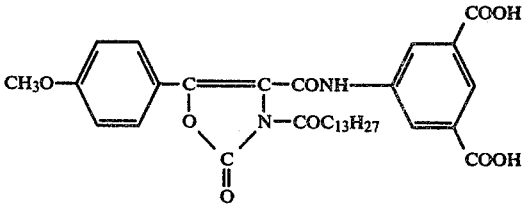
(AY-262)
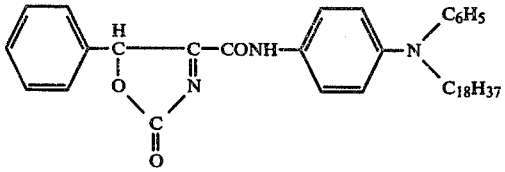
(AY-263)
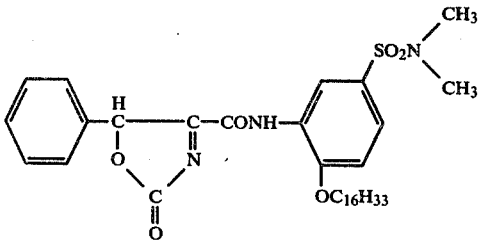

-continued
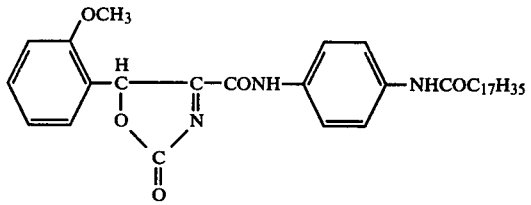
(AY-264)
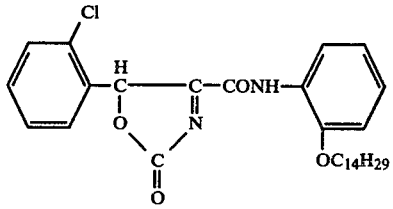
(AY-265)
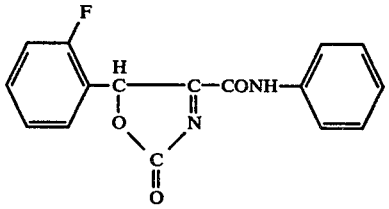
(AY-266)
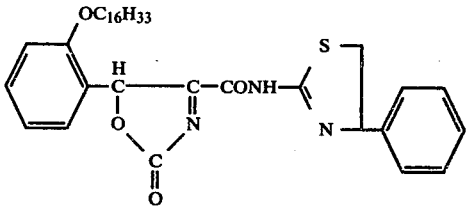
(AY-267)
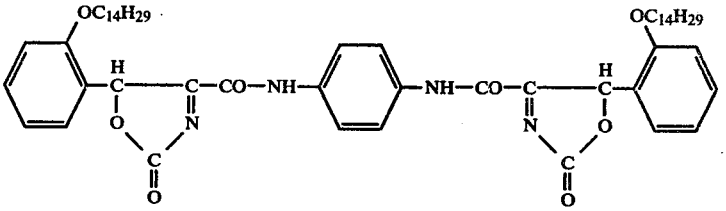
(AY-268)
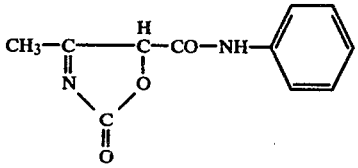
(AY-269)
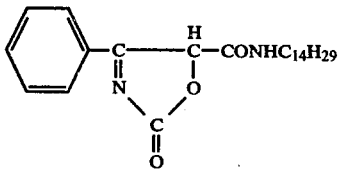
(AY-270)
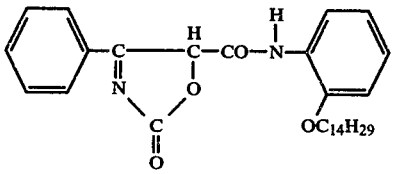
(AY-271)

-continued
(AY-272)
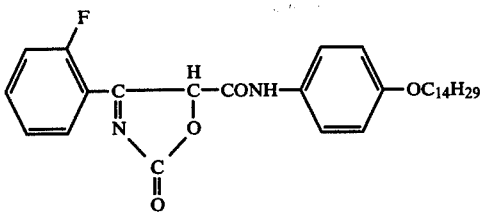
(AY-273)
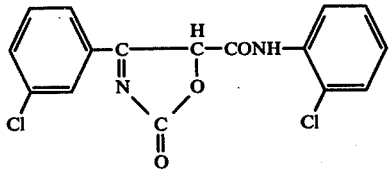
(AY-274)
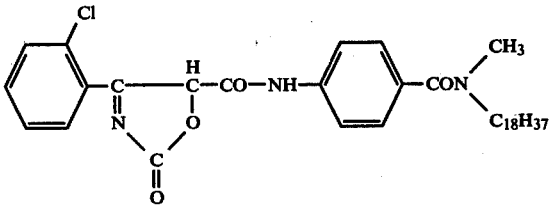
Couplers of the general formula (II):
(AY-275)
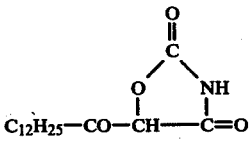
(AY-276)
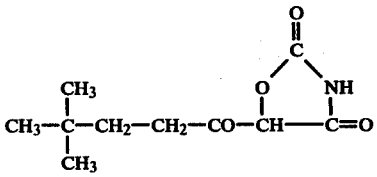
(AY-277)
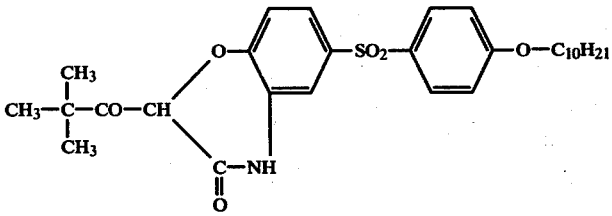
(AY-278)
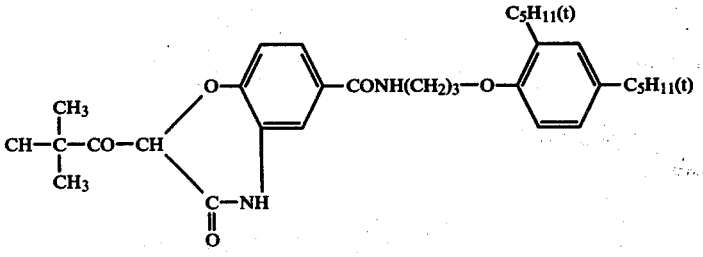

-continued
(AY-279)
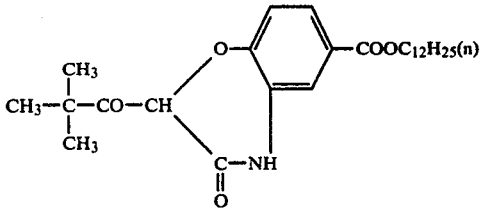
(AY-280)
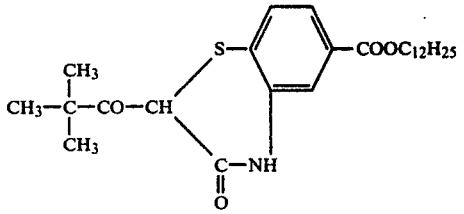
(AY-281)
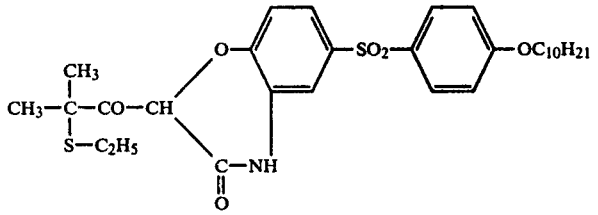
(AY-282)
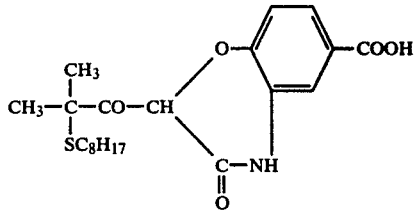
(AY-283)
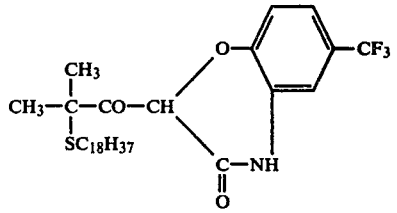
(AY-284)
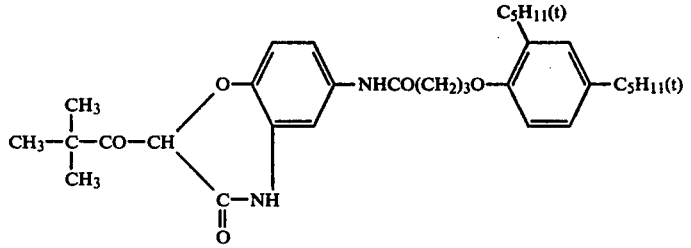
(AY-285)
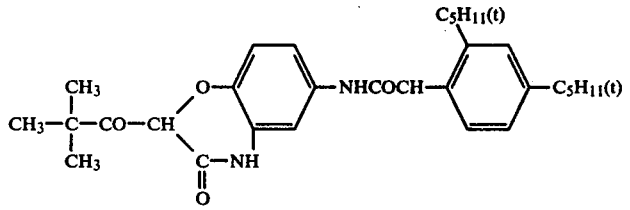

-continued
(AY-286)
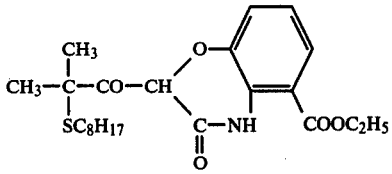
(AY-287)
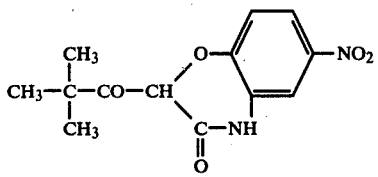
(AY-288)
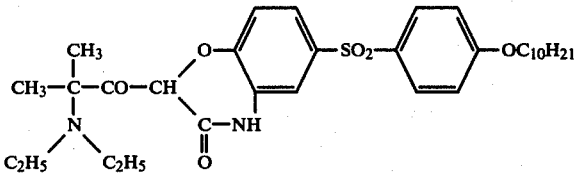
(AY-289)
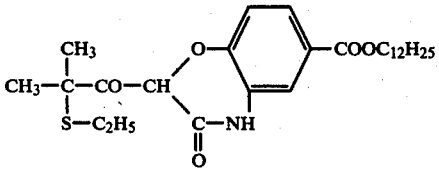
(AY-290)
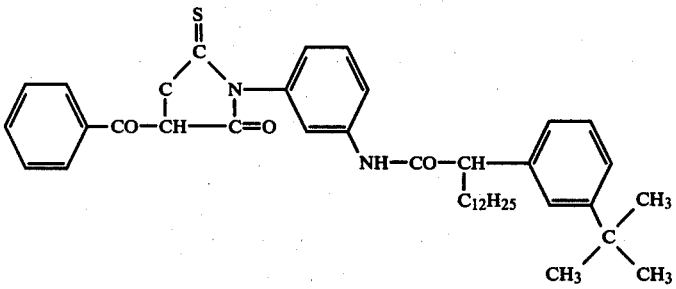
(AY-291)
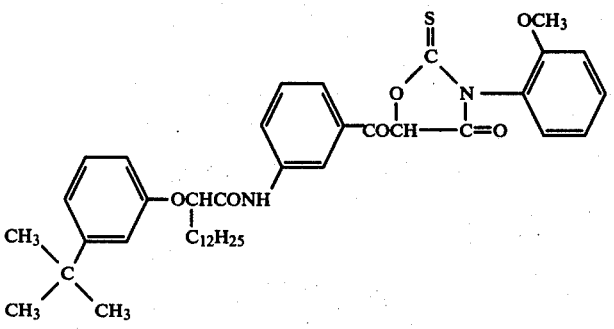

-continued
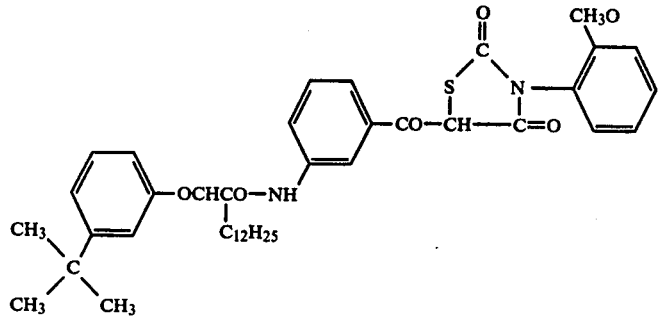
(AY-292)
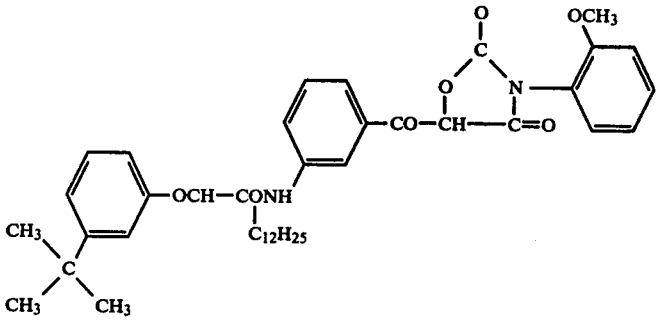
(AY-293)
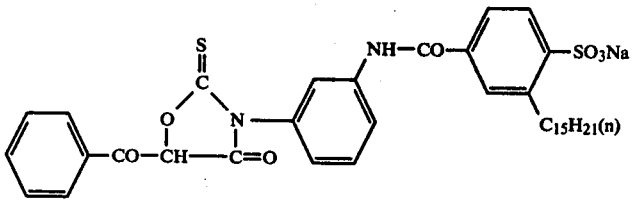
(AY-294)
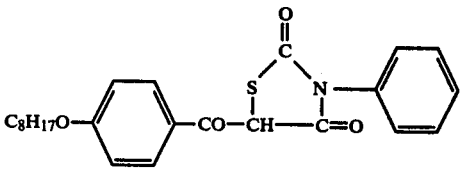
(AY-295)
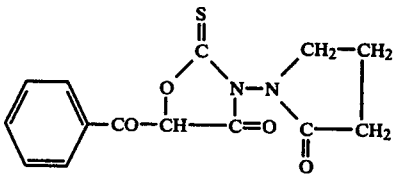
(AY-296)
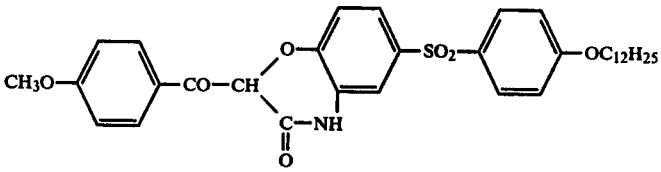
(AY-297)

-continued
(AY-298)
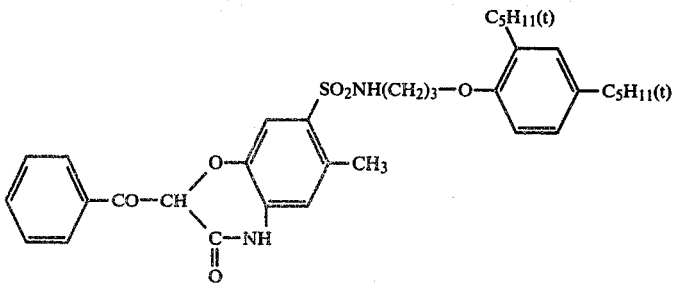
(AY-299)
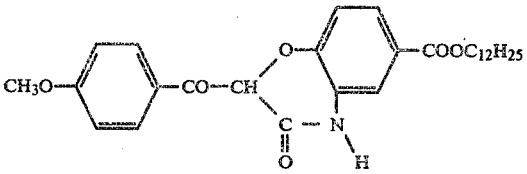
(AY-300)
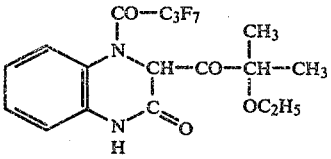
(AY-301)
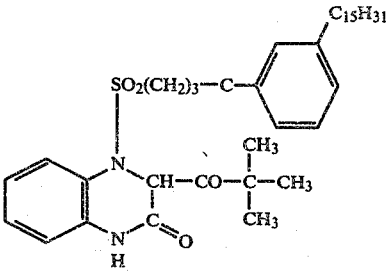
(AY-302)
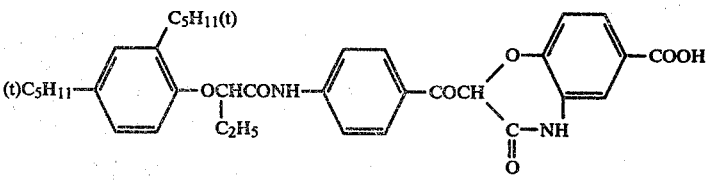
Couplers of the general formula (IV):
(AY-303)
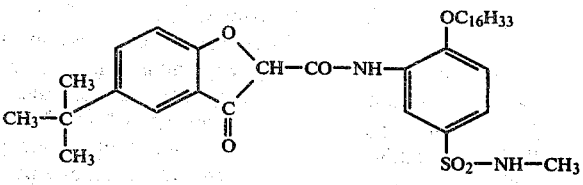
(AY-304)
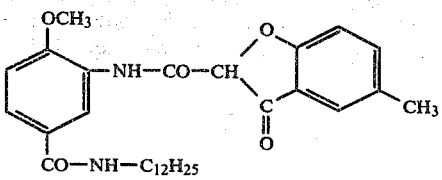

-continued

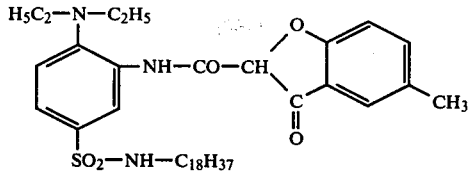

(AY-305)

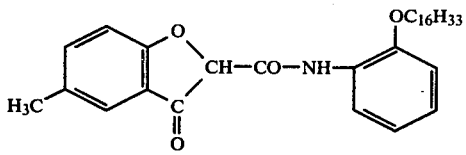

(AY-306)

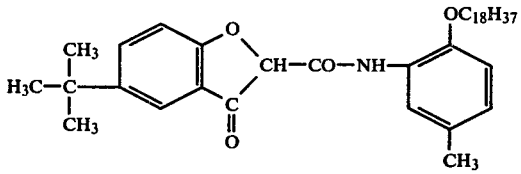

(AY-307)

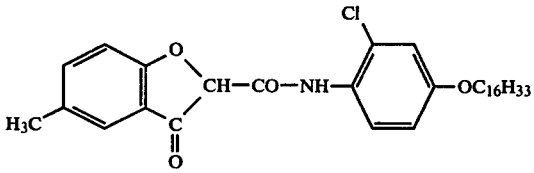

(AY-308)

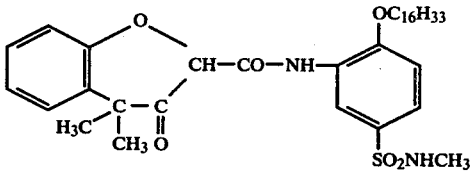

(AY-309)

As a compound providing a bromide ion to be contained in the color developing solution according to this invention, any known bromides, for example, lithium bromide, rubidium bromide, ammonium bromide, sodium bromide or potassium bromide may be used. Since such bromides are used for providing a bromide ion, type of bromides is not particularly limited and bromides may be used in the combination of two or more of them.

The concentration of the bromide ion in the developing solution as used in this invention may be sufficient at more than 0.0292 mol/liter to achieve the object of this invention, and preferably 0.0292–3.0 mol/liter, but for a high speed light-sensitive silver halide color photographic material, the concentration of 0.0534 mol/liter is more effective.

The processing according to this invention is particularly advantageous not only for the abovementioned objects but also for reduction of cost and prevention of public pollution.

Previously, when the treatment is carried out by means of an automatic processing machine, treatment of a light-sensitive material has been effected while supplementing the processing solution depending upon the amount of the light-sensitive material to be treated. In this process, the amount to be supplemented is quite a large quantity, for example, the supplementing amount for the color developing solution of treatment process C-41 (for use in the treatment of color negative film) which is the product of Eastman Kodak Co., Ltd. is 45.6 cc per roll of usual 35 mm film. However, it is the present status that most of the amount overflows out of the tank of the automatic developing machine and then is discarded. This has been a great problem in removing public pollution.

To the contrary, according to the process of this invention, treatment without substantial overflow is possible and thus the process of this invention is particularly advantageous not only for removing public pollution but also for reducing cost.

The color developer used in the color developing solution according to this invention is an aromatic primary amine compound and the typical examples thereof include p-phenylenediamines and p-aminophenols. As further concrete typical examples, the following compounds can be mentioned:

Salts with inorganic acid such as hydrochloric acid or sulfuric acid, or organic acid such as p-toluenesulfonic acid of N,N-dimethyl-p-phenylenediamine, N,N-diethyl-p-phenylenediamine, 3-methyl-N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-ethyl-p-phenylenediamine, 3-β-methanesulfonamidoethyl-4-amino-N,N-diethylaniline, N-ethyl-N-tetrahydrofurfuryl-2-methyl-p-aminophenol, 3-acetylamino-4-aminodimethylaniline, 3-methyl-4-amino-N-ethyl-N-β-hydroxyethylaniline, N-ethyl-N-β-methanesulfonamidoethyl-4-aminoaniline, 3-methyl-4-amino-N-ethyl-N-β-methanesulfonamidoethylamine, N-ethyl-N-β-methanesulfoniamidoethyl-3-methyl-4-aminoaniline, 3-methyl-4-amino-N-ethyl-N-β-methoxyethylaniline, N-methyl-N-β-sulfoethyl-p-phenylenediamine, N-ethyl-N-β-(β-methoxyethoxy)ethyl-3-methyl-4-aminoaniline, N-ethyl-N-β-[β-(β-methoxyethoxy)ethoxy]ethyl-3-methyl-4-aminoaniline, o-aminophenol, or p-aminophenol, 5-amino-2-oxy-toluene.

Further, those described in, for example, Japanese Patent L-O-P Specifications No. 48-64932, No. 50-131526 and No. 51-95849 and Bent et al's Journal of the American Chemical Society, 73, 3100–3125 (1951) may be included as the typical examples.

The amount of these aromatic primary amino compounds is decided depending upon the active degree of the developing solution. In order to increase the active degree, it is effective to increase the amount used. As the amount used, the range from 0.0002 mol/liter to 0.7 mol/liter is ordinary. Furthermore, depending upon the objects, several compounds can be used in an appropriate combination. For example, the following combinations can freely be used depending upon the objects:

Combinations: 3-methyl-4-amino-N,N-diethylaniline and 3-methyl-4-amino-N-ethyl-N-β-methanesulfonamidoethylaniline; 3-methyl-4-amino-N-ethyl-N-β-methanesulfonamidoethylaniline and 3-methyl-4-amino-N-ethyl-N-β-hydroxyethylaniline; 3-methyl-4-amino-N-ethyl-N-β-methanesulfonamidoethylaniline and N-ethyl-N-β-[β-(β-methoxyethoxy)ethoxy)]ethyl-3-methyl-4-aminoaniline; 3-methyl-4-amino-N,N-diethylaniline and 3-methyl-4-amino-N-ethyl-N-β-methanesulfonamidoethylaniline; 3-methyl-4-amino-N-ethyl-N-β-hydroxyethylaniline and N-ethyl-N-β-[β-(β-methoxyethoxy)ethoxy]ethyl-3-methyl-4-aminoaniline; and 3-methyl-4-amino-N-ethyl-N-β-methanesulfonamidoethylaniline and 3-methyl-4-amino-N-β-methoxyethylaniline.

Further, in the process of this invention, in addition to the above coupler according to this invention, the yellow-, magenta- and/or cyan couplers which have heretofore been known may be used in combination.

The yellow coupler which may be used in combination includes an open-chain ketomethylene series coupler, the magenta coupler used in combination includes pyrazolone series-, pyrazolyltriazole series-, pyrazolinobenzimidazole series- and indazolone series couplers and the cyan coupler used in combination includes phenol series- and naphthol series couplers. These couplers used in combination may further be combined not only alone but also together with two or more thereof.

Furthermore, it may be possible in the present invention to use an azo type colored coupler for making an automask, osazone type compound, a coupler releasing diffusible dye on development (so-called DDR coupler), a coupler releasing a development inhibitor during the coupling with a color developer (so-called DIR coupler), a compound releasing a development inhibitor but forming no colored dye during the coupling with a color developing agent (so-called DIR substance) or a coupler forming no colored dye even by coupling (so-called white-coupler).

In the present invention, the coupler according to this invention and other coupler, etc. may sufficiently be present during color development for achieving the object of this invention and the coupler according to this invention may be present either in the color developing solution or in the light-sensitive color photographic material. The coupler of this invention is preferably present in the light-sensitive color photographic material.

Generally, the coupler of this invention is usually present in the silver halide emulsion layer of the light-sensitive color photographic material.

The coupler of this invention, when it is soluble in an alkali, may be added, as an alkaline solution, into the silver halide emulsion and, when it is soluble in oil, the coupler of this invention is preferably added into the silver halide emulsion by being dissolved according to the method as described in U.S. Pat. Nos. 2,332,027, 2,801,170, 2,801,171, 2,272,191 and 2,304,940 in a high-boiling solvent, if necessary, using at the same time a low-boiling solvent and dispersed. In this case, if necessary, other couplers, hydroquinone derivatives, UV-absorbers, fading inhibiting agents, etc. may be used without causing any adverse effects. Further, in that case, the coupler of this invention may be used as a mixture of two or more of them without causing any adverse effect. The method for adding the coupler of this invention will be explained below in detail. One or more of the couplers of this invention, if necessary, together with other couplers, hydroquinone derivatives, fading inhibiting agents or UV-absorbers are dissolved in a high-boiling solvent such as organic acid amides, carbamates, esters, ketones, urea derivatives, particularly di-n-butyl phthalate, tricresyl phosphate, triphenyl phosphate, di-isooctyl azelate, di-n-butyl sebacate, tri-n-hexyl phosphate, N,N-diethyl-caprylamide butyl, N,N-diethyl-laurylamide, n-pentadecyl phenyl ether, dioctyl phthalate, n-nonyl phenol, 3-pentadecylphenyl ethyl ether, 2,5-di-sec.-amylphenyl butyl ether, monophenyl-di-O-chlorophenyl phosphate or fluorine paraffin, if necessary, in a low-boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl, alcohol, acetnitrile, dimethylformamide, dioxane methyl ethyl ketone (these high-boiling solvents and low-boiling solvents may be used alone or in combination), mixed with an aqueous solution containing a hydrophilic binder such as gelatin which contains an anion surfactant such as alkylbenzenesulfonic acid and alkylnaphthalenesulfonic acid and/or a nonion surfactant such as sorbitan sesquiolenic acid ester and sorbitan monolauric acid ester, emulsified and dispersed by means of a high-speed rotary mixer, a colloid mill or a supersonic dispersion apparatus and then added to the silver halide emulsion.

The amount of the coupler to be added is not limitative by preferably 10–100 g per mol of silver halide and when the coupler of this invention is added to the color developing solution, it is added in the amount of about 0.1–3 g/l and the amount added may be varied appropriately depending upon needs.

Use of a thiazolidone, benzotriazole, acrylonitrile or benzophenone compound as the UV-absorber to be used together with the coupler of this invention is convenient to prevent fading due to active light of short wavelength and, in particular, use of Tinuvin-ps, −320, −326, −327 and −328 (all being products of Ciba-Geigy Limited) alone or in combination is convenient.

The hydroquinone derivatives used together with the coupler of this invention include also the precursors thereof. The term precursor means a compound which releases a hydroquinone derivative on being hydrolyzed.

The fading inhibiting agents used together with the coupler of this invention include a chroman compound, a coumaran compound, a spiro-chroman compound, etc.

The silver halide emulsion used in the lightsensitive color photographic material is usually a dispersion of silver halide particles in hydrophilic colloid and said silver halide includes silver chloride, silver bromide, silver iodide, silver chlorobromide, silver iodobromide and the mixture thereof. These silver halides are prepared by a various process such as an ammonia method, a neutral method, a so-called conversion method and a simultaneous mixing process. The hydrophilic colloid in which the silver halide is dispersed generally includes gelatin and modified gelatin such as phthalated gelatin or malonated gelatin and in place of a part or whole of such gelatin or modified gelatin, it is possible to use albumin, agar, gum arabic, alginic acid, casein, partially hydrolyzed cellulose derivative, polyvinylalcohol, partially hydrolyzed polyvinyl acetate, polyacrylamide, imidation product of polyacrylamide, polyvinylpyrrolidone and copolymers of these vinyl compounds. Further, the silver halide emulsion can be optically sensitized with various sensitizing dyes to impart the light-sensitivity at the desired light-sensitive wavelength range and, for example, a cyanine dye, merocyanine dye of composite cyanine dye can be used alone or in admixture with two or more of them as the preferable sensitizing dye. Furthermore, if necessary, various photographic additives such as salts of noble metal, e.g. a gold, platinum, palladium, iridium, rhodium and/or ruthenium compound; chemical sensitizers such as a sulfur compound, a reductive substance or a thioether compound, a quaternary ammonium salt compound or a polyalkyleneoxide compound; a stabilizer such as triazoles, imidazoles, azaindenes, benzothiazoliums, zinc compounds, cadmium compounds or mercaptans; hardening agent such as chromium salts, zirconium salts, mucochloric acid, aldehyde compounds, triazone compounds, polyepoxy compounds, active halogen compounds, ketone compounds, acryloyl compounds, triethylene phosphamide compounds, ethyleneimine compounds; plasticizer of dihydroxy alkanes such as dihydroxyalkanes, e.g. glycerin or 1,5-pentadiol; a fluorescent brightening agent; an antistatic agent and a coating aid can be added and used alone or in combination with 2 or more of the above-mentioned additives. Into the resulting silver halide emulsion is included a dispersion solution wherein the coupler of this invention is dispersed, and such silver halide emulsion, if necessary, through a sublayer, a halation inhibiting layer, an inter layer, a yellow-filter layer or a protective layer is applied on a support, for example, a synthetic resin film such as cellulose acetate, cellulose nitrate, polycarbonate, polyethylene terephthalate or polystyrene, baryta paper, polyethylene-coated paper, or glass plate to give light-sensitive color photographic material. The light-sensitive color photographic material according to this invention may comprise not only a single layer but also two or more layers of a siliver halide emulsion layers, and further two or more emulsion layers which are light-sensitive at the same wave length range may be applied.

The light-sensitive color photographic material according to this invention can include, if necessary, a contrast adjusting agent, a development accelerator, a stabilizer, a latent image stabilizer, a formalin-fastness increasing agent, a mordant, a color turbidity preventing agent, a viscosity increasing agent, a latex, a mat agent, etc., in addition to the additives as mentioned above.

The light-sensitive color photographic material according to this invention is conveniently color developed according to the color developing process after exposure. Further, the coupler of this invention can be applied either to such light-sensitive color photographic material in that a coupler and a color developer are contained in the same layer, being kept not contacted to each other while they are unexposed but contacted after exposure or to such light-sensitive color photographic material in that a color developer is included in the coupler-free layer and moved when an alkaline treating solution is penetrated so that the color developing agent may be also to contact with the coupler. Further, in a light-sensitive color photographic material for diffusion transfer process, the coupler according to this invention can be used by being added to the light-sensitive element and/or image receiving element of said light-sensitive material and particularly the coupler is conveniently added to the light-sensitive element.

The light-sensitive color photographic material of this invention can provide a color image by means of the conventional color developing process. The basic step of the negative-positive process comprises the color developing, bleaching and fixing steps. On the other hand, the basic step of the reverse process comprises the development with a black and white negative developing solution and subsequent exposure to white light or treatment with a processing solution containing fog agent, followed by the color developing, bleaching and fixing steps. Each of the above basic steps may be carried out independently, but two or more steps may be carried out in a single treatment with such processing solution that possesses at the same time the multiple functions convering the two or more steps. For example, the monobath color photographic process which contains a color developer together with a ferric salt bleaching component and a thiosulfate fixing component, or the monobath bleaching and fixing process which contains an (ethylenediaminetetraacetato) iron (III) complex bleaching component and thiosulfate fixing component is included as such treatment.

There is no particular limitation to the process for treatment and any process for treatment can be applied. As typical processes, there are known, for example, the process comprising the color development followed by bleaching and fixing treatment and, if necessary, further washing with water and stabilization treatment; the process comprising the color development followed by bleaching and fixing effected separately, and, if necessary, further washing with water and stabilization treatment; the process comprising pre-hardening, neutralization, color development, stopping and fixing, washing with water, bleaching, fixing, washing with water, post-hardening, and then washing with water; the process comprising color development, washing it with water, complementary color development, stopping, bleaching, fixing, washing with water and stabilization; the process comprising pre-hardening, neutralization, washing with water, first development, stopping, washing with water, color development, stopping, washing with water, bleaching, fixing and washing with water; the process comprising pre-hardening, neutralization, first development, stopping, washing with water, color development, stopping, washing with water, bleaching bathing in organic acid, fixing and washing with water;

the process comprising first development, non-fixing silver dye bleach, washing with water, color development, acid rinse, washing with water, bleaching, washing with water, fixing, washing with water, stabilization and washing with water; development process in which developed silver caused by the color development is subjected to the halogenation bleach and thereafter again to the color development, increasing thereby the resulting dye quantity and the process comprising the treatment of a light-sensitive material of low silver content with an amplifier such as peroxide or cobalt complex. Any of the above-mentioned processes can be used for treatment. The treatment according to such processes may be carried out at a high temperature above 30° C. in order to prosecute the treatment rapidly, or at a room temperature or, in particular case, below 20° C. In general, the treatment is conveniently carried out at a temperature within the range of 20°–70° C.

There is no particular limitation on the additives to the processing solution used (referred to hereinafter as treating agent) and those usually used can be used. For example, as the pre-hardening processing agent, the combination of succinaldehyde and formalin can be used as the typical one. As the treatment put into practice, there are known the treatment with Process E-4, Process-ME-4, Ektachrome 160 or Ektachrome 40 (products of Eastman Kodak) and treatment with Vericolor. As the pre-hardening neutralizing agent, hydroxylamine, hydrazine, aniline, derivative, dimedones, resorcinol derivatives and ascorbic acids can be used as typical one.

In the present invention, the color developing solution containing more than 0.0292 mol/liter of a bromide ion usually contains the afore-mentioned color developer but it can contain optionally further various components which are usually added to a color developing solution, for example, an alkali agent such as sodium hydroxide, sodium carbonate and potassium carbonate, alkali metal sulfite, alkali metal bisulfite, alkali metal thiocyanate, alkali metal halide, benzyl alcohol, a water softening agent, a thickening agent and a development accelerator. The pH value of the present color developing solution is usually higher than 7 and most generally between about 9 and about 13.

Various additives added to the present color developing solution depending upon need include, more particularly, for example, a hydroxide, carbonate or phosphate of alkali metal or ammonium, a pH adjusting agent or a buffer (for example, weak acid such as acetic acid or boric acid, weak base and salts thereof), which keeps the pH value at a certain constant value, a development accelerator, for example, a pyridinium compound, cationic compounds, potassium nitrate or sodium nitrate, condensation product of polyethyleneglycol, phenyl cellosolve, phenyl carbitol, alkyl cellosolve, phenyl carbitol, dialkylformamide, alkyl phosphate and derivatives thereof, nonionic compounds such as polythioethers, polymer compounds having a sulfite ester, organic amines such as pyridine, ethanolamine and hydrazines.

The color developing solution of the present invention is lowered in the activity degree due to the higher concentration of bromide ion than that in the conventional color developing solution. It is preferable therefore to elevate the processing temperature and pH value. Alternatively, for the purpose of lowering the processing temperature, use of development accelerator is effective and the processing temperature can be lowered as the increase in the amount added. As the fog inhibiting agent other than bromides, there can be used, for example, not only alkali iodide and nitrobenzimidazoles but also those compounds for use in the solution used for rapid treatment such as mercaptobenzimidazole, 5-methylbenzotriazole and 1-phenyl-5-mercaptotetrazole, nitrobenzoic acid, benzothiazolium derivatives or fog inhibitor such as phenazine N-oxides. These fog inhibitors are conveniently used also for adjusting the color balance in the development treatment with the developing solution of this invention.

In addition, an antistain agent, an antisludge agent, superposed layer effect-increasing agent and a constancy maintaining agent (for example, a sulfite, acid sulfite, hydroxylamine hydrochloride, formsulfite or alkanolamine sulfite additive) can be added. As the chelating agent, phosphate such as polyphosphoric acid salt, nitrilotriacetic acid, aminopolycarboxylic acids such as 1,3-diamino-2-propanol-tetraacetic acid, hydroxycarboxylic acids such as citric acid or gluconic acid and 1-hydroxyethylidene-1,1-diphosphonic acid are included. Further, it is possible to use lithium sulfate together with the chelating agent, and the above chelating agents may be used in combination.

As the bleaching agent, a ferric salt, bichromate, iron (III) aminopolycarboxylic acid, metal salt of aliphatic polycarboxylic acid, persulfate, copper complex, cobalt complex, iodine, combination of bleaching powder and sulfamic acid, quinones, p-sulfophenylquinones and a nitroso compound are included.

As the bleaching accelerator and bleaching and fixing accelerator, there are included, for example, a water-soluble iodide, thioether compound containing polyethylene group, polyoxyethylene compound, thiourea and its derivative, a heterocyclic compound containing a mercapto group, a copper chelate compound, a selenium compound and thioselenate, selenourea and heavy metal salt of selenium semicarbazide, bis(1,2,4-triazol-3-yl)-diselenide, selenosemicarbazide and 1,2,4-triazol-3-selenol and derivatives thereof, a surface active agent, a phenylamine derivative, an onium compound, polyvinyl pyrrolidone, carboxythiazolidine, hydrobromide, halide, etc.

As the fixing agent, thiosulfate, dithiosuberic acid, polythiaalkanediol, thiocyanate, halide, thioether-polycarboxylic acid, bissulfonylalkane, etc. are included.

For the transfer of the light-sensitive photographic material while being treated, various transferring methods can be applied and various types of treating means can be used in accordance with such methods. For example, Rack and Tank Processing method, Continuous Processing method, roller transferring method or the like can be used. As a specific type method, the method, as described in Japanese Patent Publications No. 36-16989 and No. 46-40908, U.S. Pat. Nos. 3,189,452 and 3,607,277, according to which the light-sensitive photographic material is not dipped in the processing bath but the processing solution is coated on the light-sensitive material or sprayed can also be used effectively for the treatment of the light-sensitive color photographic material.

When the processing method of this invention is carried out according to such processing method in which supplement is effected at such degree as causing no substantial overflow, the supplement can be effected by means of a microdetermination pump. In the case of a kit of liquidized supplementing solution, the supplement is conveniently effected separately to each part of kit. Further, there has been developed a process for reproducing and using the processing solution or a process for recovering the chemicals which are important from the viewpoint of public pollution or resources, such as developer, heavy metals, etc., and some treating means have been arranged with equipments for practicing such process and can appropriately be used for the treatment.

The effect of this invention will be explained concretly by the examples given below but the practical embodiments of this invention will not be limited thereto.

EXAMPLE 1

A coupler as exemplified in Table 1 given below was dissolved and dispersed in the amount defined in the table in the mixture of dibutyl phthalate (DBP) and ethyl acetate (EA). The dispersion was then added to a silver iodobromide emulsion containing 6 mol% of silver iodide and coated on a cellulose acetate film base.

In this case, the coupler was included in the amount of $2\times10^{-1}$ mol per mol of silver halide and coated so that the amount of silver was 1.2 g/m$^2$. The sample thus obtained was subjected to a wedge exposure and the color development was carried out according to the following treating step:

Color development (3.25 min.) 43 bleaching (6.5 min.) → washing with water (3.25 min.) → fixing (6.5 min.) → washing with water (3.25 min.) → stabilization (1.5 min.) → drying.

Treating temperature is 38° C. excepting the color development. The temperature for color developing treatment is as defined in the Table 1.

Composition of developing solution:

| | |
|---|---|
| 4-amino-3-methyl-N-ethyl-N-(β-hydroxyethyl)aniline sulfate | 4.8 g |
| anhydrous sodium sulfite | 4.25 g |
| hydroxylamine sulfate | 2.0 g |
| anhydrous potassium carbonate | 30.0 g |
| nitriloacetic acid, trisodium salt | 2.5 g |
| potassium hydroxide | 1.0 g |
| sodium bromide (NaBr) | as defined in Table 1 |
| water to make up 1 liter | |
| pH being adjusted to 10.0 with potassium hydroxide | |

Composition of bleaching solution:

| | |
|---|---|
| ethylenediaminetetraacetic acid iron (III) ammonium salt | 100.0 g |
| ethylenediaminetetraacetic acid di ammonium salt | 10.0 g |
| ammonium bromide | 150.0 g |
| glacial acetic acid | 10.0 ml |
| water to make up 1 liter | |
| pH being adjusted to 6.0 with aqueous ammonia | |

Composition of fixing solution:

| | |
|---|---|
| ammonium thiosulfate | 85 g |
| anhydrous sodium sulfite | 6.0 g |
| sodium metasulfite | 2.8 g |
| water to make up 1 liter | |
| pH being adjusted to 6.0 with acetic acid | |

Composition of stabilizing solution:

| | |
|---|---|
| 37% aqueous formalin solution | 5 ml |
| polyethyleneglycol-p-tert.octyl-phenylether | 0.5 g |
| water to make up 1 liter | |

As shown in Table 1, each treatment was carried out under such condition where the sensitometry characteristics was made almost equivalent by the combination of the bromine ion concentration and temperature condition.

RMS granularity at the point of 0.3 of developed color density of a film after being color developed is shown in Table 1 (in which RMS granularity is an 1000-fold value of the standard deviation of variation at the measured density value of 0.3 which is obtained by scanning a sample which has been uniformly exposed and developed with a microdensitometer having 25 μ of round scanning opening diameter).

Table 1

| NaBr g/l | Color developing temperature C.° | Sample No. Coupler No. | 1 AY48 | 2 AY137 | 3 AY152 | 4 AY129 | 5 AY249 | 6 AY259 | 7 AY278 | 8 AY303 | 9 A | 10 B | 11 C | 12 D |
|---|---|---|---|---|---|---|---|---|---|---|---|---|---|---|
| 1.2 | 38 | | 76 | 79 | 82 | 80 | 82 | 83 | 80 | 79 | 75 | 86 | 78 | 84 |
| 1.8 | 40 | R | 76 | 79 | 81 | 79 | 81 | 82 | 81 | 81 | 74 | 88 | 76 | 82 |
| 2.5 | 41 | M | 74 | 75 | 80 | 77 | 79 | 80 | 79 | 81 | 75 | 85 | 75 | 81 |
| 3.0 | 42 | S | 70 | 68 | 76 | 72 | 72 | 71 | 76 | 77 | 73 | 84 | 75 | 79 |
| 4.3 | 43.5 | | 68 | 66 | 70 | 65 | 68 | 67 | 72 | 73 | 71 | 86 | 73 | 78 |
| 5.5 | 45 | | 54 | 46 | 47 | 52 | 62 | 63 | 65 | 67 | 72 | 84 | 73 | 77 |
| 7.0 | 46 | | 41 | 46 | 45 | 43 | 48 | 49 | 54 | 57 | 70 | 81 | 72 | 74 |

In Table 1, samples 1,2,3,4,5,6,7 and 8 contain the couplers of this invention, and among them, samples 1, 2, 3 and 4 contain a coupler of the general formula (I), samples 5 and 6 contain a coupler of the general formula (II), sample 7 contains a coupler of the general formula (III), sample 8 contains a coupler of the general formula (IV) and samples 7, 8, 9 and 10 contain a coupler other than that according to this invention.

Couplers, A, B, C and D which are outside the present invention have the following structures, respectively:

A.

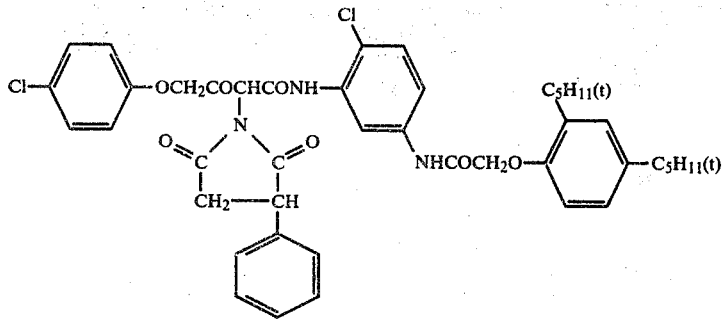

B.

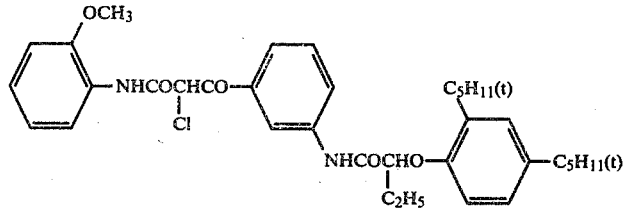

C.

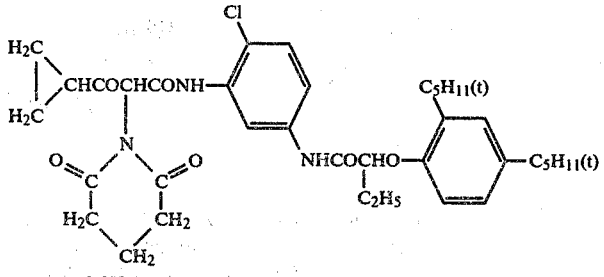

D.

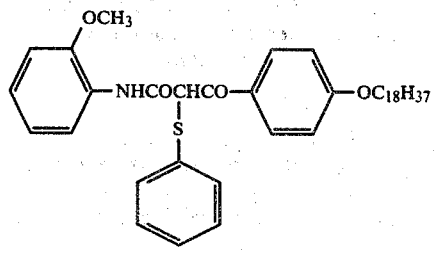

From the result as shown in the Table 1, it is apparent that when the concentration of sodium bromide is larger than 3.0 g/l (0.0292 mol/l), the RMS granularity is decreased in the case of the present couplers, in particular, when it is greater than 5.5 g/l (0.0534 mol/l), RMS granularity is decreased and consequently granularity is improved.

Further, it is apparent that among the couplers of this invention, the coupler of the general formula (III) is superior to that of the general formula (IV), the coupler of the general formula (II) is superior to that of the general formula (III) and the coupler of the general formula (I) is superior to that of the general formula (II),

EXAMPLE 2

A coupler as exemplified in Table 2 given below was dissolved in DBP in the amount as defined in said Table 2 and protect despersed in an aqueous gelatin solution. The dispersion was then added to a silver chlorobromide emulsion and coated and dried on a resin-coated support to give a sample. In this case, the coupler was included in the amount of $2 \times 10^{-1}$ mol per mol of silver halide and coated so that the amount of silver may be 400 mg.m$^2$. The sample thus obtained was subjected to wedge exposure and subsequently color development according to the following treating step:

Color development (3.5 min.) → bleaching and fixing (1.5 min.) → washing with water (2 min.) → stabilization (1 min.) → drying.

Treating temperature was 31°0 C. except for the color development which was carried out at the temperature as defined in the Table 2 below. Composition of each treating solution is shown below.

Color developing solution:

| | |
|---|---|
| potassium carbonate | 30 g |
| sodium sulfite | 2 g |
| hydroxylamine (sulfate) | 3 g |
| benzyl alcohol | 15 ml |
| 4-amino-N-ethyl-N-(β-methanesulfonamidoethyl)-m-toluidinesesquisulfate monohydrate | 5 g |
| sodium bromide | as defined in table 2 |
| water to make up 1 liter | |
| pH being adjusted to 10.15 | |

Composition of bleaching and fixing solution:

| |
|---|
| ferric salt of ethylene |

-continued

| | |
|---|---|
| diaminetetraacetic acid | 45 g |
| ammonium thiocyanate | 10 g |
| sodium sulfite | 10 g |
| ammonium thiosulfate (60%) | 100 g |
| ethylenediamine tetraacetic acid sodium salt | 5 g |
| water to make up 1 liter | |
| pH being adjusted to 6.9 with aqueous ammonia | |

Composition of stabilizing solution:

| | |
|---|---|
| succinic acid | 10 g |
| formalin (37% aqueous solution) | 15 ml |

after addition of 800 ml of water and subsequently adjustment of pH to 3.9 with sodium acetate, water being added to makeup 1 liter.

The color development treatment was carried out, as shown in Table 2, under such condition where almost equivalent sensitometry characteristics was obtained by the combination of the bromine ion concentration and temperature.

pler of the general formula (IV) and the samples 21 and 22 contain couplers outside the present invention.

Couplers (E) and (F) which are those outside the present invention have the following structural formulae, respectively:

E.

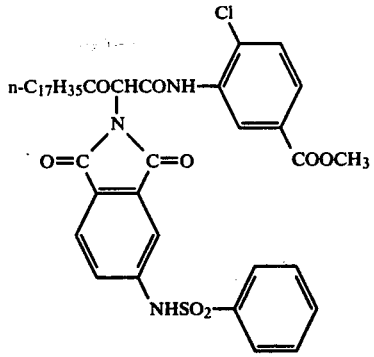

F.

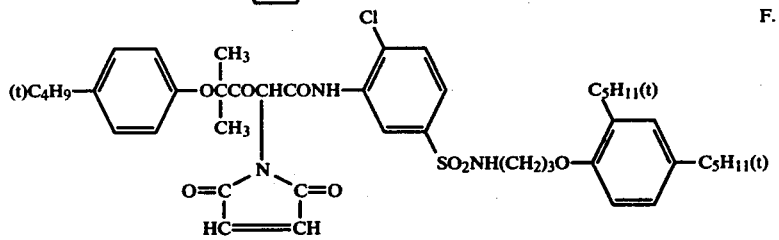

From the result as shown in the Table 2, it is noted that the samples containing the couplers of this invention are improved in granularity by the treatment with a color developing solution containing more than 3.0 g/l (0.0292 mol/l) of sodium bromide.

EXAMPLE 3

On a resin-coated paper support, each of the following layers was coated in the saccession as defined from the support to prepare a sample (sample 23):

Layer 1: Yellow-foring, blue-sensitive silver halide emulsion layer

The exemplified coupler (AY-37) was dissolved in DBP and dispersed in an aqueous gelatin solution. The dispersion was then added to a silver chloroiodobromide emulsion containing 2 mol% of silver iodide and 80% of silver bromide and coated so that the amount of silver was 400 mg/m² and the amount of the coupler was 562 mg/m².

Layer 2: Interlayer (gelatin layer, 1 μ of film thickness)

Layer 3: Green-sensitive silver halide emulsion layer

Table 2

| NaBr g/l | Color development temperature (C.°) | Sample No. | 13 | 14 | 15 | 16 | 17 | 18 | 19 | 20 | 21 | 22 |
|---|---|---|---|---|---|---|---|---|---|---|---|---|
| | | Coupler No. | AY16 | AY39 | AY160 | AY196 | AY253 | AY265 | AY290 | AY307 | E | F |
| | | Amount of coupler coated | 575 (mg/m²) | 600 | 600 | 611 | 527 | 391 | 496 | 438 | 588 | 619 |
| 0.43 | 31 | Granularity | X | X | X | X | X | X | X | X | X | X |
| 1.8 | 41 | | X | X | X | X | X | X | X | X | X | X |
| 3.0 | 45 | | ◎ | ◎ | ◎ | ◎ | ○ | ○ | ○ | ○ | X | X |
| 4.3 | 48 | | ◎ | ◎ | ◎ | ◎ | ○ | ○ | ○ | ○ | X | X |
| 5.5 | 50 | | ◎ | ◎ | ◎ | ◎ | ○ | ○ | ○ | ○ | X | X |

X: Granularity observed by microscope is not good.
○: Granularity observed by microscope is good.
◎: Granularity observed by microscope is excellent.

In the Table 2, samples 13, 14, 15, 16, 17, 18, 19 and 20 contain the couplers of this invention and among them, samples 13, 14, 15 and 16 contain couplers of the general formula (I), samples 17 and 18 contain couplers of the general formula (II), the sample 19 contains a coupler of the general formula (III), the sample 20 contains a cou- The magenta coupler having the following structural formula was dissolved in tricresyl phosphate (TCP) and dispersed in an aqueous gelatin solution. The dispersion was then added to a silver chlorobromide emulsion containing 80 mol% of silver bromdie and subsequently coated so that the amount of silver was 560 mg/m$^2$ and the amount of the coupler was 684 mg/m$^2$.

Magenta coupler:

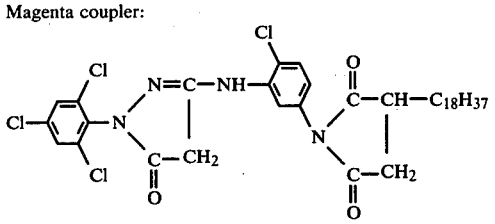

Layer 4: Interlayer (gelatin layer, 1$\mu$ of film thickness)

Layer 5: Cyan-forming, red-sensitive silver halide emulsion layer

The cyan coupler having the structural formula given below was dissolved in TCP and dispersed in an aqueous gelatin solution. The dispersion was then added to a silver chlorobromide emulsion containing 80 mol% of silver bromide and subsequently coated so that the amount of silver was 500 mg/m$^2$ and the amount of the coupler was 458 mg/m$^2$.

Cyan coupler

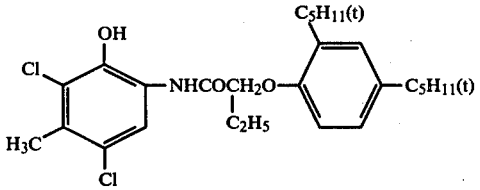

Layer 6: Protective layer (gelatin layer, 1$\mu$ of film thickness)

In the layer 1, layer 3 and layer 5, there were contained as the stabilizer, 4-hydroxy-6-methyl-1,3,3a,7-tetraziaindene sodium salt, as a hardening agent, bis(vinylsulfonylmethyl)ether and as a coating aid, saponin, respectively.

The above sample was subjected to a wedge exposure and then a similar treatment as in Example 2 was effected, with the proviso that a comparison was made between the case where 0.1% of the bleaching and fixing solution of Example 2 was admixed to the color developing solution and the case where no such admixture was effected.

Fog densities of the yellow, magenta and cyan images of the sample after being treated are shown in Table 3 below in terms of blue density (B), green density (G) and red density (R), respectively.

Table 3

| NaBr | Color developing temperature | With admixture of bleaching and fixing solution | | | Without admixture of bleaching and fixing solution | | |
|---|---|---|---|---|---|---|---|
| g/l | C.° | B | G | R | B | G | R |
| 0.43 | 31 | 0.40 | 0.56 | 0.40 | 0.05 | 0.02 | 0.02 |
| 1.80 | 41 | 0.21 | 0.28 | 0.15 | 0.05 | 0.03 | 0.02 |
| 3.0 | 45 | 0.08 | 0.04 | 0.03 | 0.06 | 0.03 | 0.02 |
| 4.3 | 48 | 0.07 | 0.04 | 0.02 | 0.06 | 0.03 | 0.02 |
| 5.5 | 50 | 0.06 | 0.03 | 0.02 | 0.06 | 0.03 | 0.02 |

From the result as shown in the above Table 3, it is apparent that when the concentration of sodium bromide is greater than 3.0 g/l (0.0292 mol/1), no color fog due to the admixture of a bleaching and fixing solution is brought about. On the observation with a microscope of granularity of yellow dye image it was confirmed that granularity is improved when the concentration of sodium bromide is more than 3.0 g/l.

EXAMPLE 4

On a support comprising cellulose triacetate film, each of the following layers was coated in the succession as defined from the support to prepare a sample (sample 24):

Layer 1: Antihalation layer (gelatin layer containing black colloidal silver, 1$\mu$ of film thickness)

Layer 2: Cyan-forming, red-sensitive silver halide emulsion layer

A mixture of 5 g of the colored coupler having the structural formula as given below, 20 g of the cyan coupler having the structural formula ;as given below and 2 g of DIR compound having the structural formula as given below was dissolved in TCP and dispersed in an aqueous gelatin solution. The dispersion was then added to a silver iodobromide gelatin emulsion and subsequently coated so that the following condition was achieved:

Amount of silver: 3.4 g/m$^2$

Amount of coupler mixture: 1.4 g/m$^2$

Colored coupler

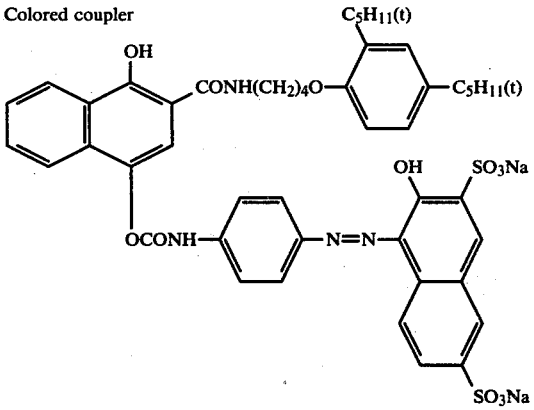

Cyan coupler

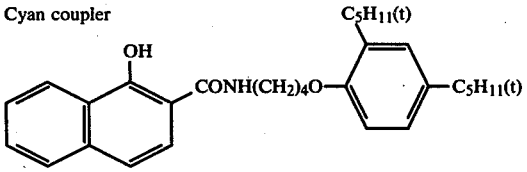

DIR compound

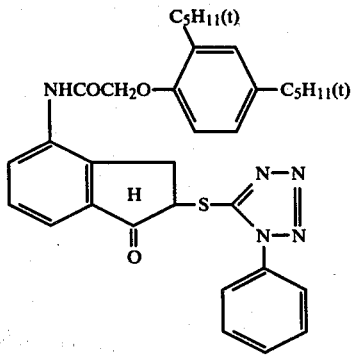

Layer 3: Interlayer (gelatin layer, 1μ of film thickness)

Layer 4: Magenta-forming, green-sensitive silver halide emulsion layer

A mixture of 5 g of the colored coupler having the structural formula set forth below, 25 g of the magenta coupler having the structural formula as given below and 2 g of DIR compound (the same as that used in layer 2) was dissolved in TCP and dispersed in an aqueous gelatin solution. The dispersion was then added to a silver iodobromide gelatin emulsion containing 6 mol% of silver halide and subsequently coated so that the following condition was achieved:

Amount of silver: 3.2 g/m²

Amount of coupler mixture: 1.2 g/m²

Colored coupler

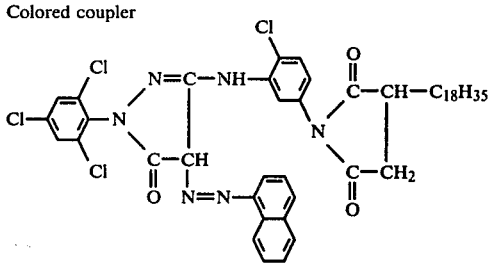

Magenta coupler

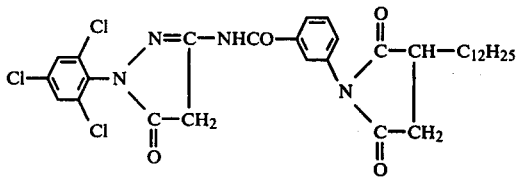

Layer 5: Interlayer (gelatin layer, 1μ of film thickness)

Layer 6: Yellow filter layer (gelatin layer containing yellow colloidal silver, 1μ of film thickness)

Layer 7: Yellow-forming, blue-sensitive silver halide emulsion layer

A mixture of 26 g of the exemplified coupler (AY-49) and 6 g of the yellow coupler having the structural formula as given below was dissolved in DBP and dispersed in an aqueous gelatin solution. The dispersion was then added to a silver iodobromide emulsion containing 7 mol% of silver iodide and subsequently coated so that the following condition was achieved:

Amount of silver: 1.0 g/m²

Amount of the coupler mixture: 1.4 g/m²

Yellow coupler:

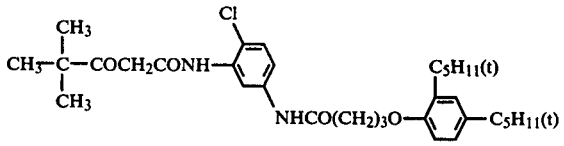

Layer 8: Protective layer (gelatin layer, 1μ of film thickness)

In the above layer 2, layer 4 and layer 7, there were contained as the stabilizer, 4-hydroxy-6-methyl-1,3,3a,7-tetrazaindene sodium salt, as a hardening agent, 1,2-(vinylsulfonyl)ethane and as a coating aid, saponin, respectively.

The above sample was subjected to wedge exposure and then color developed under the same condition as in Example 1 and under such condition where the sensitometry characteristics of each treatment was almost equivalent. Further, the effect due to presence or absence of admixture of the fixing solution into the color developing solution was determined (where 3 ml of the fixing solution was admixed with 1 liter of the color developing solution). For densities of the yellow, magenta and cyan images of the sample after being treated are shown in Table 4 below in terms of blue density (B), green density (G) and red density (R), respectively (the term "fog density" means a value obtainable by subtracting the mask density of colored coupler).

Table 4

| NaBr | Color developing temperature | With admixture of fixing solution | | | Without admixture of fixing solution | | |
|---|---|---|---|---|---|---|---|
| g/l | C.° | B | G | R | B | G | R |
| 1.2 | 38 | 0.32 | 0.40 | 0.19 | 0.12 | 0.20 | 0.13 |
| 1.8 | 40 | 0.30 | 0.38 | 0.18 | 0.12 | 0.20 | 0.13 |
| 2.5 | 41 | 0.26 | 0.37 | 0.18 | 0.12 | 0.21 | 0.13 |
| 3.0 | 42 | 0.15 | 0.21 | 0.15 | 0.13 | 0.18 | 0.13 |
| 4.3 | 43.5 | 0.13 | 0.16 | 0.15 | 0.13 | 0.17 | 0.12 |
| 5.5 | 45 | 0.11 | 0.15 | 0.13 | 0.13 | 0.15 | 0.12 |
| 7.0 | 46 | 0.11 | 0.15 | 0.13 | 0.13 | 0.15 | 0.12 |

As apparent from Table 4, it is noted that when the concentration of sodium bromide is greater than 3.0 g/l (0.0292 mol/l), the color fog due to admixture of the fixing solution is reduced and, particularly, when the concentration is greater than 5.5 g/l (0.0534 mol/l), no substantial color fog is brought about. Further, on observation by means of a microscope of granularity of the yellow dye image, it was confirmed that particular improvement in the granularity is achieved at the concentration of more than 3.0 g/l, in particular more than 5.5 g/l.

EXAMPLE 5

The sample of Example 4 (Sample No. 24) was adjusted to 35 mm of width and subjected to the photograph by camera under the exposure condition of ASA 100 and then the photographed sample 24 was treated continuously under the conditions of the treatment A and treatment B as given below for 9000 m, respectively, while effecting supplement of the treating solution by means of the automatic developing machine Model 35-7 KO II prepared by Pako Company.

| Treating Step | Treating Temperature Treatment A | Treatment B | Treating Time |
|---|---|---|---|
| color development | 38° C. | 48° C. | 3.25 min |
| bleaching | 38° C. | 38° C. | 6.5 min |
| first washing with water | 38° C. | 38° C. | 3.25 min |
| fixing | 38° C. | 38° C. | 6.5 min |
| second washing with water | 38° C. | 38° C. | 3.25 min |
| stabilization | 38° C. | 38° C. | 1.5 min |

The treatment temperature condition of the color developing solution according to the treatment B was set so that almost equivalent sensitometry characteristics as that of the comparative treatment A may be achievable, in view of the relation with the formulation.

(1) Composition of color developing solution (g/l) and amount of supplement (cc/m)

| Composition | Tank solution Treatment A | Tank solution Treatment B | Supplement solution Treatment A | Supplement solution Treatment B |
|---|---|---|---|---|
| potassium carbonate | 30 | 30 | 33 | 40 |
| potassium sulfite | 3 | 3 | 5 | 6.5 |
| sodium bromide | 1.2 | 10.6 | 0.9 | 0 |
| potassium iodide | $2 \times 10^{-3}$ | $2 \times 10^{-3}$ | 0 | 0 |
| hydroxylamine sulfate | 3 | 3 | 3.5 | 3.5 |
| 4-amino-3-methyl-N-ethyl-N-(β-hydroxyethyl)-aniline sulfate | 4.8 | 4.8 | 5.5 | 18.2 |
| pH | 10.02 | 10.02 | 10.10 | 10.28 |
| amount of supplement | — | — | 70 | 2.5 |

The term "tank solution" means the solution which has been originally charged in the tank ( the same meaning as above will be referred to hereinafter for the same term).

(2) Composition of bleaching solution and amount of supplement

To both treatment A and treatment B were applied 35 ml of supplement per m of the light-sensitive material at the same composition used in Example 1 (tank solution and supplementing solution having the same composition).

(3) First washing with water 900 ml Of water was run per m of the light-sensitive material.

(4) Composition of fixing solution and amount of supplement

To both the treatment A and treatment B were applied 35 ml of supplement per m of the light-sensitive material at the same composition used in Example 1 (tank solution and supplementing solution having the same composition).

(5) Second washing with water 900 ml Of water was run per m of the light-sensitive material.

(6) Composition of stabilizing solution and amount of supplement

To both the treatment A and treatment B were applied 35 ml of supplement per m of the light-sensitive material, at the same composition used in Example 1 (tank solution and supplementing solution having the same composition).

With regard to the photographic characteristics, there was observed no change thereof between the initiation stage of the treatment A and the treatment B, respectively, of the above sample which has been subjected to wedge exposure and the completion stage of the 9,000 m treatment.

Further, on the observation by means of a microscope of granularity of yellow dye image of the treated sample, it was noted that outstandingly more excellent granularity is achieved when the same sample is treated according to the treatment B compared with the case where the sample is treated according to the treatment A.

Further, the treatment A caused about 67.5 cc per m of sample of overflow, whereas no substantial overflow was required for the treatment B. Consequently, the treatment B is particularly advantageous from the viewpoint of public pollution.

when the index of pollution level of the waste solution (overflow solution) of the color developing solution as caused in the treatment of the light-sensitive material according to the treatment A in the unit length is defined as 100, the comparison between the treatment A and the treatment B is as follows:

Table 5

| | Treatment A | Treatment B |
|---|---|---|
| Pollution | 100 | 0.7 |

Thus, it was proved that according to the present invention, not only granularity is improved but also particularly advantageous effect on removing public pollution problem is achieved.

EXAMPLE 6

A coupler as exemplified in Table 6 given below was dispersed in the amount as defined in said Table in a mixture of DBP and ethyl acetate. The dispersion was then added to a silver iodobromide emulsion containing 5 mol% of silver iodide and then coated on cellulose acetate film so that $3 \times 10^{-1}$ mol of coupler per mol of silver halide was contained and the amount of silver was 1.0 g/m$^2$ to give a sample. The sample was subjected to wedge exposure and subsequently to the following development step:

First development (38° C., 3 min.)→first stopping (38° C., 30 sec.)→washing with water (38° C., 1 min.)→color development (43° C., 3 min. 40 sec.)→second stopping (38° C., 30 sec.)→washing with water (38° C., 1 min.)→bleaching (38° C., 6 min.)→fixing (38° C., 6 min.)→washing with water (38° C., 3 min.)→stabilization (38° C., 30 sec.)→drying.

Composition of each treating solution will be given below. Composition of the first developing solution:

| | |
|---|---|
| sodium polyphosphate | 2.0 g |
| sodium bisulfite (anhydrous) | 8.0 g |
| phenidone | 0.35 g |
| sodium sulfite | 37.0 g |
| hydroquinone | 5.5 g |
| sodium carbonate | 33.0 g |
| sodium thiocyanate (10% aqueous solution) | 13.8 ml |
| sodium bromide | 1.3 g |
| potassium iodide (0.1% aqueous solution) | 23.0 ml |
| water to make up 1 liter | |
| pH being adjusted to 9.9 ± 1 | |

Composition of the first stopping solution:

| | |
|---|---|
| sodium hydroxide | 1.75 g |
| glacial acetic acid | 30 ml |
| water to make up 1 liter | |

-continued

| |
|---|
| pH being adjusted to 3.8 |

Composition of color developing solution:

| | |
|---|---|
| sodium polyphosphate | 5.0 g |
| benzyl alcohol | 4.5 g |
| sodium sulfite | 7.5 g |
| trisodium phosphate 12 hydrate | 36.0 g |
| sodium bromide | as defined in Table 6 |
| potassium iodide (0.1% aqueous solution) | 90 ml |
| 4-amino-N-ethyl-N-(β-methanesulfonamidoethyl)-m-toluidine sesquisulfate monohydrate | 11.0 g |
| ethylene amine | 3.0 g |
| tertiary-butylaminoborane hydride | 0.07 g |
| water to make up 1 liter | |
| pH being adjusted to 11.65 ± 0.1 with sodium hydroxide | |

Composition of the second stopping solution:
This is the same as that of the first stopping solution.
Composition of the bleaching solution:

| | |
|---|---|
| ethylenediaminetetraacetic acid iron (III) ammonium salt | 170 g |
| ammonium bromide | 160 g |
| water to make up 1 liter | |
| pH being adjusted to 5.8-6.0 | |

Composition of the fixing solution:

| | |
|---|---|
| sodium thiosulfate | 94.5 g |
| sodium bisulfite | 17.6 g |
| disodium phosphate | 15.0 g |
| water to make up 1 liter | |
| pH being adjusted to 5.95 ± 0.2. | |

Composition of the stabilizing solution:

| | |
|---|---|
| formalin (37% aqueous solution) | 12 ml |
| polyethyleneglycol-p-tertiary octylphenylether | 1 g |
| water to make up 1 liter. | |

The color development was carried out, as shown in the Table 6, under such condition where the sensitometry characteristics were almost equivalent for each treatment by the combination of the bromine ion concentration and temperature.

In the Table 6 above, the samples 25, 26, 27, 28, 29, 30, 31 and 32 contained the couplers of this invention and sample 33 contained the following coupler G which is outside the present invention:

Coupler G

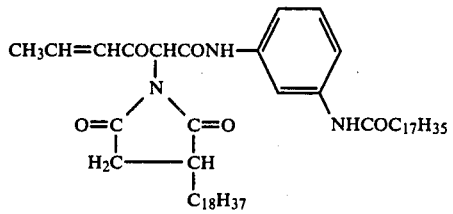

From the result of the Table 6, it is apparent that when the concentration of sodium bromide is greater than 3 g/l (0.0292 mol/l), RMS granularity is decreased in the case where the couplers of this invention are used, in particular, when the concentration is greater than 5.58 g/l (0.0534 mol/l), RMS granularity is decreased and improvement in granularity is achieved.

What we claim is:

1. A process for developing an image-wise exposed light-sensitive silver halide color photographic material with a color developing solution which process comprises conducting the development with the developing solution containing 0.0534 to 3.0 mol/l of bromide ion in the presence of a yellow coupler represented by general formula [I], [II], [III]or [IV];

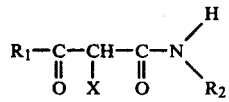

(I)

wherein $R_1$ represents a chained or cyclic alkyl group having at the end thereof a tertiary carbon atom which is directly attached to the carbonyl group, or an aryl group, X represents

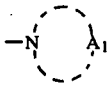

or a group on which oxygen is directly attached to the active point, said group being able to split off during coupling and said oxygen being directly attached to a non-metal atom having a double bond, $A_1$ represents and atomic group necessary for forming an imido group, a pyrrole group or a diazole group, and $R_2$ represents an aryl group or a heterocyclic ring;

Table 6

| NaBr Xg/l | Color developing temperature Y °C. | Sample No. / Coupler No. | 25 AY118 | 26 AY120 | 27 AY133 | 28 AY179 | 29 AY263 | 30 AY255 | 31 AY280 | 32 AY308 | 33 G |
|---|---|---|---|---|---|---|---|---|---|---|---|
| 0.9 | 43 | | 51 | 52 | 56 | 54 | 53 | 54 | 51 | 52 | 54 |
| 2.2 | 45.1 | R | 48 | 49 | 47 | 51 | 50 | 51 | 52 | 51 | 52 |
| 3.0 | 46.5 | | 44 | 44 | 45 | 46 | 47 | 46 | 48 | 48 | 50 |
| 5.5 | 49 | M | 32 | 35 | 34 | 33 | 38 | 39 | 42 | 44 | 48 |
| 7.0 | 50.5 | S | 30 | 31 | 33 | 31 | 35 | 34 | 41 | 43 | 46 |
| 10.9 | 53 | | 30 | 29 | 28 | 29 | 33 | 32 | 36 | 38 | 40 |

(In the above Table, RMS granularity was determined by the similar method as in Example 1 and the measured concentration value was defined as 0.5).

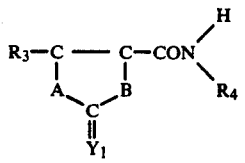

(II)

wherein $R_3$ represents a chained or cyclic alkyl group, an aryl group or a heterocyclic ring, A and B each represent oxygen or >N—R′(wherein R′ represents hydrogen, an alkyl group, an aryl group, or an acyl group), $Y_1$ represents oxygen or sulfur and $R_4$ represents an aryl group or a heterocyclic ring, provided that there are excluded the case where A and B are the same;

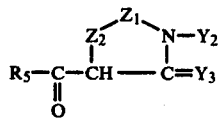

(III)

wherein $R_5$ represents a chained or cyclic alkyl group, an aryl group or a heterocyclic ring, $Y_2$ represents hydrogen or $R_3$; when $Z_1$ represents a carbonyl group or a thiocarbonyl group, $Y_3$ and $Z_2$ each represent oxygen or sulfur; and when $A_1$ represents a chained or cyclic alkylene group, an arylene group or a divalent heterocyclic ring, $Y_3$ represents oxygen and $Z_2$ represents oxygen, sulfur, or nitrogen substituted by an acyl group or a sulfonyl group;

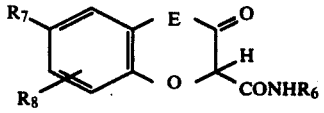

(IV)

wherein $R_6$ represents an aryl group, $R_7$ represents a group which is not split off during coupling, $R_8$ represents hydrogen, halogen, an alkyl group, an alkoxy group, an aryloxy group or an acylamino group, and E represents a simple bond or $—C(CH_3)_2—$.

2. A process according to claim 1 wherein the color developing solution contains the yellow coupler.

3. A process according to claim 1 wherein the light sensitive silver halide color photographic material comprises the yellow coupler.

4. A process according to claim 3 wherein $R_1$ represents a chained or cyclic alkyl group having 4–18 carbon atoms or a phenyl group.

5. A process according to claim 3 wherein $R_2$ represents a phenyl group.

6. A process according to claim 3 wherein the yellow coupler is represented by general formula [I], [II]or [III].

7. A process according to claim 6 wherein the yellow coupler is represented by general formula [I]or [II].

8. A process according to claim 7 wherein the yellow coupler is represented by general formula [I].

9. A process according to claim 1 wherein the color developing solution contains an aromatic primary amine compound.

10. A process according to claim 9 wherein the aromatic primary amine compound is p-phenylene diamine.

11. A process according to claim 9 wherein the color developing solution contains 0.0002–0.7 mol/liter of the aromatic primary amine compound.

* * * * *